US006905530B2

(12) United States Patent
Yoshimura et al.

(10) Patent No.: US 6,905,530 B2
(45) **Date of Patent: *Jun. 14, 2005**

(54) METALLIC POWDER-MOLDED BODY, RE-COMPACTED BODY OF THE MOLDED BODY, SINTERED BODY PRODUCED FROM THE RE-COMPACTED BODY, AND PROCESSES FOR PRODUCTION THEREOF

(75) Inventors: Takashi Yoshimura, Kanagawa (JP); Hiroyuki Amma, Yokohama (JP); Masashi Fujinaga, Chiba (JP); Mitsumasa Iijima, Kanagawa (JP); Yasuo Hatai, Kanagawa (JP); Takayuki Matsumoto, Kanagawa (JP); Satoshi Uenosono, Chiba (JP); Shigeru Unami, Chiba (JP)

(73) Assignees: Unisia Jecs Corporation, Atsugi (JP); Kawasaki Steel Corporation, Kobe (JP)

( * ) Notice: Subject to any disclaimer, the term of this patent is extended or adjusted under 35 U.S.C. 154(b) by 249 days.

This patent is subject to a terminal disclaimer.

(21) Appl. No.: 10/180,133

(22) Filed: Jun. 27, 2002

(65) Prior Publication Data

US 2002/0159908 A1 Oct. 31, 2002

Related U.S. Application Data

(62) Division of application No. 09/647,862, filed as application No. PCT/JP00/01615 on Mar. 17, 2000, now Pat. No. 6,503,443.

(30) Foreign Application Priority Data

Apr. 16, 1999 (JP) ..... 11-109056
Apr. 16, 1999 (JP) ..... 11-110073

(51) Int. Cl.[7] ..... C22C 33/02
(52) U.S. Cl. ..... 75/231; 419/11
(58) Field of Search ..... 75/231; 419/11, 419/55

(56) References Cited

U.S. PATENT DOCUMENTS 5,108,493 A 4/1992 Causton ..... 75/255

(Continued)

FOREIGN PATENT DOCUMENTS

BE 508993 2/1952

(Continued)

OTHER PUBLICATIONS

Pamphlet, "the Second Presentation of Developments in Powder Metallurgy.", Published by Japan Powder Metallurgy Association, Nov. 15, 1985, p. 90.

(Continued)

*Primary Examiner*—Daniel Jenkins
(74) *Attorney, Agent, or Firm*—Foley & Lardner LLP

(57) ABSTRACT

In a preliminary molding step 1, a metallic powder mixture 7 obtained by blending an iron-based metal powder 7*a* with graphite 7*b* such that the graphite is present in an amount of preferably not less than 0.1% by weight, more preferably not less than 0.3% by weight, is compacted into a preform 8 having a density of not less than 7.3 g/cm$^3$. In a provisional sintering step 2, the preform 8 is provisionally sintered at a predetermined temperature to form a metallic powder-molded body 9 having a structure in which the graphite remains along a grain boundary of the metal powder. In a re-compaction step 3, the metallic powder-molded body 9 is re-compacted into a re-compacted body 10. In a re-sintering step 4, the re-compacted body 10 is re-sintered to obtain a sintered body 11. In a heat treatment step 5, the sintered body 11 is heat-treated to obtain a heat-treated sintered body 11.

Accordingly, in accordance with the present invention, there are provided a re-compacted body produced from a metallic powder-molded body having an excellent deformability which is suitably applied to the production of machine parts exhibiting high mechanical properties due to the use of sintered metal, and a sintered body produced from the re-compacted body as well as a process for the production thereof.

21 Claims, 39 Drawing Sheets

U.S. PATENT DOCUMENTS

| | | | | |
|---|---|---|---|---|
| 5,154,881 | A | 10/1992 | Rutz et al. | 419/37 |
| 5,368,630 | A | 11/1994 | Luk | 75/252 |
| 5,571,305 | A | 11/1996 | Uenosono et al. | 75/246 |
| 5,641,922 | A | 6/1997 | Shivanath et al. | 75/231 |
| 5,872,322 | A | 2/1999 | Mocarski et al. | 75/246 |
| 6,159,266 | A * | 12/2000 | Yoshimura et al. | 75/243 |
| 6,203,753 | B1 | 3/2001 | Donaldson | 419/54 |
| 6,503,443 | B1 * | 1/2003 | Yoshimura et al. | 19/38 |
| 6,514,307 | B2 * | 2/2003 | Nakamura et al. | 75/243 |

FOREIGN PATENT DOCUMENTS

| | | |
|---|---|---|
| CH | 352352 | 4/1961 |
| EP | 0 418 943 | 3/1991 |
| GB | 1 402 660 | 8/1975 |
| JP | 1-123005 | 5/1989 |
| JP | 1-165702 | 6/1989 |
| JP | 7-173504 | 7/1995 |
| JP | 8-144026 | 6/1996 |
| JP | 8-144027 | 6/1996 |
| JP | 9-049047 | 2/1997 |
| JP | 9-049061 | 2/1997 |
| JP | 9-049062 | 2/1997 |
| JP | 9-049064 | 2/1997 |
| WO | 97/43066 | 11/1997 |

OTHER PUBLICATIONS

Ferguson, H., & Smith, S.K., Metal Powder Products Co., SAE Technical paper Series 1999–01–0294 Precision cold forging of a P/M Preform to produce a high density.

* cited by examiner 0.5%C

SINTERING TEMPERATURE 800°C

| DENSITY(g/cm³) | ELONGATION(%) |
|---|---|
| 6. 1 | 3. 7 |
| 6. 3 | 4. 2 |
| 6. 5 | 4. 1 |
| 6. 7 | 4. 9 |
| 6. 9 | 5. 2 |
| 7. 1 | 6. 6 |
| 7. 3 | 11. 1 |
| 7. 5 | 12. 1 |

DENSITY 7.3

| ELONGATION (%) | 0. 3%C | 0. 5%C | 1. 0%C | 2. 0%C |
|---|---|---|---|---|
| 700°C | 4 | 4. 5 | 3. 1 | 3. 3 |
| 800°C | 10. 7 | 11. 1 | 10. 9 | 10. 6 |
| 900°C | 15. 8 | 16. 2 | 15. 5 | 14. 8 |
| 950°C | 16. 2 | 15. 9 | 15. 8 | 15 |
| 1000°C | 15. 7 | 15. 7 | 15. 1 | 14. 6 |
| 1100°C | 7 | 6. 5 | 4. 4 | 2. 8 |

DENSITY 7.5

| ELONGATION (%) | 0. 3%C | 0. 5%C | 1. 0%C | 2. 0%C |
|---|---|---|---|---|
| 700°C | 4. 4 | 4. 2 | 3. 2 | 3. 7 |
| 800°C | 11. 5 | 12. 1 | 11. 8 | 12. 5 |
| 900°C | 17. 3 | 16. 9 | 16. 5 | 16. 2 |
| 950°C | 17. 5 | 16. 3 | 16. 6 | 15. 9 |
| 1000°C | 18. 2 | 18. 4 | 19 | 17. 5 |
| 1100°C | 8. 1 | 6. 8 | 5. 1 | 3. 3 |

DENSITY 7.3

| HARDNESS (HRB) | 0. 3%C | 0. 5%C | 1. 0%C | 2. 0%C |
|---|---|---|---|---|
| 700℃ | 43. 1 | 44. 3 | 44. 9 | 43. 6 |
| 800℃ | 44. 5 | 45. 7 | 46. 1 | 45. 4 |
| 900℃ | 49. 9 | 48. 8 | 46. 3 | 46. 8 |
| 950℃ | 53. 6 | 53. 2 | 54. 7 | 55. 2 |
| 1000℃ | 55. 5 | 57. 8 | 58. 5 | 59. 2 |
| 1100℃ | 63. 3 | 65. 1 | 67. 4 | 68. 9 |

DENSITY 7.5

| HARDNESS (HRB) | 0. 3%C | 0. 5%C | 1. 0%C | 2. 0%C |
|---|---|---|---|---|
| 700℃ | 48. 5 | 47. 7 | 48. 2 | 45. 5 |
| 800℃ | 47. 6 | 46. 7 | 46. 2 | 46. 7 |
| 900℃ | 50 | 50. 6 | 49. 5 | 49. 3 |
| 950℃ | 53. 5 | 58. 3 | 55 | 54. 7 |
| 1000℃ | 59. 5 | 60. 4 | 60. 8 | 61 |
| 1100℃ | 65. 1 | 68. 5 | 73. 8 | 76. 2 |

0.5%C

| YIELD POINT (MPa) | DENSITY 7.3 | DENSITY 7.5 |
|---|---|---|
| 700°C | — | — |
| 800°C | 210 | 230 |
| 900°C | 185 | 216 |
| 950°C | 197 | 243 |
| 1000°C | 223 | 252 |
| 1100°C | 307 | 315 |

0.5%C

| YIELD POINT (MPa) | DENSITY 7.3 | DENSITY 7.5 |
|---|---|---|
| 700°C | – | – |
| 800°C | 202 | 224 |
| 900°C | 215 | 246 |
| 950°C | 229 | 264 |
| 1000°C | 231 | 272 |
| 1100°C | 309 | 317 |

| | GRAPHITE RESIDUAL RATE | | |
|---|---|---|---|
| RESINTERING TEMPERATURE (°C) | RESINTERING TIME 30MIN. | RESINTERING TIME 60MIN. | RESINTERING TIME 90MIN. |
| 700 | 72% | 66% | 61% |
| 800 | 64% | 55% | 50% |
| 900 | 41% | 36% | 33% |
| 1000 | 35% | 26% | 22% |
| 1100 | 22% | 18% | 15% |
| 1200 | 15% | 11% | 7% |
| 1300 | 5% | 1% | 0% |
| 1400 | 0% | 0% | 0% |

0.5%C

| RESINTERING TEMPERATURE (°C) | TENSILE STRENGTH (MPa) |
|---|---|
| 700 | 559 |
| 800 | 582 |
| 900 | 604 |
| 1000 | 638 |
| 1100 | 650 |
| 1150 | 620 |
| 1200 | 606 |
| 1300 | 525 |
| 1400 | 321 |

PROVISIONAL SINTERING TEMPERATURE 900°C

REARWARD EXTRUSION

SECTION REDUCTION RATE 60%

0.5%C

| RESINTERING TEMPERATURE (°C) | HARDNESS (HRB) |
|---|---|
| 700 | 46 |
| 800 | 47 |
| 900 | 52 |
| 1000 | 54 |
| 1100 | 59 |
| 1150 | 55 |
| 1200 | 52 |
| 1300 | 46 |
| 1400 | 24 |

PROVISIONAL SINTERING TEMPERATURE 900°C

REARWARD EXTRUSION

SECTION REDUCTION RATE 60%

0.5%C

| RESINTERING TEMPERATURE (°C) | TENSILE STRENGTH (MPa) |
|---|---|
| 900 | 1013 |
| 1000 | 1085 |
| 1100 | 1106 |
| 1150 | 1057 |
| 1200 | 1019 |

PROVISIONAL SINTERING TEMPERATURE 900°C

REARWARD EXTRUSION

SECTION REDUCTION RATE 60%

CARBURIZING HARDENING TEMPERING 0.3%C

| RESINTERING TEMPERATURE (°C) | PRESENT INVENTION | CONVENTIONAL METHOD |
|---|---|---|
| 0. 1 | 618 | 595 |
| 0. 2 | 571 | 634 |
| 0. 4 | 560 | 591 |
| 0. 6 | 512 | 589 |
| 0. 8 | 471 | 622 |
| 1. 0 | 402 | 613 |
| 1. 2 | 381 | 590 |
| 1. 4 | 361 | 547 |
| 1. 6 | 364 | 563 |
| 1. 8 | 352. | 572 |
| 2. 0 | 330 | 550 |

PROVISIONAL SINTERING TEMPERATURE 900°C

REARWARD EXTRUSION

SECTION REDUCTION RATE 60%

CARBURIZING HARDENING TEMPERING 0.2 Mo ALLOY STEEL POWDER

| | ELONGATION, % | | | |
|---|---|---|---|---|
| PROVISIONAL SINTERING TEMPERATURE,°C | 0.1%C | 0.3%C | 0.5%C | 1.0%C |
| 600 | 2.5% | 2.3 % | 2.2% | 1.5% |
| 700 | 4.5% | 4.2 % | 3.9% | 2.8% |
| 800 | 12.0% | 11.2 % | 10.6% | 10.8% |
| 900 | 19.7% | 19.0 % | 18.5% | 17.7% |
| 1000 | 16.2% | 15.9 % | 15.5% | 15.4% |
| 1100 | 6.5% | 6.1 % | 5.9% | 4.1% |

2.0Ni-1.0Mo PARTIALLY ALLOYED POWDER

| | ELONGATION, % | | | |
|---|---|---|---|---|
| PROVISIONAL SINTERING TEMPERATURE, °C | 0.1%C | 0.3%C | 0.5%C | 1.0%C |
| 600 | 3.5% | 3.5% | 3.3% | 2.7% |
| 700 | 5.1% | 4.9% | 4.9% | 3.6% |
| 800 | 12.5% | 11.8% | 11.0% | 10.2% |
| 900 | 20.5% | 20.5% | 20.2% | 19.5% |
| 1000 | 19.8% | 18.5% | 19.1% | 17.8% |
| 1100 | 9.1% | 8.3% | 7.7% | 6.5% |

0.2 Mo ALLOY STEEL POWDER

| | HARDNESS, HRB | | | |
|---|---|---|---|---|
| PROVISIONAL SINTERING TEMPERATURE,°C | 0.1%C | 0.3%C | 0.5%C | 1.0%C |
| 600 | 49.6 | 50.5 | 51.3 | 51.2 |
| 700 | 49.3 | 49.5 | 49.8 | 49.6 |
| 800 | 52.5 | 53.3 | 53.9 | 53.2 |
| 900 | 56.8 | 60.8 | 62.1 | 60.4 |
| 1000 | 63.0 | 64.0 | 65.2 | 65.7 |
| 1100 | 70.2 | 72.5 | 74.1 | 76.4 |

2.0Ni-1.0Mo PARTIALLY ALLOYED POWDER

| | HARDNESS, HRB | | | |
|---|---|---|---|---|
| PROVISIONAL SINTERING TEMPERATURE,°C | 0.1%C | 0.3%C | 0.5%C | 1.0%C |
| 600 | 48.8 | 49.2 | 49.6 | 50.5 |
| 700 | 48.1 | 48.0 | 47.8 | 47.3 |
| 800 | 51.0 | 52.0 | 52.3 | 51.4 |
| 900 | 54.9 | 57.5 | 60.1 | 59.2 |
| 1000 | 60.5 | 61.3 | 62.9 | 63.5 |
| 1100 | 68.8 | 70.7 | 71.5 | 74.6 |

0.2 Mo ALLOY
STEEL POWDER

| | FORMING LOAD, Mpa | | | |
|---|---|---|---|---|
| PROVISIONAL SINTERING TEMPERATURE,°C | 0.1%C | 0.3%C | 0.5%C | 1.0%C |
| 700 | 2023 | 2035 | 2047 | 2151 |
| 800 | 2036 | 2078 | 2217 | 2303 |
| 900 | 2179 | 2300 | 2354 | 2384 |
| 1000 | 2689 | 2742 | 2793 | 2850 |

2.0Ni-1.0Mo PARTIALLY ALLOYED POWDER

| | FORMING LOAD, Mpa | | | |
|---|---|---|---|---|
| PROVISIONAL SINTERING TEMPERATURE,°C | 0.1%C | 0.3%C | 0.5%C | 1.0%C |
| 700 | 2039 | 2055 | 2083 | 2132 |
| 800 | 2380 | 2428 | 2480 | 2506 |
| 900 | 2396 | 2477 | 2512 | 2574 |
| 1000 | 2703 | 2758 | 2825 | 2951 |

0.2 Mo ALLOY STEEL POWDER

| | TENSILE STRENGTH, Mpa | | | |
|---|---|---|---|---|
| PROVISIONAL SINTERING TEMPERATURE,°C | 0.1%C | 0.3%C | 0.5%C | 1.0%C |
| 700 | 605 | 610 | 613 | 622 |
| 800 | 679 | 692 | 698 | 704 |
| 900 | 701 | 705 | 714 | 715 |
| 1000 | 743 | 745 | 748 | 755 |

2.0Ni-1.0Mo PARTIALLY ALLOYED POWDER

| | TENSILE STRENGTH (MPa) | | | |
|---|---|---|---|---|
| PROVISIONAL SINTERING TEMPERATURE,°C | 0.1%C | 0.3%C | 0.5%C | 1.0%C |
| 700 | 637 | 635 | 639 | 650 |
| 800 | 709 | 706 | 715 | 721 |
| 900 | 724 | 730 | 732 | 745 |
| 1000 | 749 | 755 | 762 | 776 |

0.2 Mo ALLOY
STEEL POWDER

| | HARDNESS HRB | | | |
|---|---|---|---|---|
| PROVISIONAL SINTERING TEMPERATURE,°C | 0.1%C | 0.3 %C | 0.5%C | 1.0%C |
| 700 | 55 | 57 | 58 | 60 |
| 800 | 74 | 75 | 79 | 84 |
| 900 | 79 | 82 | 84 | 88 |
| 1000 | 90 | 90 | 92 | 103 |

2.0Ni-1.0Mo PARTIALLY ALLOYED POWDER

| | HARDNESS, HRB | | | |
|---|---|---|---|---|
| PROVISIONAL SINTERING TEMPERATURE,°C | 0.1%C | 0.3%C | 0.5%C | 1.0%C |
| 700 | 72 | 74 | 75 | 78 |
| 800 | 90 | 96 | 98 | 104 |
| 900 | 95 | 99 | 101 | 106 |
| 1000 | 102 | 105 | 108 | 116 |

0.2 Mo ALLOY STEEL POWDER

| | GRAPHITE RESDUAL RATE | | |
|---|---|---|---|
| RESINTERING TEMPERATURE (°C) | RESINTERING TIME 30MIN. | RESINTERING TIME 60MIN. | RESINTERING TIME 90MIN. |
| 700 | 71% | 63% | 58% |
| 800 | 61% | 51% | 49% |
| 900 | 44% | 32% | 30% |
| 1000 | 35% | 24% | 21% |
| 1100 | 21% | 17% | 14% |
| 1200 | 12% | 10% | 6% |
| 1300 | 4% | 1% | 0% |
| 1400 | 0% | 0% | 0% |

0.2 Mo ALLOY STEEL POWDER 0.3%C

| RESINTERING TEMPERATURE (°C) | TENSILE STRENGTH (MPa) |
|---|---|
| 700 | 562 |
| 800 | 588 |
| 900 | 613 |
| 1000 | 653 |
| 1100 | 689 |
| 1150 | 676 |
| 1200 | 624 |
| 1300 | 401 |
| 1400 | 336 |

2.0Ni-1.0Mo PARTIALLY ALLOYED POWDER 0.3%C

| RESINTERING TEMPERATURE(°C) | TENSILE STRENGTH (MPa) |
|---|---|
| 700 | 570 |
| 800 | 613 |
| 900 | 686 |
| 1000 | 759 |
| 1100 | 793 |
| 1150 | 784 |
| 1200 | 704 |
| 1300 | 586 |
| 1400 | 447 |

0.2 Mo ALLOY STEEL POWDER 0.3%C

| RESINTERING TEMPERATURE (°C) | HARDNESS (HRB) |
|---|---|
| 700 | 58 |
| 800 | 60 |
| 900 | 66 |
| 1000 | 67 |
| 1100 | 75 |
| 1150 | 71 |
| 1200 | 64 |
| 1300 | 42 |
| 1400 | 32 |

2.0Ni-1.0Mo PARTIALLY ALLOYED POWDER 0.3%C

| RESINTERING TEMPERATURE (°C) | HARDNESS (HRB) |
|---|---|
| 700 | 83 |
| 800 | 85 |
| 900 | 89 |
| 1000 | 99 |
| 1100 | 104 |
| 1150 | 100 |
| 1200 | 89 |
| 1300 | 74 |
| 1400 | 48 |

0.2 Mo ALLOY STEEL POWDER 0.3%C

| RESINTERING TEMPERATURE (°C) | TENSILE STRENGTH (MPa) |
|---|---|
| 900 | 1184 |
| 1000 | 1216 |
| 1100 | 1235 |
| 1150 | 1185 |
| 1200 | 1039 |

2.0Ni-1.0Mo PARTIALLY ALLOYED POWDER 0.3%C

| RESINTERING TEMPERATURE (°C) | TENSILE STRENGTH (MPa) |
|---|---|
| 900 | 1415 |
| 1000 | 1510 |
| 1100 | 1566 |
| 1150 | 1678 |
| 1200 | 1430 |

2.0Ni-1.0Mo PARTIALLY ALLOYED POWDER 0.3%C

| DISTANCE FROM SURFACE (mm) | PRESENT INVENTION | CONVENTIONAL METHOD |
|---|---|---|
| 0.1 | 742 | 655 |
| 0.2 | 741 | 678 |
| 0.4 | 674 | 630 |
| 0.6 | 574 | 629 |
| 0.8 | 510 | 665 |
| 1.0 | 433 | 652 |
| 1.2 | 421 | 630 |
| 1.4 | 425 | 597 |
| 1.6 | 410 | 603 |
| 1.8 | 401 | 612 |
| 2.0 | 400 | 590 |

METALLIC POWDER-MOLDED BODY, RE-COMPACTED BODY OF THE MOLDED BODY, SINTERED BODY PRODUCED FROM THE RE-COMPACTED BODY, AND PROCESSES FOR PRODUCTION THEREOF

This application is a divisional of U.S. Ser. No. 09/647,862 filed Oct. 6, 2000, now U.S. Pat. No. 6,503,443 which is a National Stage Application under 35 U.S.C. § 371 of PCT/JP00/01615 filed Mar. 17, 2000.

TECHNICAL FIELD

The present invention relates to a metallic powder-molded body, a re-compacted body of the molded body and a sintered body produced from the re-compacted body, which are suitable for the manufacture of various structural machine parts made of sintered metals, and processes for the production thereof.

BACKGROUND ART

The process for making sintered metals essentially includes mixing of powder as a raw material, compaction, sintering and after-treatment (heat treatment). Although the sintered products can be produced only through these essential steps, in many cases, additional steps or various treatments are performed between or after the essential steps according to requirements.

For instance, Japanese Patent Application First Publication No. 1-123005 discloses a process comprising the steps of compacting a mixed powder to form a preform, provisionally sintering the preform to form a metallic powder-molded body, re-compacting (cold forging) the metallic powder-molded body and then sintering (substantial sintering) the recompacted body.

Specifically, in the conventional process, the re-compaction (cold forging) step of the metallic powder-molded body is constituted by a provisional compaction step and a substantial compaction step. The metallic powder-molded body is provisionally compacted after applying a liquid lubricant to a surf ace thereof, and exposed to negative pressure to absorb and remove the lubricant therefrom. Then, the metallic powder-molded body is subjected to substantial compaction step.

Since these steps allow the lubricant to still remain in an interior of the preform, micropores within the preform can be prevented from being collapsed and eliminated, thereby inhibiting the preform from suffering from a porous structure. As a result, the density of the obtained product increases up to 7.4–7.5 g/cm$^3$, thereby enabling the product to exhibit a higher mechanical strength than those of the prior arts.

In the above conventional case, an attention has been mainly paid to the re-compaction step of the molded body, i.e., it has been intended to enhance the density thereof by the re-compaction step in order to obtain a product having a relatively high mechanical strength. However, the product obtained by the re-compaction step shows only a limited mechanical strength.

Consequently, in order to further enhance the mechanical strength of the product, it has been considered to be effective to increase a carbon content of the product, i.e, increase an amount of graphite added to a metal powder. However, in general, when the amount of graphite added increases, the molded body is deteriorated in elongation, and shows an increased hardness, thereby causing problems such as deteriorated deformability upon the re-compaction of the molded body and, therefore, difficulty in conducting the re-compaction step.

For example, in a pamphlet entitled "The Second Presentation of Developments in Powder Metallurgy," published by Japan Powder Metallurgy Association (Nov. 15, 1985), page 90, it has been described that a metallic powder-molded body having a carbon content of 0.05 to 0.5% exhibits an elongation of 10% at most, and a hardness of HRB 83. However, it is known from experience that a metallic powder-molded body having an elongation of not more than 10% and a hardness of more than HRB 60 is difficult to be re-compacted. For this reason, it has been required to obtain a metallic powder-molded body having a still higher elongation, a low hardness and an excellent deformability.

The present inventors have continuously made intense studies for producing various structural machine parts having a high mechanical strength due to the use of sintered metals. As a result, it has been recognized that when machine parts are manufactured by provisionally sintering a preform to form a metallic powder-molded body, re-compacting the molded body and subjecting the re-compacted body to substantial sintering, the metallic powder-molded body bears important factors determinate to qualities of the obtained machine parts. Therefore, it is necessary to obtain a molded body having a predetermined graphite content, a large elongation, a low hardness and an excellent deformability. Based on the above recognition, the present inventors have conducted further researches.

As a result of the researches, it has been found that the properties of the metallic powdermolded body having a predetermined graphite content, especially elongation and hardness thereof which are important properties for facilitating the recompaction, are influenced and determined by a density of the preform prior to the formation of the molded body, a structure of the molded body obtained by provisionally sintering the preform, and the configuration of carbon contained in the molded body.

DISCLOSURE OF THE INVENTION

The present invention has been made in view of the above-described conventional problems. An object of the present invention is to provide a metallic powder-molded body having an excellent deformability, a re-compacted body of the molded body, a sintered body produced from the re-compacted body, and processes for the production thereof.

According to the invention as recited in at least certain claims, there is provided a metallic powder-molded body produced by a process comprising the steps of:

compacting a metallic powder mixture obtained by blending graphite with an iron-based metal powder to form a preform having a density of not less than 7.3 g/cm$^3$ and provisionally sintering said preform at a temperature of 700–1000° C., said metallic powder-molded body having a structure in which the graphite remains along a grain boundary of the metal powder.

In the invention as recited in at least certain claims, the amount of the graphite blended with the metal powder is 0.3% by weight or more.

According to the invention as recited in at least certain claims, there is provided a re-compacted body produced by re-compacting the metallic powder-molded body as claimed in at least certain claims.

According to the invention as recited in at least certain claims, there is provided a process for producing a recompacted body, comprising:

a preliminary molding step of compacting a metallic powder mixture obtained by blending graphite with an iron-based metal powder to form a preform having a density of not less than 7.3 g/cm$^3$ a provisional sintering step of provisionally sintering said preform at a temperature of 700–1000° C. to form a metallic powder-molded body having a structure in which the graphite remains along a grain boundary of the metal powder; and a re-compaction step of re-compacting said metallic powder-molded body.

According to the invention as recited in at least certain claims, said preliminary molding step further comprises the step of pressing the metallic powder mixture filled in a mold cavity of a forming die, by upper and lower punches, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an outer circumferential periphery of an end surface thereof facing the mold cavity to increase a volume of the mold cavity.

According to the invention as recited in at least certain claims, in the process as claimed in at least certain claims, the amount of the graphite blended with the metal powder is 0.3% by weight or more.

According to the invention as recited in at least certain claims, there is provided a sintered body produced by a process comprising the steps of:

compacting a metallic powder mixture obtained by blending graphite with an iron-based metal powder to form a preform having a density of not less than 7.3 g/cm$^3$ provisionally sintering the preform at a temperature of 700–1000° C. to form a metallic powder-molded body having a structure in which the graphite remains along a grain boundary of the metal powder;

re-compacting the metallic powder-molded body to form a re-compacted body; and re-sintering the re-compacted body at a predetermined temperature, said sintered body having a structure in which the graphite particle is diffused or remains in the metal powder and along a grain boundary thereof at a predetermined rate.

According to the invention as recited in at least certain claims, in the sintered body as claimed in at least certain claims, the amount of the graphite blended with the metal powder is 0.3% by weight or more.

According to the invention as recited in at least certain claims, there is provided a process for producing a sintered body, comprising:

a preliminary molding step of compacting a metallic powder mixture obtained by blending graphite with an iron-based metal powder to form a preform having a density of not less than 7.3 g/cm$^3$ a provisional sintering step of provisionally sintering the preform at a temperature of 700–1000° C. to form a metallic powder-molded body having a structure in which the graphite remains along a grain boundary of the metal powder;

a re-compaction step of re-compacting the metallic powder-molded body to form a re-compacted body; and a re-sintering step of re-sintering the recompacted body.

According to the invention as recited in at least certain claims, in the process as claimed in at least certain claims, said preliminary molding step further comprises the step of pressing the metallic powder mixture filled in a mold cavity of a forming die, by upper and lower punches, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an outer circumferential periphery of an end surface thereof facing the mold cavity to increase a volume of the mold cavity.

According to the invention as recited in at least certain claims, in the process as claimed in at least certain claims, the amount of the graphite blended with the metal powder is 0.3% by weight or more.

According to the invention as recited in at least certain claims, there is provided a sintered body produced by a process comprising the steps of:

compacting a metallic powder mixture obtained by blending graphite with an iron-based metal powder to form a preform having a density of not less than 7.3 g/cm$^3$ provisionally sintering the preform at a temperature of 700–1000° C. to form a metallic powder-molded body having a structure in which the graphite remains along a grain boundary of the metal powder;

re-compacting the metallic powder-molded body to form a re-compacted body;

re-sintering the re-compacted body at a predetermined temperature to form a sintered body having a structure in which the graphite is diffused or remains in the metal powder and along a grain boundary thereof at a predetermined rate; and heat-treating the sintered body.

According to the invention as recited in at least certain claims, in the sintered body as claimed in at least certain claims, the amount of the graphite blended with the metal powder is 0.3% by weight or more.

According to the invention as recited in at least certain claims, there is provided a process for producing a sintered body, comprising:

a preliminary molding step of compacting a metallic powder mixture obtained by blending graphite with an iron-based metal powder to form a preform having a density of not less than 7.3 g/cm$^3$ a provisional sintering step of provisionally sintering the preform at a temperature of 700–1000° C. to form a metallic powder-molded body having a structure in which the graphite particle remains along a grain boundary of the metal powder;

a re-compaction step of re-compacting the metallic powder-molded body to form a re-compacted body;

a re-sintering step of re-sintering the recompacted body to form a sintered body; and a heat treatment step of heat-treating the sintered body.

According to the invention as recited in at least certain claims, in the process as claimed in at least certain claims, said preliminary molding step further comprises the step of pressing the metallic powder mixture filled in a mold cavity of a forming die, by upper and lower punches, said mold cavity being formed with a greater diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an outer circumferential periphery of an end surface thereof facing the mold cavity to increase a volume of the mold cavity.

According to the invention as recited in at least certain claims, in the process as claimed in at least certain claims, the amount of the graphite blended with the metal powder is 0.3% by weight or more.

According to the invention as recited in at least certain claims, the metallic powder mixture of the metallic powder-molded body as claimed in at least certain claims, is an iron-based alloy steel powder containing at least one alloy element selected from the group consisting of molybdenum (Mo), nickel (Ni), manganese (Mn), copper (Cu), chromium (Cr), tungsten (W), vanadium (V), cobalt (Co) and the like, which element is capable of forming a solid solution with a base material of the metal powder to enhance mechanical properties such as strength and hardenability, or capable of forming a precipitate such as carbide to enhance mechanical properties such as strength and hardness, said metallic powder-molded body, when being provisionally sintered, having a structure in which the graphite remains along a grain boundary of the metal powder and which contains substantially no precipitate such as carbides of iron or the alloy elements.

According to the invention as recited in at least certain claims, the metallic powder mixture of the metallic powder-molded body as claimed in at least certain claims, is obtained by diffusing and depositing a powder containing as a main component, an alloy element selected from the group consisting of molybdenum (Mo), nickel (Ni), manganese (Mn), copper (Cu), chromium (Cr), tungsten (W), vanadium (V), cobalt (Co) and the like, which element is capable of forming a solid solution with a base material of the metal powder to enhance mechanical properties such as strength and hardenability, or capable of forming a precipitate such as carbide to enhance mechanical properties such as strength and hardness, onto said iron-based metal powder, said metallic powder-molded body, when being provisionally sintered, having a structure in which the graphite remains along a grain boundary of the metal powder and which contains substantially no precipitate such as carbides of iron or the alloy element.

According to the invention as recited in at least certain claims, the metallic powder mixture of the metallic powder-molded body as claimed in at least certain claims, is obtained by blending a powder containing as a main component, an alloy element-selected from the group consisting of molybdenum (Mo), nickel (Ni), manganese (Mn), copper (Cu), chromium (Cr), tungsten (W), vanadium (V), cobalt (Co) and the like, which element is capable of forming a solid solution with a base material of the metal powder to enhance mechanical properties such as strength and hardenability, or capable of forming a precipitate such as carbide to enhance mechanical properties such as strength and hardness, with the iron-based metal powder, said metallic powder-molded body, when being provisionally sintered, having a structure in which the graphite remains along a grain boundary of the metal powder and which contains substantially no precipitate such as carbides of iron or the alloy element.

According to the invention as recited in at least certain claims, in the metallic powder-molded body as claimed in at least certain claims, the amount of the graphite blended with the metal powder is 0.1% by weight or more.

According to the invention as recited in at least certain claims, there is provided a re-compacted body produced by re-compacting the metallic powder-molded body as claimed in at least certain claims, wherein the recompacted body has a dense structure containing substantially no voids.

According to the invention as recited in at least certain claims, in there-compacted body as claimed in at least certain claims, the amount of the graphite blended with the metal powder is 0.1% by weight or more.

According to the invention as recited in at least certain claims, there is provided a process for producing a recompacted body, comprising:

a preliminary molding step of compacting the metallic powder mixture as claimed in at least certain claims to form a preform having a density of not less than 7.3 g/cm$^3$ a provisional sintering step of provisionally sintering the preform at a temperature of 700–1000° C. to form a metallic powder-molded body having a structure in which the graphite remains along a grain boundary of the metal powder; and a re-compaction step of re-compacting the metallic powder-molded body.

According to the invention as recited in at least certain claims, there is provided a sintered body obtained by re-sintering the re-compacted body as claimed in at least certain claims at a predetermined temperature, wherein the sintered body has a graphite-diffused structure and a graphite-remaining structure at a predetermined ratio determined depending on the predetermined re-sintering temperature.

According to the invention as recited in at least certain claims, there is provided a process for producing a sintered body, comprising:

a preliminary molding step of compacting the metallic powder mixture claimed in at least certain claims to form a preform having a density of not less than 7.3 g/cm$^3$ a provisional sintering step of provisionally sintering the preform at a temperature of 700–1000° C. to form a metallic powder-molded body having a structure in which the graphite remains along a grain boundary of the metal powder;

a re-compaction step of re-compacting the metallic powder-molded body to form a re-compacted body; and a re-sintering step of re-sintering the recompacted body.

According to the invention as recited in at least certain claims, there is provided a sintered body produced by heat-treating the sintered body as claimed in at least certain claims, wherein the sintered body heat-treated has a hardened structure.

According to the invention as recited in at least certain claims, there is provided a process for producing a sintered body, comprising:

a preliminary molding step of compacting the metallic powder mixture as claimed in at least certain claims to form a preform having a density of not less than 7.3 g/cm$^3$ a provisional sintering step of provisionally sintering the preform at a temperature of 700–10000 C to form a metallic powder-molded body having a structure in which the graphite remains along a grain boundary of the metal powder;

a re-compaction step of re-compacting the metallic powder-molded body to form a re-compacted body; and a re-sintering step of re-sintering the recompacted body to form a sintered body; and a heat treatment step of heat-treating the sintered body.

According to the invention as recited in at least certain claims, in the sintered body claimed in at least certain claims, the amount of the graphite blended with the metal powder is 0.1% by weight or more.

According to the invention as recited in at least certain claims, there is provided a re-compacted body produced by a process comprising the steps of:

forming a preform using a device comprising a forming die having a mold cavity to be filled with the metallic powder mixture, and upper and lower punches inserted into the forming die to press the metallic powder mixture, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an end surface thereof facing the mold cavity to increase a volume of the mold cavity;

provisionally sintering the preform at a temperature of 700–1000° C. to form the metallic powder-molded body as claimed in at least certain claims; and re-compacting the metallic powder-molded body to form a re-compacted body.

According to the invention as recited in at least certain claims, there is provided a process for producing a recompacted body, comprising the steps of:

forming a preform using a device comprising a forming die having a mold cavity to be filled with the metallic powder mixture, and upper and lower punches inserted into the forming die to press the metallic powder mixture, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an end surface thereof facing the mold cavity to increase a volume of the mold cavity;

provisionally sintering the preform at a temperature of 700–1000° C. to form the metallic powder-molded body as claimed in any one of at least certain claims; and re-compacting the metallic powder-molded body to form a re-compacted body.

According to the invention as recited in at least certain claims, in the re-compacted body as claimed in at least certain claims, the amount of the graphite blended with the metal powder is 0.1% by weight or more.

According to the invention as recited in at least certain claims, there is provided a sintered body produced by a process comprising the steps of:

forming a preform using a device comprising a forming die having a mold cavity to be filled with the metallic powder mixture, and upper and lower punches inserted into the forming die to press the metallic powder mixture, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an end surface thereof facing the mold cavity to increase a volume of the mold cavity;

provisionally sintering the preform at a temperature of 700–1000° C. to form the metallic powder-molded body as claimed in at least certain claims;

re-compacting the metallic powder-molded body to form a re-compacted body; and re-sintering the re-compacted body to form the sintered body.

According to the invention as recited in at least certain claims, there is provided a process for producing a sintered body, comprising the steps of:

forming a preform using a device comprising a forming die having a mold cavity to be filled with the metallic powder mixture, and upper and lower punches inserted into the forming die to press the metallic powder mixture, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an end surface thereof facing the mold cavity to increase a volume of the mold cavity;

provisionally sintering the preform at a temperature of 700–1000° C. to form the metallic powder-molded body as claimed in at least certain claims;

re-compacting the metallic powder-molded body to form a re-compacted body; and re-sintering the re-compacted body to form the sintered body.

According to the invention as recited in at least certain claims, in the sintered body as claimed in at least certain claims, the amount of the graphite blended with the metal powder is 0.1% by weight or more.

According to the invention as recited in at least certain claims, there is provided a sintered body produced by conducting the re-sintering as claimed in at least certain claims, wherein the re-sintering temperature is within a range of 700–1300° C.

In the invention as recited in at least certain claims, the recompacted body according to the present invention is produced by re-compacting a metallic powder-molded body (hereinafter referred to merely as "molded body"). The molded body is produced by provisionally sintering a preform obtained by compacting a metallic powder mixture, at a temperature of 700–1000° C.

The preform has a density of not less than 7.3 g/cm$^3$. By controlling the density of the preform to not less than 7.3 g/cm$^3$, the molded body obtained by provisionally sintering the preform can exhibit a large elongation and a low hardness.

The molded body obtained by provisionally sintering the preform having a density of not less than 7.3 g/cm$^3$, has a structure in which the graphite remains along a grain boundary of the metal powder. This indicates that almost no carbon is diffused into an interior of crystals of the metal powder, or at least there is not caused such a condition that a whole amount of graphite is diffused into crystal grains to form a solid solution therewith or produce a carbide therein. More specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated, thereby obtaining a molded body showing a large elongation after the provisional sintering. That is, when the voids between the metal powder particles are continuous, an atmospheric gas within a furnace is penetrated into an interior of the preform upon the provisional sintering, and a gas generated from graphite contained thereinside is diffused around so as to promote carburization of the provisional sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering, the sintering due to surface-diffusion or melting extensively occurs at contact surfaces between the metal powder particles, so that the obtained molded body can exhibit a large elongation.

Thus, in accordance with the invention as recited in at least certain claims, it is possible to obtain a recompacted body of the molded body which is suitable for the manufacture of machine parts having a high mechanical strength due to the use of sintered metals, and exhibits an excellent deformability.

In the invention as recited in at least certain claims, the metallic powder mixture is produced by blending not less than 0.3% by weight of graphite with an iron-based metal powder. By controlling the amount of graphite blended with the metal powder to not less than 0.3% by weight, the metallic powder mixture capable of producing high-carbon steel can be obtained.

In the invention as recited in at least certain claims, the recompacted body according to the present invention, is produced by re-compacting the molded body. The re-compaction can enhance the mechanical strength of the molded body. In particular, when the molded body having a graphite content of not less than 0.3% by weight is re-compacted, the obtained re-compacted body can have the substantially same mechanical strength as those of cast/forging materials.

In the invention as recited in at least certain claims, the preform is produced at the preliminary molding step, and the molded body is produced by provisionally sintering the preform at the provisional sintering step. The re-compacted body is produced by recompacting the molded body at the re-compaction step.

The preform has a density of not less than 7.3 g/cm$^3$. By controlling the density of the preform to not less than 7.3 g/cm$^3$, the molded body obtained by provisionally sintering the preform at the provisional sintering step can exhibit a large elongation and a low hardness.

The molded body obtained by provisionally sintering the preform having a density of not less than 7.3 g/cm3 at the provisional sintering step, has a structure in which the graphite remains along a grain boundary of the metal powder. This indicates that almost no carbon is diffused into an interior of crystals of the metal powder, or at least, there is not caused such a condition that a whole amount of graphite is diffused into crystal grains to form a solid solution therewith or produce a carbide therein.

Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated, thereby obtaining a molded body showing a large elongation after the provisional sintering step. That is, when the voids between the metal powder particles are continuous, an atmospheric gas within a furnace is penetrated into an interior of the preform upon the provisional sintering, and a gas generated from graphite contained thereinside is diffused around so as to promote carburization of the provisionally sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the graphite content. Further, it is indicated that since the preform is substantially free from the diffusion of carbon, the molded body obtained by provisionally sintering the preform shows a reduced hardness.

Also, upon the provisional sintering step, the sintering due to surface-diffusion or melting extensively occurs at contact surfaces between the metal powder particles, so that the obtained molded body can exhibit a large elongation.

In the invention as recited in at least certain claims, the provisional sintering temperature used at the provisional sintering step is within the range of 700–1000° C., so that it is possible to obtain the molded body having a structure in which the graphite remains along a grain boundary of the metal powder which can exhibit an excellent deformability, i.e., an elongation of not less than 10% and a hardness of not more than HRB 60.

In the invention as recited in at least certain claims, the preliminary molding step of forming the preform is conducted by pressing the metallic powder mixture filled in a mold cavity of a forming die, by upper and lower punches. In this case, the density of the preform is as high as not less than 7.3 g/cm$^3$ as a whole, so that the friction between the compact and the forming die increases. However, since a notch is formed at either one or both of the upper and lower punches, the density of the preform is locally reduced, so that the friction between the compact and the forming die can be reduced. For this reason, the preform is readily released from the forming die by the synergistic effect with the tapered portion formed within the mold cavity, thereby obtaining the preform having a density of not less than 7.3 g/cm$^3$.

The re-compaction step is conducted preferably at ordinary temperature. In this case, the molded body can be readily re-compacted due to an excellent deformability thereof.

Thus, the re-compaction step can be performed by applying a small molding load to the molded body, thereby obtaining a re-compacted body with a high dimensional accuracy. The re-compacted body has such a structure in which metal particles of the molded body are largely deformed into a flat shape. However, since the molded body itself has the structure in which the graphite remains along a grain boundary of the metal powder, the obtained recompacted body is excellent in machinability and lubricating ability.

Therefore, according to the invention as recited in at least certain claims, there is provided a process for the production of a re-compacted body having an excellent deformability, which is suitable for the manufacture of machine parts having a high mechanical strength due to the use of sintered metals.

In the invention as recited in at least certain claims, the metallic powder mixture compacted at the preliminary molding step as recited in at least certain claims, is produced by blending graphite with an iron-based metal powder. Among others, by controlling the amount of graphite blended with the metal powder to not less than 0.3% by weight, the sintered body obtained by recompacting and re-sintering the molded body can show substantially the same mechanical strength as those of cast/forging materials.

In the invention as recited in at least certain claims, the sintered body is obtained by re-sintering the recompacted body at a predetermined temperature. The re-compacted body is produced by re-compacting the molded body which is produced by provisionally sintering the preform obtained by compacting the metallic powder mixture, at a temperature of 700–1000° C.

The preform has a density of not less than 7.3 g/cm$^3$. By controlling the density of the preform to not less than 7.3 g/cm$^3$, the molded body obtained by provisionally sintering the preform can exhibit a large elongation and a low hardness.

The molded body obtained by provisionally sintering the preform having a density of not less than 7.3 g/cm$^3$, has a structure in which the graphite remains along a grain boundary of the metal powder. This indicates that almost no carbon is diffused into an interior of crystals of the metal powder, or at least there is not caused such a condition that a whole amount of graphite is diffused into crystal grains of the metal powder to form a solid solution therewith or produce a carbide therein. Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated, thereby obtaining a molded body showing a large elongation after the provisional sintering at the provisional sintering step. That is, when the voids between the metal powder particles are continuous, an atmospheric gas within a furnace is penetrated into an interior of the preform upon the provisional sintering, and a gas generated from graphite contained thereinside is diffused around so as to promote carburization of the provisional sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering, the sintering due to surface-diffusion or melting extensively occurs at contact surfaces between the metal powder particles, so that the obtained molded body can exhibit a large elongation.

The re-compaction of the molded body obtained by provisionally sintering the preform is preferably conducted at ordinary temperature. In this case, owing to the excellent deformability, the molded body can be readily re-compacted by applying a small load thereto, thereby obtaining a re-compacted body having a high dimensional accuracy.

The re-compacted body is re-sintered to obtain a sintered body. The sintered body has a structure in which the graphite retained along a grain boundary of the metal powder is diffused into a ferrite base material (to form a solid solution or a carbide therewith), and a structure in which the graphite is diffused or remains in a ferrite or pearlite structure of the metal powder in a predetermined ratio. Here, the predetermined ratio includes no amount of the residual graphite.

The residual rate of the graphite varies depending upon the re-sintering temperature. The higher the re-sintering temperature is, the smaller the residual rate of the graphite becomes. By controlling the residual rate, the obtained sintered body can show desired mechanical properties such as mecahnical strength.

Therefore, according to the invention as recited in at least certain claims, it is possible to produce a sintered body by re-sintering a re-compacted body of the molded body having an excellent deformability, which is suitable for the manufacture of machine parts having a high mechanical strength due to the use of sintered metals.

In the invention as recited in at least certain claims, the metallic powder mixture is obtained by blending not less than 0.3% by weight of graphite with an iron-based metal powder. By controlling the amount of graphite blended with the metal powder to not less than 0.3% by weight, the sintered body obtained by re-compacting and re-sintering the molded body can show substantially the same mechanical strength as those of cast/forging materials.

In the invention as recited in at least certain claims, the preform is produced at the preliminary molding step, the molded body is produced by provisionally sintering the preform at the provisional sintering step, the re-compacted body is produced by recompacting the molded body at the re-compaction step, the sintered body is produced by re-sintering the re-compacted body.

The preform formed at the preliminary molding step has a density of not less than 7.3 g/cm$^3$. By controlling the density of the preform to not less than 7.3 g/cm$^3$, the molded body obtained by provisionally sintering the preform at the provisional sintering step can exhibit a large elongation and a low hardness.

The molded body obtained by provisionally sintering the preform having a density of not less than 7.3 g/cm$^3$, has a structure in which the graphite remains along a grain boundary of the metal powder. This indicates that almost no carbon is diffused into an interior of crystals of the metal powder, or at least there is not caused such a condition that a whole amount of graphite is diffused into crystal grains of the metal powder to form a solid solution therewith or produce a carbide therein. Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated, thereby obtaining a molded body showing a large elongation after the provisional sintering at the provisional sintering step. That is, when the voids between the metal powder particles are continuous, an atmospheric gas within a furnace is penetrated into an interior of the preform upon the provisional sintering, and a gas generated from graphite contained thereinside is diffused around so as to promote carburization of the provisional sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm3, the elongation of the obtained molded body is rarely influenced by the content of graphite. Further, it is indicated that since the preform is substantially free from the diffusion of carbon, the molded body obtained by provisionally sintering the preform shows a reduced hardness.

Also, at the provisional sintering step, the sintering due to surface-diffusion or melting extensively occurs at contact surfaces between the metal powder particles, so that the obtained molded body can exhibit a large elongation.

The provisional sintering temperature used at the provisional sintering step is selected within the range of 700–1000° C., so that it is possible to obtain the molded body having a structure in which the graphite remains along a grain boundary of the metal powder, and exhibiting an excellent deformability, i.e., an elongation of not less than 10% and a hardness of not more than HRB 60.

The re-compaction step is preferably conducted at ordinary temperature. In this case, owing to the excellent deformability, the molded body can be readily re-compacted.

For this reason, the re-compacted body having a high dimensional accuracy can be obtained by applying a small load to the molded body.

The re-compacted body is re-sintered to obtain a sintered body. The sintered body has a structure in which the graphite retained along a grain boundary of the metal powder is diffused into a ferrite base material (to form a solid solution or a carbide therewith), and a structure in which the graphite is diffused or remains in a ferrite or pearlite structure of the metal powder in a predetermined ratio. Here, the predetermined ratio includes no amount of the residual graphite.

The residual rate of the graphite in the sintered body varies depending upon the re-sintering temperature. The higher the re-sintering temperature is, the smaller the residual rate of the graphite becomes. By controlling the residual rate, the obtained sintered body can show desired mechanical properties such as mechanical strength.

Therefore, according to the invention as recited in at least certain claims, it is possible to produce a sintered body by re-sintering the re-compacted body of the molded body having an excellent deformability, which is suitable for the manufacture of machine parts having a high mechanical strength due to the use of sintered metals.

In the invention as recited in at least certain claims, the preliminary molding step of forming the preform is conducted by pressing the metallic powder mixture filled in a mold cavity of a forming die, by upper and lower punches. In this case, the density of the obtained preform is as high as not less than 7.3 g/cm$^3$ as a whole, so that the friction between the preform and the forming die increases. However, since a notch is formed at either one or both of the upper and lower punches, the density of the preform is locally reduced, so that the friction between the preform and the forming die can be lessened. For this reason, the preform is readily released from the forming die along with the synergistic effect of the tapered portion formed within the mold cavity, thereby obtaining the preform having a density of not less than 7.3 g/cm$^3$.

In the invention as recited in at least certain claims, the metallic powder mixture is obtained by blending not less than 0.3% by weight of graphite with an iron-based metal powder. By controlling the amount of graphite blended with the metal powder to not less than 0.3% by weight, the sintered body obtained by re-compacting and re-sintering the molded body can show substantially the same mechanical strength as those of cast/forging materials.

In the invention as recited in at least certain claims, the sintered body is produced by heat-treating such a sintered body obtained by re-sintering the recompacted body, at a predetermined temperature. The re-compacted body is produced by re-compacting the molded body. The molded body is produced by provisionally sintering the preform obtained by compacting the metallic powder mixture, at a predetermined temperature.

The preform has a density of not less than 7.3 g/cm$^3$. By controlling the density of the preform to not less than 7.3 g/cm$^3$, the molded body obtained by provisionally sintering the preform can exhibit a large elongation and a low hardness.

The molded body obtained by provisionally sintering the preform having a density of not less than 7.3 g/cm$^3$, has a structure in which the graphite remains along a grain boundary of the metal powder. This indicates that almost no carbon is diffused into an interior of crystals of the metal powder, or at least there is not caused such a condition that a whole amount of graphite is diffused into crystal grains of the metal powder to form a solid solution therewith or produce a carbide therein. Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated, thereby obtaining a molded body showing a large elongation after the provisional sintering at the provisional sintering step. That is, when the voids between the metal powder particles are continuous, an atmospheric gas within a furnace is penetrated into an interior of the preform upon the provisional sintering, and a gas generated from graphite contained thereinside is diffused around so as to promote carburization of the provisionally sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering, the sintering due to surface-diffusion or melting extensively occurs at contact surfaces between the metal powder particles, so that the obtained molded body can exhibit a large elongation.

The re-compaction of the molded body obtained by provisionally sintering the preform is preferably conducted at ordinary temperature. In this case, owing to the excellent deformability, the molded body can be readily re-compacted.

The re-compacted body is re-sintered to obtain a sintered body. The sintered body has a structure in which the graphite retained along a grain boundary of the metal powder is diffused into a ferrite base material (to form a solid solution or a carbide therewith), and a structure in which the graphite is diffused or remains in a ferrite or pearlite structure of the metal powder in a predetermined ratio. Here, the predetermined ratio includes no amount of the residual graphite.

The residual rate of the graphite in the sintered body varies depending upon the re-sintering temperature. The higher the re-sintering temperature is, the smaller the residual rate of the graphite becomes. By controlling the residual rate, the obtained sintered body can show desired mechanical properties such as mechanical strength.

The sintered body obtained by re-sintering the re-compacted body at a predetermined temperature is then heat-treated. The heat treatment may include various treatments such as induction quenching, carburizing and quenching, nitriding and the combination thereof. The sintered body obtained by re-sintering the re-compacted body at a predetermined temperature has a less amount of voids and a high density owing to the re-compaction, so that the degree of diffusion of carbon due to the heat treatment is gradually lessened inwardly from the surface of the sintered body. For this reason, the heat-treated sintered body shows an increased hardness in the vicinity of the surface thereof, and a toughness at an inside thereof, thereby allowing the sintered body to have an excellent mechanical properties as a whole.

Therefore, according to the invention as recited in at least certain claims, the sintered body which is suitable for the manufacture of machine parts having a high mechanical strength due to the use of sintered metals, can be obtained by heat-treating the sintered body obtained by re-sintering the recompacted body of the molded body having an excellent deformability.

In the invention as recited in at least certain claims, the metallic powder mixture is obtained by blending not less than 0.3% by weight of graphite with an iron-based metal powder. By controlling the amount of graphite blended with the metal powder to not less than 0.3% by weight, the sintered body obtained by re-compacting and re-sintering the molded body can show substantially the same mechanical strength as those of cast/forging materials.

In the invention as recited in at least certain claims, by controlling the density of the preform to not less than 7.3 g/cm$^3$, the molded body obtained by provisionally sintering the preform at the provisional sintering step can exhibit a large elongation and a low hardness.

The molded body obtained by provisionally sintering the preform having a density of not less than 7.3 g/cm$^3$ at the provisional sintering step, has a structure in which the graphite remains along a grain boundary of the metal powder. This indicates that almost no carbon is diffused into an interior of crystals of the metal powder, or at least, there is not caused such a condition that a whole amount of graphite is diffused into crystal grains of the metal powder to form a solid solution therewith or produce a carbide therein. Specifically, the metal powder shows a ferrite structure as a whole, or a structure in which pearlite is precipitated in the vicinity of graphite. For this reason, the above molded body can exhibit a large elongation, a low hardness and an excellent deforambility.

In addition, in the preform having a density of not less than 7.3 g/cm$^3$, voids between the metal powder particles are not continuous but isolated, thereby obtaining a molded body showing a large elongation after the provisional sintering at the provisional sintering step. That is, if the voids between the metal powder particles are continuous, an atmospheric gas within a furnace is penetrated into an interior of the preform upon the provisional sintering, and a gas generated from graphite contained thereinside is diffused around so as to promote carburization of the provisionally sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm3, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering at the provisional sintering step, the sintering due to surface-diffusion or melting extensively occurs at contact surfaces between the metal powder particles, so that the obtained molded body can exhibit a large elongation.

The provisional sintering temperature used at the provisional sintering step is selected within the range of 700–1000° c., so that it is possible to obtain the molded body having a structure in which the graphite remains along a grain boundary of the metal powder, and exhibiting an excellent deformability, i.e., an elongation of not less than 10% and a hardness of not more than HRB 60.

The re-compaction step is preferably conducted at ordinary temperature. In this case, owing to the excellent deformability, the molded body can be readily re-compacted.

For this reason, the re-compacted body having a high dimensional accuracy can be obtained by applying a small load to the molded body.

At the re-sintering step, the re-compacted body is re-sintered to obtain a sintered body. The sintered body has a structure in which the graphite retained along a grain boundary of the metal powder is diffused into a ferrite base material (to form a solid solution or a carbide therewith), and in which the graphite is diffused or remains in a ferrite or pearlite structure of the metal powder in a predetermined ratio. Here, the predetermined ratio includes no amount of the residual graphite.

The residual rate of the graphite in the sintered body varies depending upon the re-sintering temperature. The higher the re-sintering temperature is, the smaller the residual rate of the graphite becomes. By controlling the residual rate, the obtained sintered body can show desired mechanical properties such as mechanical strength.

The heat treatment may include various treatments such as induction. quenching, carburizing and quenching, nitriding and the combination thereof. The sintered body obtained by re-sintering the re-compacted body at a predetermined temperature has a less amount of voids and a high density owing to the re-compaction, so that the degree of diffusion of carbon due to the heat treatment is gradually lessened inwardly from the surface of the sintered body. For this reason, the heat-treated sintered body shows an increased hardness in the vicinity of the surface thereof, and a toughness at an inside thereof, thereby allowing the sintered body to have excellent mechanical properties as a whole.

In the invention as recited in at least certain claims, the metallic powder mixture filled in a mold cavity of a forming die, is pressed by upper and lower punches. In this case, the density of the obtained preform is as high as not less than 7.3 g/cm$^3$, so that the friction between the preform and the forming die increases. However, since a notch is formed at either one or both of the upper and lower punches, the density of the preform is locally reduced, so that the friction between the preform and the forming die can be lessened. For this reason, the preform is readily released from the forming die along with the synergistic effect of the tapered portion formed within the mold cavity, thereby obtaining the preform having a density of not less than 7.3 g/cm$^3$.

Further, in the invention as recited in at least certain claims, the metallic powder mixture compacted at the preliminary molding step as recited in at least certain claims, is obtained by blending not less than 0.3% by weight of graphite with an iron-based metal powder. By controlling the amount of graphite blended with the metal powder to not less than 0.3% by weight, the sintered body obtained by recompacting and re-sintering the molded body can show substantially the same mechanical strength as those of cast/forging materials.

In the inventions as recited in at least certain claims, the preform obtained by the compaction of the metallic powder mixture has a density of not less than 7.3 g/cm$^3$. Therefore, the molded body obtained by provisionally sintering the preform contains the graphite that surely remains along a grain boundary of the metal powder. As a result, the molded body can show a low hardness, a large elongation, a high lubricating ability along the grain boundary of the metal powder, and a high moldability as a whole.

That is, in the preform compacted into a high density of not less than 7.3 g/cm$^3$, voids between the metal powder particles are not continuous but isolated, so that it becomes difficult to penetrate an atmospheric gas within a furnace into the preform upon the provisional sintering, and diffuse a gas generated from graphite contained thereinside to the surrounding. This considerably contributes to inhibiting the diffusion of carbon (to allow the residual graphite). For this reason, the obtained molded body has a structure in which the graphite remains along a grain boundary of the metal powder and almost no precipitates such as carbides of iron or alloy elements are formed.

Specifically, the mold preform as recited in at least certain claims has a ferrite structure, an austenite structure or such a structure in which a slight amount of pearlite or bainite is precipitated in the vicinity of graphite. Whereas, the molded body as recited in at least certain claims has a ferrite structure, an austenite structure, a structure in which at least one undiffused alloy component such as nickel (Ni) is co-present, or a structure in which a slight amount of pearlite or bainite is precipitated in the vicinity of graphite. Therefore, the molded body before subjecting to the recompaction, is rarely influenced by the diffusion of carbon. As a result, the molded body not only shows a low hardness and a large elongation, but also is further enhanced in moldability since the grain boundary of the metal powder is well lubricated by the residual graphite.

Also, upon the provisional sintering of the molded body, the sintering due to surface diffusion or melting is extensively caused at contact surfaces between the metal powder particles, thereby obtaining a molded body with a large elongation.

In the invention as recited in at least certain claims, the metallic powder mixture such as alloy steel powder contains not less than 0.1% by weight of graphite, so that when the preform is provisionally sintered or the obtained molded body is re-sintered, the decarburization of substantially a whole amount of carbon is prevented. Therefore, machine parts obtained by re-compacting and re-sintering the molded body can show a sufficiently enhanced mechanical strength.

In the invention as recited in at least certain claims, the re-compacted body obtained by subjecting the molded body to re-compaction such as cold forging, has a dense structure in which the graphite still remains along a grain boundary of the metal powder, but voids of the molded body are collapsed and almost entirely dissipated.

Also, since the molded body used therein is substantially free from diffusion of carbon, it is possible to re-compact the molded body into a desired shape by applying a small molding load (deformation resistance) thereto. Specifically, if a large amount of carbon is diffused in the molded body (like conventional molded bodies), the molded body shows not only a high hardness and a small elongation, but also a low sliding property between the metal particles, so that it becomes very difficult to re-compact the molded body. On the contrary, the molded body used in the present invention is substantially free from diffusion of carbon. Therefore, the molded body can show a low hardness and a large elongation and surely exhibits a good sliding property between the metal particles due to the graphite remaining along a grain boundary thereof. As a result, it becomes possible to recompact the molded body. Further, since the recompaction of the molded body is conducted at ordinary temperature, production of scales or deteriorated dimensional accuracy of the recompacted body due to transformation thereof can be prevented, thereby enabling the re-compacted body to be processed with an extremely high accuracy.

Further, the alloy components added to the metallic powder mixture serves for enhancing the degree of work-hardening upon the re-compaction. The plastic-worked body produced therefrom shows a higher hardness as compared to the case where no alloy component is added. However, since the grain boundary is well lubricated by the residual graphite, the molded body can be re-compacted with a small deformation resistance. In particular, in the molded body as recited in at least certain claims, the diffused alloy components are exposed to the near-surface portion of the metal powder, so that the diffusion of the alloy components is difficult to proceed towards an inside of the metal powder. As a result, it is possible to obtain a plastic-worked body which is work-hardened with a lower deformation resistance.

Accordingly, the obtained plastic-worked body is applicable to sliding parts requiring a high strength and a high accuracy.

In the invention as recited in at least certain claims, the metallic powder mixture compacted at the preliminary molding step as recited in at least certain claims, is produced by blending not less than 0.1% by weight of graphite with an iron-based metal powder. By controlling the amount of graphite blended with the metal powder to not less than 0.1% by weight, the sintered body obtained by re-compacting and resintering the molded body can be enhanced in mechanical strength.

Specifically, the metallic powder mixture used herein is obtained by blending not less than 0.1% by weight of graphite with an alloy steel powder. Therefore, when the preform is provisionally sintered or the obtained molded body is subsequently re-sintered, the decarburization of substantially a whole amount of carbon can be prevented. Accordingly, the machine parts obtained by recompacting and re-sintering the molded body can show substantially the same mechanical strength as those of cast/forging materials.

In the invention as recited in at least certain claims, by controlling the density of the preform compacted at the preliminary molding step to not less than 7.3 g/cm$^3$, the molded body obtained by provisionally sintering the preform at the provisional sintering step can exhibit a large elongation and a low hardness.

The molded body obtained by provisionally sintering the preform having a density of not less than 7.3 g/cm3 at the provisional sintering step, has a structure in which the graphite remains along a grain boundary of the metal powder. This indicates that almost no carbon is diffused into an interior of crystals of the metal powder, or at least, there is not caused such a condition that a whole amount of graphite is diffused into crystal grains of the metal powder to form a solid solution therewith or produce a carbide therein.

Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated from each other, thereby obtaining a molded body showing a large elongation after the provisional sintering at the provisional sintering step. That is, if the voids between the metal powder particles are continuous, an atmospheric gas within a furnace is penetrated into an interior of the preform upon the provisional sintering, and a gas generated from graphite contained thereinside is diffused around so as to promote carburization of the provisionally sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering at the provisional sintering step, the sintering due to surface-diffusion or melting extensively occurs at contact surfaces between the metal powder particles, so that the obtained molded body can exhibit a large elongation.

Further, the provisional sintering temperature used at the provisional sintering step is selected within the range of 700 to 1,000° C., so that it is possible to obtain the molded body having a structure in which the graphite remains along a grain boundary of the metal powder, and exhibiting an excellent deformability, i.e., an elongation of not less than 10% and a hardness of not more than HRB 60.

By re-compacting the molded body, it is possible to obtain the re-compacted body having a dense structure in which almost no voids are present.

Further, the re-compacted body obtained by subjecting the molded body to re-compaction such as cold forging, has a dense structure in which the graphite still remains along a grain boundary of the metal powder, but voids of the molded body are collapsed and almost entirely dissipated.

In the invention as recited in at least certain claims, when the re-compacted body is re-sintered, the sintering due to surface-diffusion or melting occurs at contact surfaces between the metal powder particles and, at the same time, the graphite retained along a grain boundary of the metal powder is diffused into a ferrite base material of the metal powder (to form a solid solution or a carbide therewith). The metal powder has a ferrite structure, a pearlite structure, an austenite structure or such a structure in which at least one undiffused alloy component such as nickel (Ni) coexists. When the residual graphite is present, there is obtained such a structure in which graphite is interspersed inside the metal powder.

Further, upon the re-sintering, the alloy elements capable of forming a solid solution with the base material can produce a more uniform solid solution therewith, and those capable of forming precipitates such as carbides can be formed into precipitates. Thus, the effect of enhancing mechanical properties by these alloy elements added, can be reflected on the macrostructure of the sintered body.

As a result, the obtained sintered body has a higher strength than that of the re-compacted body, and can exhibit a mechanical strength substantially identical to or higher than those of cast/forging materials which do not particularly require a hardened layer.

In addition, the thus obtained sintered body shows a re-crystallized structure having a crystal grain size of about 20 pm or smaller due to the resintering after the re-compaction. This allows the sintered body to exhibit a high strength, a large elongation, a high impact value and a high fatigue strength.

In the invention as recited in at least certain claims, by controlling the density of the preform compacted at the preliminary molding step to not less than 7.3 g/cm$^3$, the molded body obtained by provisionally sintering the preform at the provisional sintering step can exhibit a large elongation and a low hardness.

The molded body obtained by provisionally sintering the preform having a density of not less than 7.3 g/cm$^3$ at the provisional sintering step, has a structure in which the graphite remains along a grain boundary of the metal powder. This indicates that almost no carbon is diffused into an interior of crystals of the metal powder, or at least, there is not caused such a condition that a whole amount of graphite is diffused into crystal grains of the metal powder to form a solid solution therewith or produce a carbide therein. Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated from each other, thereby obtaining a molded body showing a large elongation after the provisional sintering at the provisional sintering step. That is, if the voids between the metal powder particles are continuous, an atmospheric gas within a furnace is penetrated into an interior of the preform upon the provisional sintering, and a gas generated from graphite contained thereinside is diffused around so as to promote carburization of the provisionally sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering step, the sintering due to surface-diffusion or melting extensively occurs at contact surfaces between the metal powder particles, so that the obtained molded body can exhibit a large elongation.

The provisional sintering temperature used at the provisional sintering step is selected without the range of 700–1000° C., so that it is possible to obtain the molded body having a structure in which the graphite remains along a grain boundary of the metal powder, and exhibiting an excellent deformability, i.e., an elongation of not less than 10% and a hardness of not more than HRB 60.

The re-compaction step is preferably conducted at ordinary temperature. In this case, owing to the excellent deformability, the molded body can be readily re-compacted.

For this reason, the re-compacted body having a high dimensional accuracy can be obtained by applying a small load to the molded body.

The re-compacted body is re-sintered at the resintering step to obtain a sintered body. The sintered body has a structure in which the graphite retained along a grain boundary of the metal powder is diffused into a ferrite base material (to form a solid solution or a carbide therewith), and a structure in which the graphite is diffused or remains in a ferrite or pearlite structure of the metal powder in a predetermined ratio. Here, the predetermined ratio includes no amount of the residual graphite.

The residual rate of the graphite in the sintered body varies depending upon the re-sintering temperature. The higher the re-sintering temperature is, the smaller the residual rate of the graphite becomes. By controlling the residual rate, the obtained sintered body can show desired mechanical properties such as mechanical strength.

Therefore, according to the invention as recited in at least certain claims, there is provided a process for the production of a sintered body by re-sintering the re-compacted body of the molded body having an excellent deformability, which is suitable for the manufacture of machine parts having a high mechanical strength due to the use of sintered metals.

In the invention as recited in at least certain claims, when the sintered body is subjected to the heat treatment such as quenching, the graphite forms a supersaturated solid solution therewith, or is precipitated in the form of fine carbides or nitrides the latter of which produce a hardened layer. Therefore, in the obtained sintered body, the degree of diffusion of carbon caused by the heat treatment becomes lessened towards an inside thereof. The obtained sintered body thus shows a high hardness at the near-surface portion, while maintaining a good toughness thereinside.

In the invention as recited in at least certain claims, by controlling the density of the preform compacted at the preliminary molding step to not less than 7.3 g/cm$^3$, the molded body obtained by provisionally sintering the preform at the provisional sintering step can exhibit a large elongation and a low hardness.

The molded body obtained by provisionally sintering the preform having a density of not less than 7.3 g/cm$^3$ at the provisional sintering step, has a structure in which the graphite remains along a grain boundary of the metal powder. This indicates that almost no carbon is diffused into an interior of crystals of the metal powder, or at least, there is not caused such a condition that a whole amount of graphite is diffused into crystal grains of the metal powder to form a solid solution therewith or produce a carbide therein. Specifically, the metal powder shows a ferrite structure as a whole, or a structure in which pearlite is precipitated in the vicinity of graphite. For this reason, the above molded body can exhibit a large elongation, a low hardness and an excellent deformability.

In addition, in the preform having a density of not less than 7.3 g/cm$^3$, voids between the metal powder particles are not continuous but isolated from each other, thereby obtaining a molded body showing a large elongation after the provisional sintering of the provisional sintering step. That is, if the voids between the metal powder particles are continuous, an atmospheric gas within a furnace is penetrated into an interior of the preform upon the provisional sintering, and a gas generated from graphite contained thereinside is diffused around so as to promote carburization of the provisionally sintered preform. However, since the voids of the preform used in the present invention are isolated from each other, the above problems can be effectively prevented, thereby obtaining the molded body having a large elongation. Thus, since the preform is substantially free from diffusion of carbon upon the provisional sintering by controlling the density of the preform to not less than 7.3 g/cm$^3$, the elongation of the obtained molded body is rarely influenced by the content of graphite. Further, it is indicated that since the preform is substantially free from the diffusion of carbon, the molded body obtained by provisionally sintering the preform shows a reduced hardness.

Also, upon the provisional sintering at the provisional sintering step, the sintering due to surface-diffusion or melting extensively occurs at contact surfaces between the metal powder particles, so that the obtained molded body can exhibit a large elongation.

The provisional sintering temperature used at the provisional sintering step is selected within the range of 700–1000° C., so that it is possible to obtain the molded body having a structure in which the graphite remains along a grain boundary of the metal powder, and exhibiting an excellent deformability, i.e., an elongation of not less than 10% and a hardness of not more than HRB 60.

The re-compaction step is preferably conducted at ordinary temperature. In this case, owing to the excellent deformability, the molded body can be readily re-compacted.

For this reason, the re-compacted body having a high dimensional accuracy can be obtained by applying a small load to the molded body.

The re-compacted body is re-sintered at the resintering step to obtain a sintered body. The sintered body has a structure in which the graphite retained along a grain boundary of the metal powder is diffused into a ferrite base material (to form a solid solution or a carbide therewith), and a structure in which the graphite is diffused or remains in a ferrite or pearlite structure of the metal powder in a predetermined ratio. Here, the predetermined ratio includes no amount of the residual graphite.

The residual rate of the graphite in the sintered body varies depending upon the re-sintering temperature. The higher the re-sintering temperature is, the smaller the residual rate of the graphite becomes. By controlling the residual rate, the obtained sintered body can show desired mechanical properties such as mechanical strength. The sintered body obtained by re-sintering the re-compacted body at a predetermined temperature is then heat-treated.

The heat treatment may include various treatments such as induction quenching, carburizing-quenching, nitriding and the combination thereof. The sintered body obtained by re-sintering the re-compacted body at a predetermined temperature has less amount of voids and a high density owing to the re-compaction, so that the degree of diffusion of carbon due to the heat treatment is lessened inwardly from the surface of the sintered body. For this reason, the heat-treated sintered body shows an increased hardness in the vicinity of the surface thereof, and a good toughness at an inside thereof, thereby allowing the sintered body to have excellent mechanical properties as a whole.

In the invention as recited in at least certain claims, by controlling the amount of graphite blended with the metal powder to not less than 0.1% by weight, the sintered body obtained by re-compacting and resintering the molded body can show substantially the same mechanical strength as those of cast/forging materials.

In the invention as recited in at least certain claims, it is required that the preform used for forming the molded body has a density as high as not less than 7.3 g/cm$^3$. Therefore, it is considered that the friction upon releasing the preform from the forming die is considerably increased. However, in the apparatus used for the above operation, since a notch is formed at either one or both of the upper and lower punches thereof, the density of the preform is locally reduced, so that the friction generated upon the mold-releasing can be reduced.

For this reason, the preform is readily released from the forming die along with the synergistic effect of the tapered portion formed within the mold cavity of the forming die, thereby obtaining the preform having a density of not less than 7.3 g/cm$^3$.

The molded body obtained by provisionally sintering the preform surely has a high density to thereby contain a sufficient amount of the graphite remaining along the grain boundary of the metal powder and at the same time almost no carbon diffused into the metal particle. As a result, the subsequent re-compacting can be readily conducted. Accordingly, the re-compacted body has a dense structure containing substantially no voids and a high accuracy because the re-compaction at ordinary temperature is easily performed.

the invention as recited in at least certain claims, there is provided a process for the production of a recompacted body as recited in at least certain claims, by which the re-compacted body having the specific function and effects as recited in at least certain claims can be readily obtained.

In the invention as recited in at least certain claims, the re-compacted body as recited in at least certain claims is produced by blending not less than 0.1% by weight of graphite with the metal powder. By controlling the amount of graphite blended with the metal powder to not less than 0.1% by weight, the sintered body obtained by re-compacting and re-sintering the molded body can be enhanced in mechanical strength substantially as large as cast/forging materials.

In the invention as recited in at least certain claims, it is required that the preform used for forming the molded body has a density as high as not less than 7.3 g/cm$^3$. Therefore, it is considered that the friction upon releasing the preform from the forming die is considerably increased. However, in the apparatus used for the above operation, since a notch is formed at either one or both of the upper and lower punches thereof, the density of the preform is locally reduced, so that the friction generated upon the mold-releasing can be reduced. For this reason, the preform is readily released from the forming die along with the synergistic effect of the tapered portion formed within the mold cavity of the forming die, thereby obtaining the preform having a density of not less than 7.3 g/cm$^3$.

Also, the molded body obtained by provisionally sintering the preform surely has a high density to thereby contain a sufficient amount of the graphite remaining along the grain boundary of the metal powder and at the same time almost no carbon diffused into the metal particle. As a result, the subsequent re-compacting can be readily conducted. Accordingly, the re-compacted body has a dense structure containing substantially no voids and a high accuracy because the re-compaction at ordinary temperature is easily performed.

The re-compacted body is re-sintered to obtain a sintered body. The sintered body has a structure in which the graphite retained along a grain boundary of the metal powder is diffused into a ferrite base material (to form a solid solution or a carbide therewith), and a structure in which the graphite is diffused or remains in a ferrite or pearlite structure of the metal powder in a predetermined ratio. Here, the predetermined ratio includes no amount of the residual graphite.

The residual rate of the graphite in the sintered body varies depending upon the re-sintering temperature. The higher the re-sintering temperature is, the smaller the residual rate of the graphite becomes. By controlling the residual rate, the obtained sintered body can show desired mechanical properties such as mechanical strength. Accordingly, the sintered body can be obtained by re-sintering the re-compacted body of the molded body having an excellent deformability, which is suitable for the manufacture of machine parts having a high mechanical strength due to the use of sintered metals.

In the invention as recited in at least certain claims, there is provided a process for the production of a sintered body as recited in at least certain claims, by which the sintered body having the specific function and effects as recited in at least certain claims can be readily obtained.

In the invention as recited in at least certain claims, by controlling the amount of graphite blended with the metal powder to not less than 0.1% by weight, the sintered body obtained by re-compacting and re-sintering the molded body can be enhanced in mechanical strength Substantially as large as cast/forging materials.

In the invention as recited in at least certain claims, the re-sintering temperature as recited in at least certain claims is selected within the range of 700–1300° C. By controlling the re-sintering temperature to the range of 700–1300° C., it is possible to obtain the sintered body having a structure which show a less diffusion of the graphite with the increased residual rate thereof, at a low range of the resintering temperature and obtain the sintered body having a structure which show a large diffusion of the graphite with the lowered residual rate thereof and exhibit the small re-growth of crystal with the maximum strength at a high range of the re-sintering temperature.

BEST MODE FOR CARRYING OUT THE INVENTION (First Embodiment)

An embodiment of process for producing a sintered powder metal body, according to the present invention, will be described in detail hereinafter by reference to the accompanying drawings.

Figure 1:
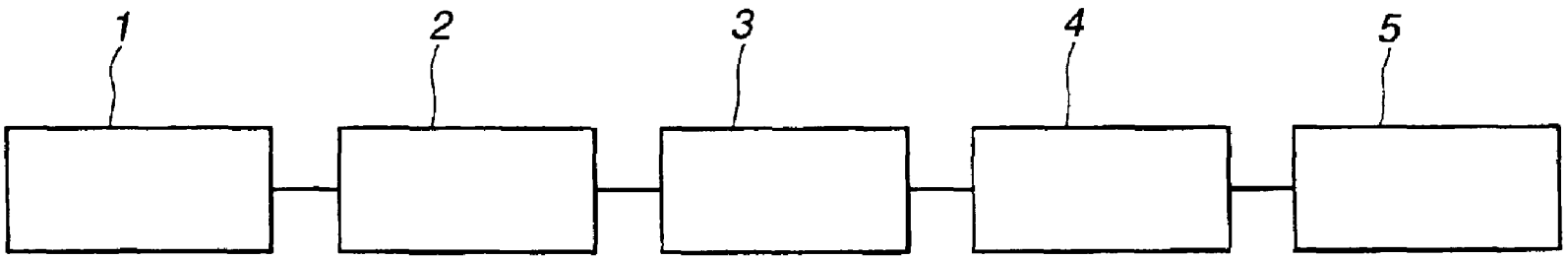
FIG. 1 is an explanatory diagram of processes for the production of a re-compacted body of a metallic powder-molded body and a sintered body produced from the re-compacted body in the embodiment according to the present invention.
Figure 2A:
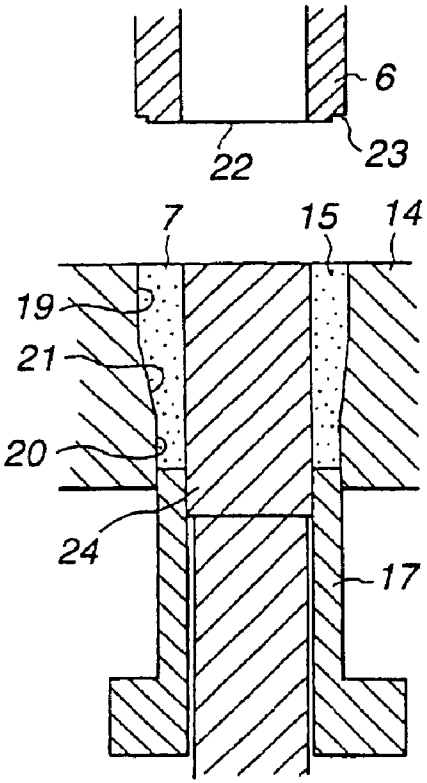
FIGS. 2(*a*)–2(*d*) are explanatory diagrams of a process of a preform, showing (a) filling a metallic powder mixture in a mold cavity of a forming die, (b) pressing the metallic powder mixture by upper and lower punches, (c) staring a downward movement of the forming die for taking the preform out thereof after completion of the pressing, and (d) taking out the preform.
Figure 2B:
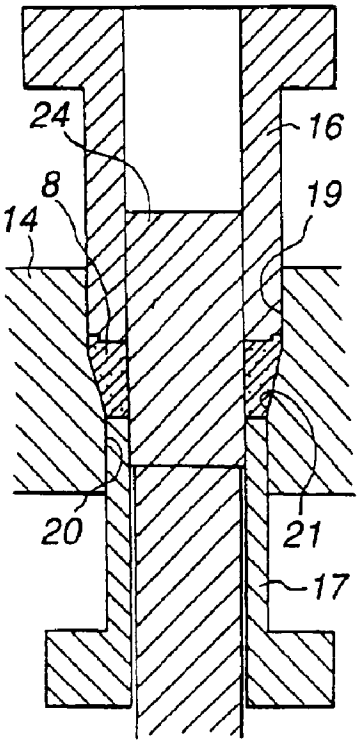
Figure 2C:
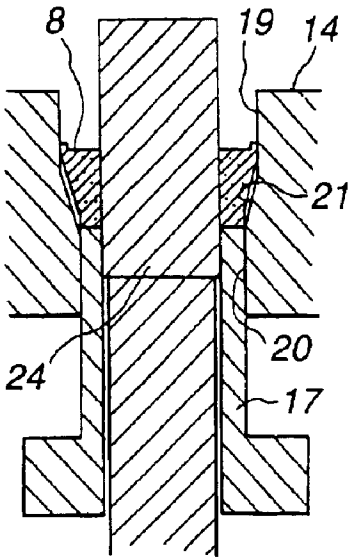
Figure 2D:
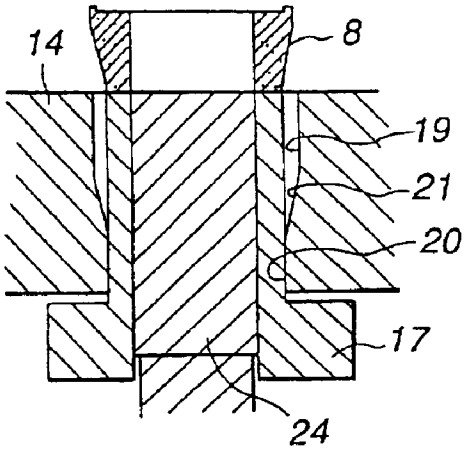

In FIG. 1, reference numeral 1 denotes a preliminary molding step, reference numeral 2 denoting a provisional sintering step, reference numeral 3 denoting a re-compaction step, reference numeral 4 denoting a re-sintering step, reference numeral 5 denoting a heat-treating step.

At the preliminary molding step 1, a metallic powder mixture 7 is compacted into a preform 8. At the provisional sintering step 2, the preform 8 is provisionally sintered to form a metallic powder-molded body 9. At the re-compaction step 3, the metallic powder-molded body 9 is re-compacted into a re-compacted body 10. At the re-sintering step 4, the re-compacted body 10 is re-sintered to form a sintered body 11. At the heat-treating step 5; the sintered body 11 is subjected to a heat treatment.

First, at the preliminary molding step 1 in which the metallic powder mixture 7 is compacted into the preform 8, in this embodiment shown in FIGS. 2(*a*)–(*d*), the metallic powder mixture 7 is filled into a mold cavity 15 of a forming die 14 and pressed by upper and lower punches 16 and 17 to be formed into the preform 8. In this case, the metallic powder mixture 7 and the forming die 14 are conditioned at ordinary temperature.

Specifically, the metallic powder mixture 7 is formed by blending graphite 7*b* in an amount of not less than 0.3% by weight on the basis of the weight of the metallic powder mixture, with an iron-based metal powder 7*a*. By blending the graphite 7*b* of not less than 0.3% by weight with the iron-based metal powder 7*a*, the mechanical strength of the re-compacted body 10 obtained by re-compacting the metallic powder-molded body 9 and the sintered body 11 obtained by re-sintering the re-compacted body 10 can be increased to substantially the same as that of a casted and forged article. The mold cavity 15 of the forming die 14 which is filled with the metallic powder mixture 7 includes a greater-diameter portion 19 into which the upper punch 16 is inserted, a smaller-diameter portion 20 into which the lower punch 17 is inserted, and a tapered portion 21 connecting the greater-diameter and smaller-diameter portions 19 and 20 with each other. Either one or both of the upper and lower punches 16 and 17 received into the mold cavity 15 of the forming die 14 is formed with a notch 23 so as to increase a volume of the mold cavity 15. In this embodiment, the upper punch 16 is formed with the notch 23 on an outer circumferential periphery of its end surface 22 opposed to the mold cavity 15 of the forming die 14. The notch 23 has an annular shape having a generally hook-shape in section.

Reference numeral 24 denotes a core that is inserted into the mold cavity 15 of the forming die 14. The core 24 defines a generally ellipsoidal cylindrical shape of the preform 8 formed within the mold cavity 15.

At the preliminary molding step 1, first, the metallic powder mixture 7 obtained by blending the graphite 7*b* of not less than 0.3% by weight with the metal powder 7*a*, is packed in the mold cavity 15 of the forming die 14 (see FIG. 2(*a*)).

Next, the upper punch 16 and the lower punch 17 are inserted into the mold cavity 15 of the forming die 14 and cooperate to press the metallic powder mixture 7. Specifically, the upper punch 16 is inserted into the greater-diameter portion 19 of the mold cavity 15 and the lower punch 17 is inserted into the smaller-diameter portion 20 of the mold cavity 15 such that they cooperates with each other to press the metallic powder mixture 7. At this time, the upper punch 16 formed with the notch 23 is so constructed as to stop within the greater-diameter portion 19 (see FIG. 2(*b*)).

The metallic powder mixture 7 is thus pressed and compacted into the preform 8. After that, the upper punch 16 is retarded or upwardly moved and at the same time, the forming die 14 is downwardly moved (see FIG. 2(*c*)). The preform B is taken out of the mold cavity 15 (see FIG. 2(*d*)).

Generally, in compaction of the metallic powder mixture, the greater the density of the compacted body is, the higher the friction caused between the compacted body and the forming die becomes and the greater the spring-back of the compacted body becomes. This prevents the compacted body from being readily taken out of the forming die. Therefore, it seems difficult to obtain the compacted body having a relatively high density. However, at the preliminary molding step 1, the problem described above can be effectively solved.

Namely, since the mold cavity 15 of the forming die 14 includes the tapered portion 21, the tapered portion 21 acts as a so-called draft to facilitate the takeout of the preform 8. Further, with the arrangement of the notch 23 increasing the volume of the mold cavity 15 on the outer circumferential periphery of the end surface 22 of the upper punch 16 opposed to the mold cavity 15 of the forming die 14, the density of the preform 8 is locally reduced at the notch 23. As a result, the friction between the preform 8 and the forming die 4 and the spring-back of the preform 8 can be effectively restricted, serving for easily taking the preform 8 out of the forming die 4.

In this manner, the preform 8 having a density of not less than 7.3 g/cm$^3$ can be readily obtained.

By making the density of the preform 8 not less than 7.3 g/cm$^3$, the metallic powder-molded body 9 obtained by provisionally sintering the preform 8 at the provisional sintering step 2 as described in detail later) can have an increased elongation.

Figures 3A, 3B:
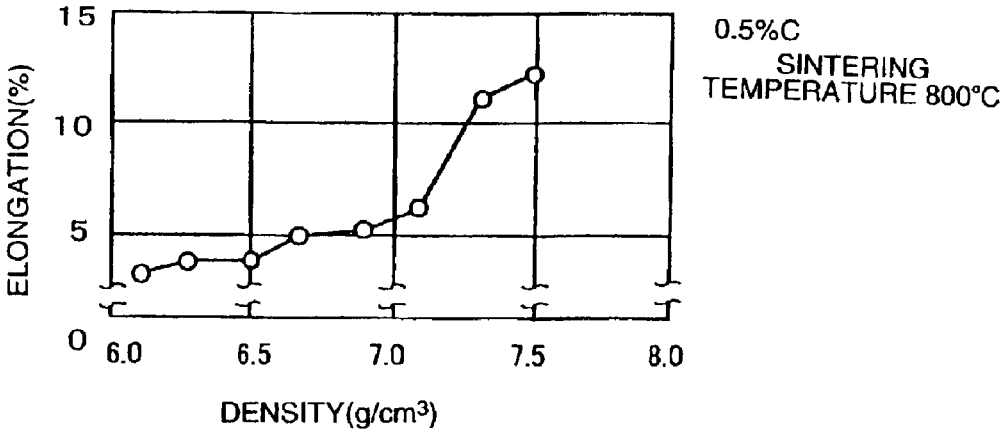
FIGS. 3(*a*) and 3(*b*) are diagrams showing, by (a) data and (b) graph, a relationship between a density of the molded body obtained by provisionally sintering the preform at 800° C. which is made of the metallic powder mixture containing 0.5% by weight of graphite blended, and an elongation of the molded body.

Namely, as shown in FIG. 3, the density of not less than 7.3 g/cm$^3$ of the preform 8 can cause the elongation of not less than 10% of the metallic powder-molded body 9.

Figure 4:
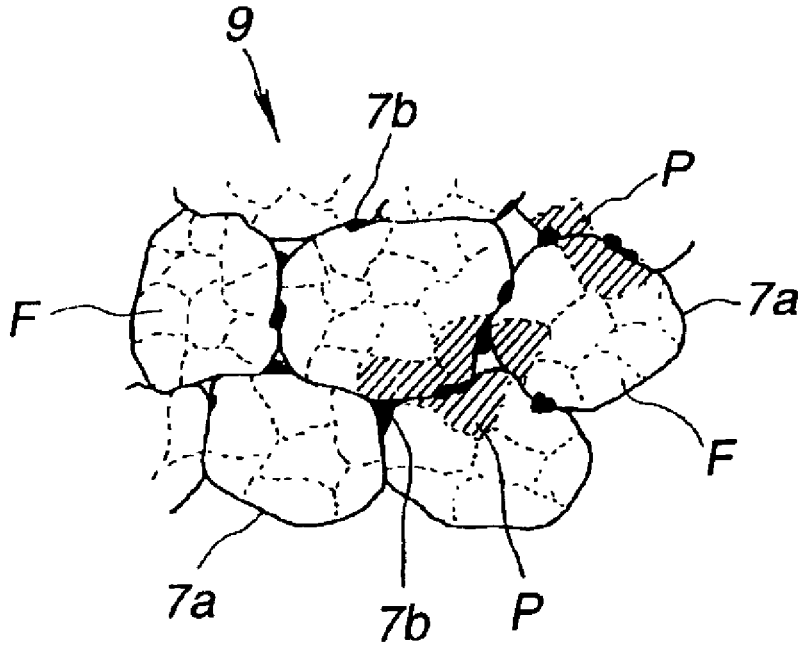
FIG. 4 is a diagram showing a structure of the molded body.

Next, the preform 8 obtained at the preliminary molding step 1 is provisionally sintered at the provisional sintering step 2. As a result, as shown in FIG. 4, the metallic powder-molded body 9 having a structure in which the graphite 7*b* remains along grain boundaries of the metal powder 7*a*, is obtained. In a case where a whole amount of the graphite 7*b* remains along grain boundaries of the metal powder 7*a* in the structure of the metallic powder-molded body 9, the metal powder 7*a* may be constituted by ferrite (F) as a whole. In a case where a part of the graphite 7*b* remains along grain boundaries of the metal powder 7*a*, the metal powder 7*a* may be constituted by ferrite as a matrix and pearlite (P) precipitated near the graphite 7*b*. At least, the structure of the metallic powder-molded body 9 is not the structure in which a whole amount of the graphite 7*b* is diffused into the crystal grains of the metal powder 7*a* to form a solid solution therewith or form carbides. With the structure, the metallic powder-molded body 9 has a large elongation and a low hardness, whereby it has an excellent deformability.

addition, in the preform 8 having a density of not less than 7.3 g/cm$^3$, voids between particles of the metal powder 7*a* are not continuous but isolated, thereby obtaining a molded body 9 showing a large elongation after the provisional sintering. That is, when the voids between particles of the metal powder 7*a* particles are continuous, an atmospheric gas within a furnace is penetrated into an interior of the preform 8 upon the provisional sintering, and a gas generated from graphite contained thereinside is diffused around so as to promote carburization of the preform 8. However, since the voids of the preform B are isolated from each other, the promotion of carburization can be effectively prevented, thereby obtaining the molded body 9 having a large elongation. It is indicated that the elongation of the obtained molded body 9 is rarely influenced by the content of graphite 7*b* by controlling the density of the preform 8 to not less than 7.3 g/cm$^3$. This is because the preform 8 is substantially free from diffusion of carbon upon the provisional sintering. Also, it is indicated that since the preform 8 is substantially free from the diffusion of carbon, the molded body 9 obtained by provisionally sintering the preform 8 shows a reduced hardness.

Further, since, at the provisional sintering step 2, the sintering extensively occurs on contact surfaces between the particles of the iron-based metal powder 7*a* due to the surface diffusion or melting, the metallic powder-molded body 9 can exhibit a large elongation, preferably the elongation of 10% or more.

The provisional sintering temperature at the provisional sintering step 2 is selected preferably within a range of 800–1000° C. By selecting the provisional sintering temperature within the range of 800–1000° C. at the provisional sintering step 2, the metallic powder-molded body 9 obtained at the provisional sintering step 2 can have a good deformability that reduces a deformation resistance of the metallic powder-molded body 9 and facilitates the formation of the re-compacted body 10 upon recompacting the metallic powder-molded body 9 into the re-compacted body 10.

Figures 5A, 5B:
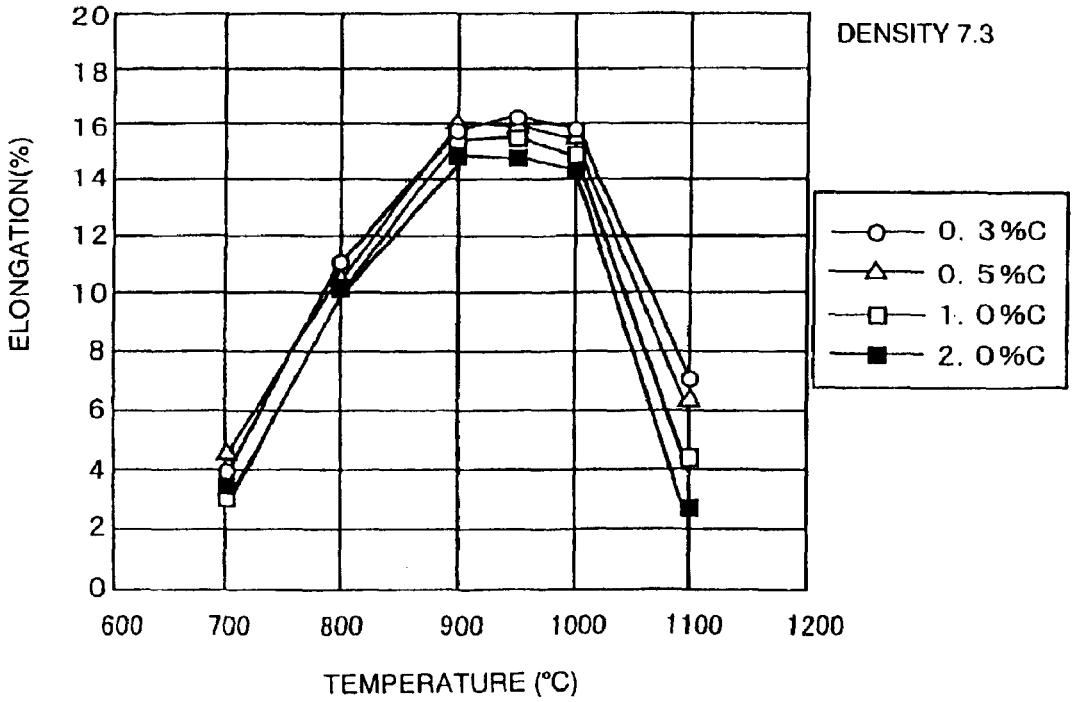
FIGS. 5(*a*) and 5(*b*) are diagrams showing, by (a) data and (b) graph, a variation of elongation of the molded body having a density of 7.3 g/cm3 with variations of an amount of the graphite present in the molded body and the provisional sintering temperature.
Figures 6A, 6B:
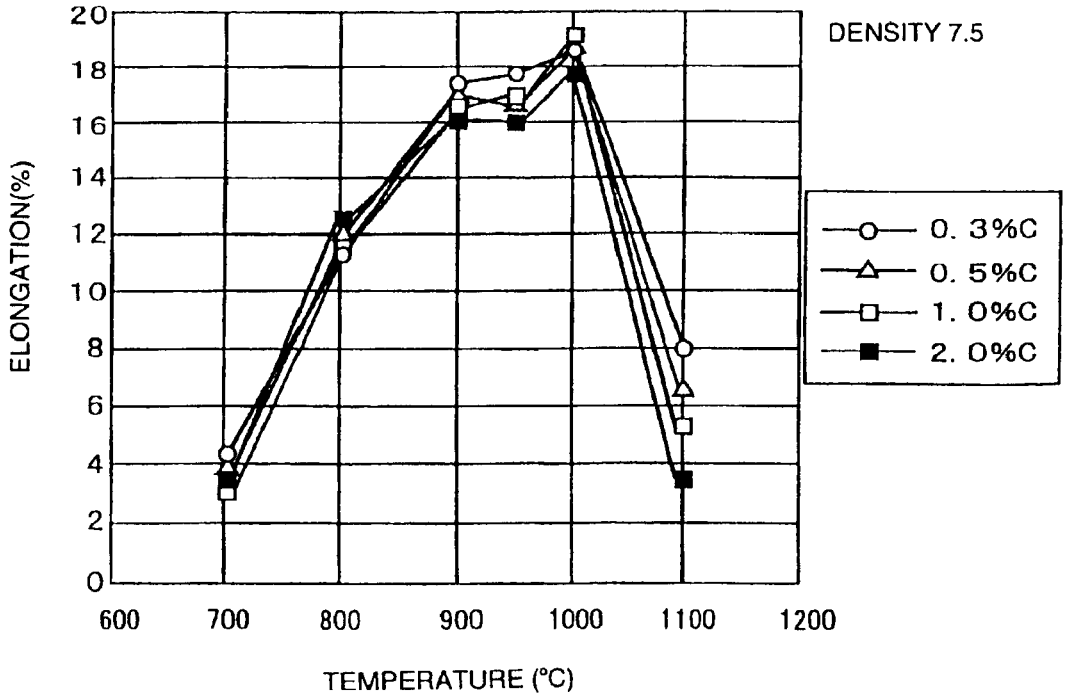
FIGS. 6(*a*) and 6(*b*) are diagrams showing, by (a) data and (b) graph, a variation of elongation of the molded body having a density of 7.9 g/cm$^3$ with variations of the amount of the graphite present in the molded body and the provisional sintering temperature.
Figures 7A, 7B:
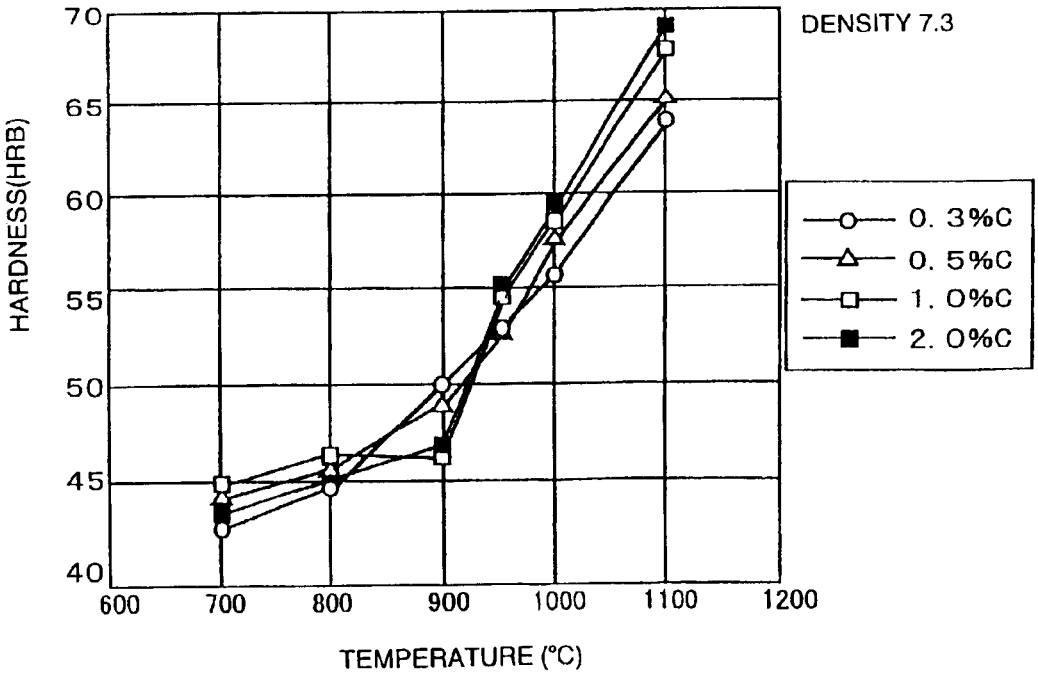
FIGS. 7(*a*) and 7(*b*) are diagrams showing, by (a) data and (b) graph, a variation of hardness of the molded body having a density of 7.3 g/cm$^3$ with variations of the amount of the graphite present in the molded body and the provisional sintering temperature.
Figures 8A, 8B:
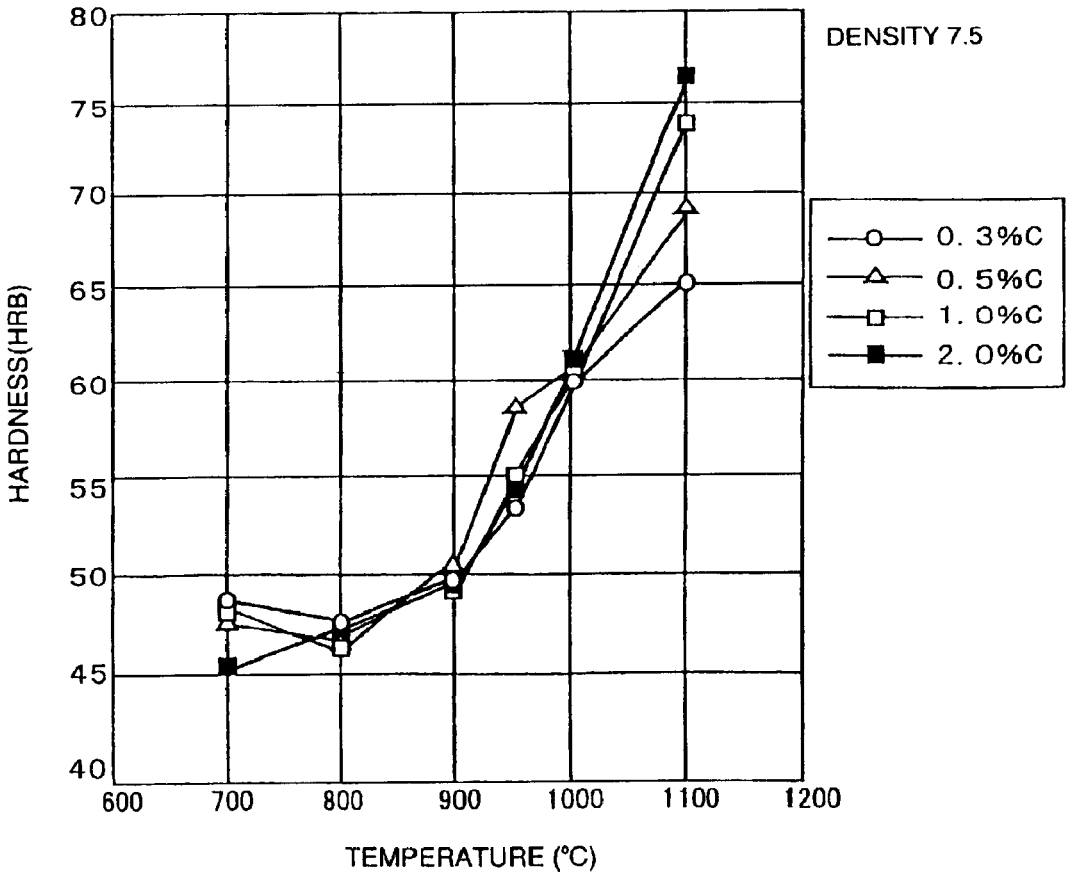
FIGS. 8(*a*) and 8(*b*) are diagrams showing, by (a) data and (b) graph, a variation of hardness of the molded body having a density of 7.5 g/cm$^3$ with variations of the amount of the graphite present in the molded body and the provisional sintering temperature.

Namely, as shown in FIGS. 5 and 6, by provisionally sintering the preform 8 at the temperature of 800–1000° C., the metallic powder-molded body 9 having the elongation of 10% or more can be obtained. Further, as shown in FIGS. 7 and 8, by provisionally sintering the preform 8 at the temperature of 800–1000° C., the metallic powder-molded body 9 having a hardness of not more than HRB60 can be obtained. The hardness of not more than HRB60 of the metallic powder-molded body 9 is lower than the hardness exhibitable in the case of annealing a low carbon steel which has a carbon content of approximately 0.2%.

Figures 9A, 9B:
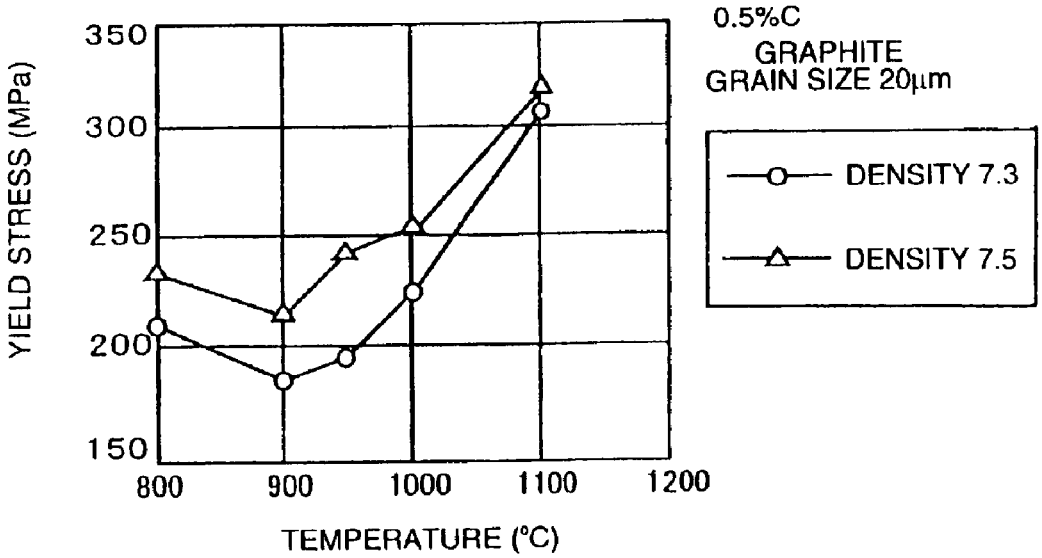
FIGS. 9(*a*) and 9(*b*) are diagrams showing, by (a) data and (b) graph, a relationship between a provisional sintering temperature and a yielding stress of the molded bodies having densities of 7.3 g/cm$^3$ and 7.5 g/cm$^3$, in which the molded bodies are made from the metallic powder mixture containing 0.5% by weight of graphite having a particle diameter of 20
Figures 10A, 10B:
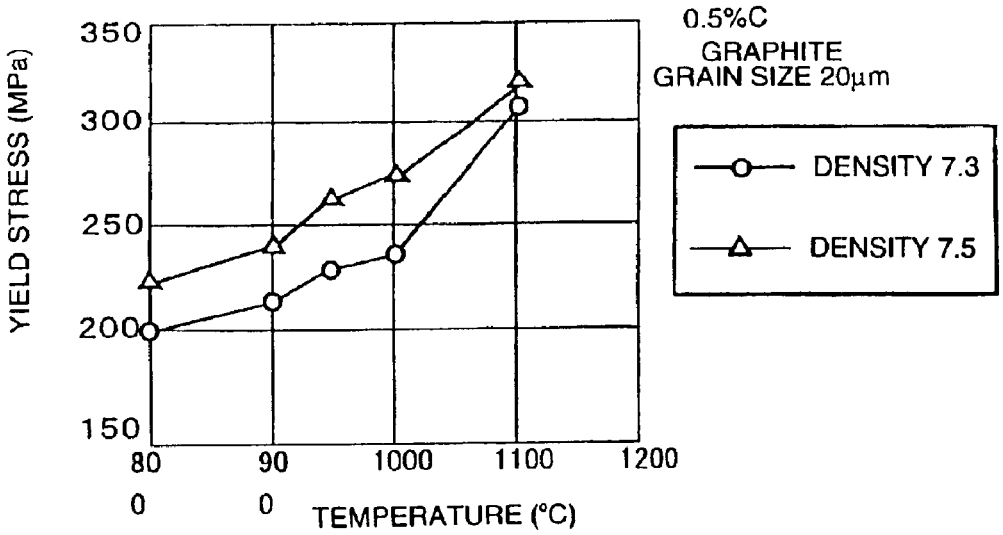
FIGS. 10(*a*) and 10(*b*) are diagrams showing, by (a) data and (b) graph, a relationship between the provisional sintering temperature and the yielding stress of the molded bodies having densities of 7.3 g/cm$^3$ and 7.5 g/cm$^3$, in which the molded bodies are made from the metallic powder mixture containing 0.5% by weight of graphite having a particle diameter of 5

Furthermore, as shown in FIGS. 9 and 10, the yielding stress of the metallic powder-molded body 9 falls in the range of 202–272 MPa in the case of the provisional sintering temperature of the preforms 8 within the range of 800–1000° C. The yielding stress in the range of 202–272 MPa is lower than the yielding stress of a low carbon steel having a carbon content of approximately 0.2%.

Next, the metallic powder-molded body 9 obtained at the provisional sintering step 2 is re-compacted into the re-compacted body the re-compaction step 3. The re-compaction of the metallic powder-molded body 9 is conducted preferably at ordinary temperature. In this case, the metallic powder-molded body 9 can be readily re-compacted and suffer from no scale because of the good deformability.

By re-compacting the metallic powder-molded body 9, the re-compacted body 10 can be obtained with high dimensional accuracy at the re-compacting load applied thereto.

Figure 11A:
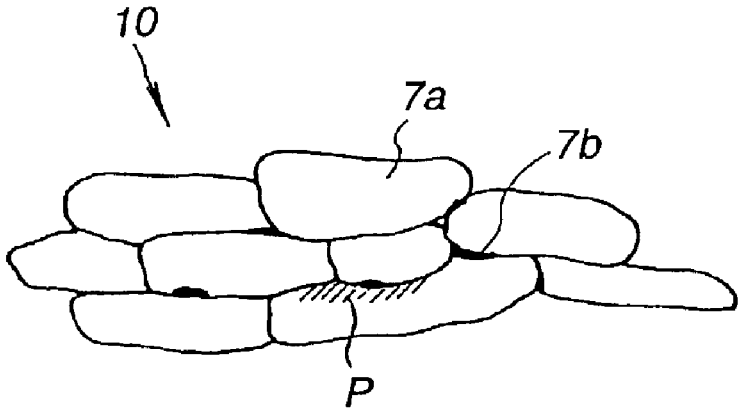
FIGS. 11(*a*) and 11(*b*) are diagrams showing a structure of the re-compacted body obtained (a) when the re-compaction is conducted at a small degree and (b) when the re-compaction is further conducted.
Figure 11B:
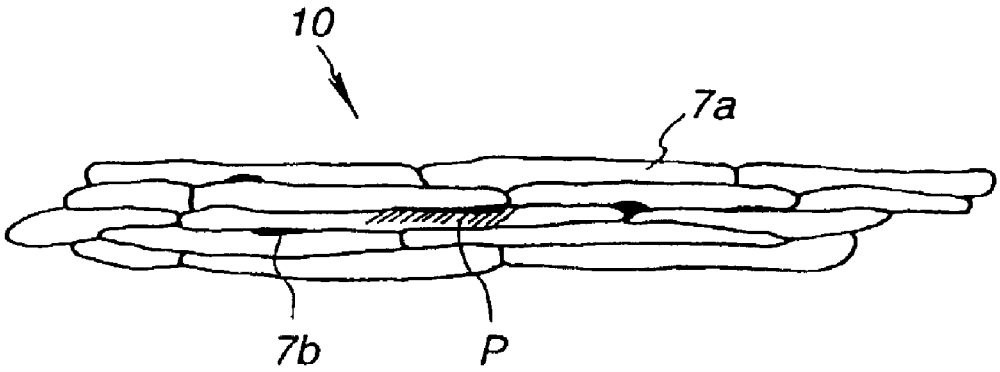

The re-compacted body 10 has a structure in which the graphite 7*b* remains along a grain boundary of the metal powder 7*a*. As shown in FIG. 11, the metal powder 7*a* has a flattened shape that is determined depending on the degree of re-compaction. That is, in a small degree of re-compaction, the metal powder 7*a* is slightly flattened to form the structure in which many of voids between the metal powder 7*a* are eliminated (see FIG. 11(*a*)). In a large degree of re-compacting greater than the small degree thereof, the metal powder 7*a* is remarkably flattened to form the structure in which substantially all voids between the metal powder 7*a* are dissipated (see FIG. 11(*b*)).

The re-compacted body 10 has such a structure in which particles of the metal powder 7*a* of the molded body 9 are largely deformed into a flat shape. However, since the molded body 9 itself has the structure in which the graphite 7*b* remains along a grain boundary of the metal powder 7*a*, the obtained re-compacted body 10 is excellent in machinability and lubricating ability.

Accordingly, there can be provided the re-compacted body 10 formed from the metallic powder-molded body 9, which has an excellent deformability suitable for the manufacture of machine parts having an increased mechanical strength caused due to sintered metal, as well as a process for the production thereof.

In addition, with the arrangement in which the tapered portion 21 and the notch 23 are formed in the forming die 14 and the upper punch 16, respectively, which are used at the preliminary molding step 1, the preform 8 having the density of notless than 7.3 g/cm$^3$ can be readily obtained. Further, owing to the provisionally sintering temperature of 800–1000° C. at the provisional sintering step 2, the metallic powder-molded body 9 has the structure in which the graphite 7*b* remains along the grain boundary of the metal powder 7*a*, the hardness of HRB60 or less and the elongation of 10% or more. The metallic powder-molded body 9 having the thus enhanced deformability can be obtained.

Figure 12:
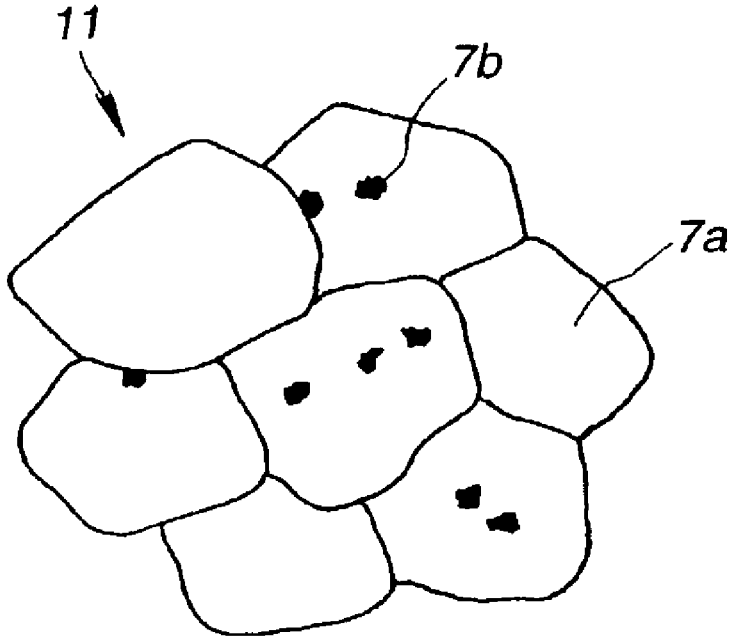
FIG. 12 is a diagram showing a structure of the sintered body.

Next, the re-compacted body 10 obtained at the re-compaction step 3 is re-sintered to form the sintered body 11 at the re-sintering step 4. The sintered body 11 has such a structure as shown in FIG. 12, in which the graphite 7*b* is diffused into the ferrite matrix of the metal powder 7*a* (to form a solid solution or carbide therewith), or in which the graphite 7*b* is diffused and remains in the ferrite or pearlite matrix of the metal powder 7*a* at a predetermined rate. Here, the predetermined rate of the residual graphite 7*b* may be zero.

Figures 13A, 13B:
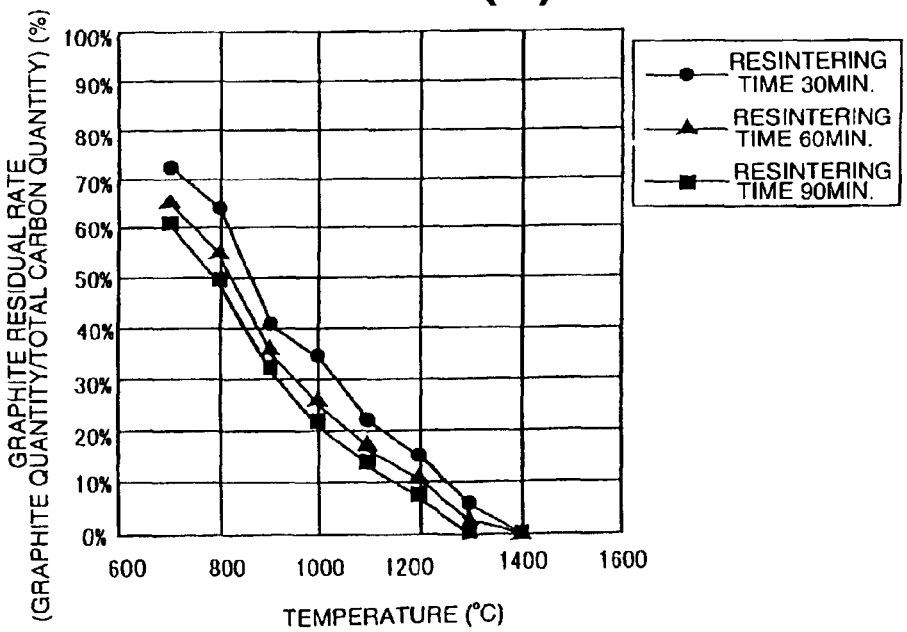
FIGS. 13(*a*) and 13(*b*) are diagrams showing, by (a) data and (b) graph, a variation of a residual rate of the graphite remaining in the sintered body with variation of the re-sintering temperature.

The rate of the residual graphite 7*b* remaining in the sintered body 11 varies depending on the re-sintering temperature. The higher the re-sintering temperature becomes, the lower the rate of the residual graphite 7*b* becomes (see FIG. 13). Accordingly, the mechanical properties such as predetermined strength of the sintered body 11 can be selectively determined.

The re-sintering temperature at the re-sintering step 4 is preferably selected in a range of 700–1300° C. Owing to the re-sintering temperature of this range, the diffusion of the graphite 7*b* can be reduced at the low re-sintering temperature range so that the sintered body 11 having a higher rate of the residual graphite 7*b* can be obtained. On the other hand, the diffusion of the graphite 7*b* can be increased at the high re-sintering temperature range, whereby the sintered body 11 having a lower rate of the residual graphite 7*b*, a less re-growth of the crystal grains and a maximum strength can be obtained.

Figures 14A, 14B:
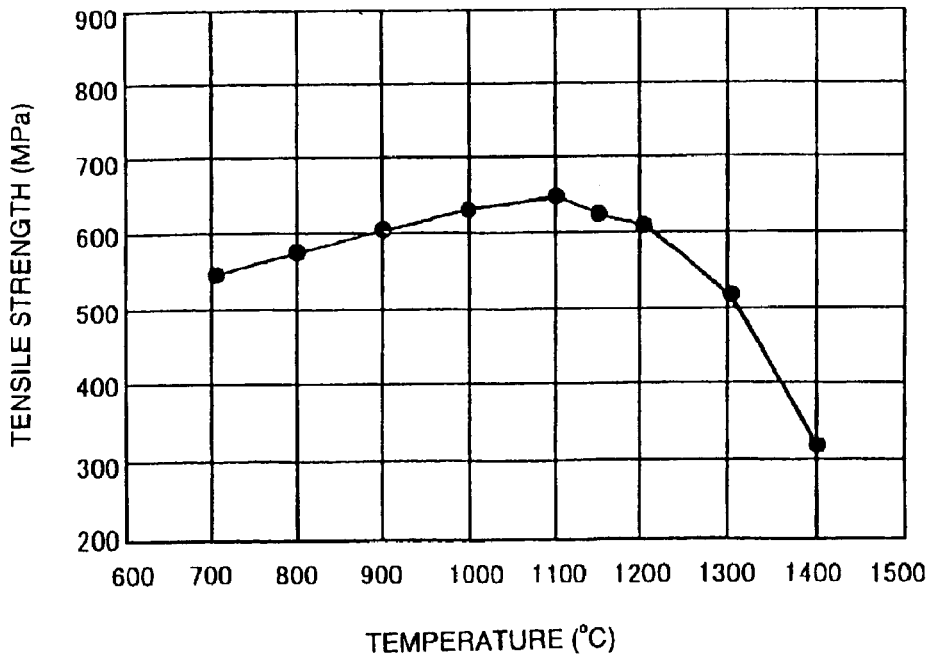
FIGS. 14(*a*) and 14(*b*) are diagrams showing, by (a) data and (b) graph, a variation of a tensile strength of the sintered body with variation of the re-sintering temperature.
Figures 15A, 15B:
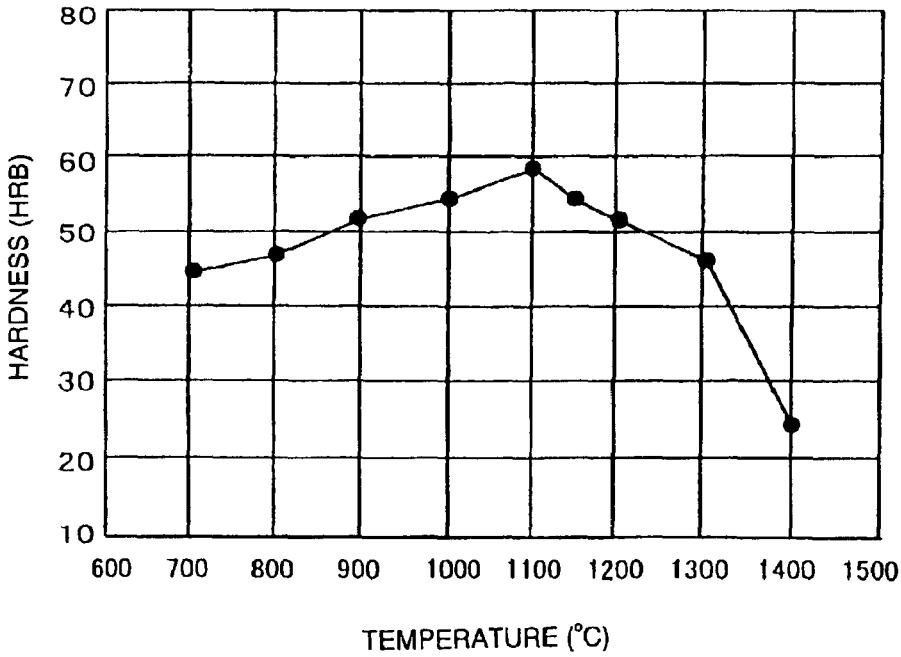
FIGS. 15(*a*) and 15(*b*) are diagrams showing, by (a) data and (b) graph, a variation of hardness of the sintered body with variation of the re-sintering temperature.

Specifically, as shown in FIGS. 14 and 15, in a case where the re-sintering temperature is in the relatively low range of 700–1000° C., the hardness of the re-compacted body work-hardened at the re-compaction step 3 is reduced by the re-sintering, but as the diffusion of the graphite 7*b* proceeds, the structure containing the fine crystal grains is obtained due to the low-temperature re-sintering. As a result, the strength and hardness of the obtained sintered body is increased. Meanwhile, depending on the shape of the re-compacted body obtained at the re-compaction step 3, the low-temperature re-sintering causes a large reduction in hardness of the work-hardened re-compacted body. In such a case, the work-hardened re-compacted body is slowly softened and hardened again at approximately 1000° C.

Further, in a case where the re-sintering temperature is in the relatively high range of 1000–1300° C., the residual rate of the graphite 7*b* decreases and the graphite 7*b* is sufficiently diffused in the ferrite matrix (to form the solid solution or carbide therewith). This causes the strength and hardness of the obtained sintered body to increase. However, if the re-sintering temperature exceeds 1100° C., there will occur such a tendency that the total amount of carbon contents decreases as the amount of carbon decarburized increases, or the strength and hardness of the sintered body obtained are reduced due to the re-growth of the crystal grains. If the re-sintering temperature is beyond 1300° C., the structure of the sintered body will become bulky due to an excessive growth of the crystal gains. This leads to a remarkable reduction of the strength and hardness of the sintered body 11 obtained. Therefore, the re-sintering temperature is preferably within the range of 700–1300° C., and more preferably within the range of 900–1200° C. in order to obtain a stable structure of the sintered body 11 obtained.

Accordingly, there can be provided the sintered body 11 obtained by re-sintering the re-compacted body 10 produced from the metallic powder-molded body 9, which has an excellent deformability suitable for the manufacture of machine parts having an increased mechanical strength caused due to sintered metal, as well as a process for the production thereof.

Further, owing to the re-sintering temperature of 700–1300° C. at the re-sintering step, it is possible by selecting the re-sintering temperature within the range to obtain the sintered body 11 having the structure that has the less diffusion of the graphite 7*b* and the higher rate of the residual graphite 7*b*, and the sintered body 11 having the structure that has the increased diffusion of the graphite 7*b* and the lower rate of the residual graphite 7*b* and at the same time the small re-growth of the crystal and the maximum strength.

Next, at the heat treatment step 5, the sintered body 11 is subjected to heat treatment. The heat treatment at the heat treatment step 5 is conducted by one selected from various treatments such as induction quenching, carburizing-quenching, nitriding and the combination thereof. As a result, the graphite 7*b* forms a super-saturated solid solution with a base material of the metal powder, or is precipitated in the form of fine carbides or nitrides to thereby form a hardened layer. This can impart good mechanical properties to the sintered body 11.

Figures 16A, 16B:
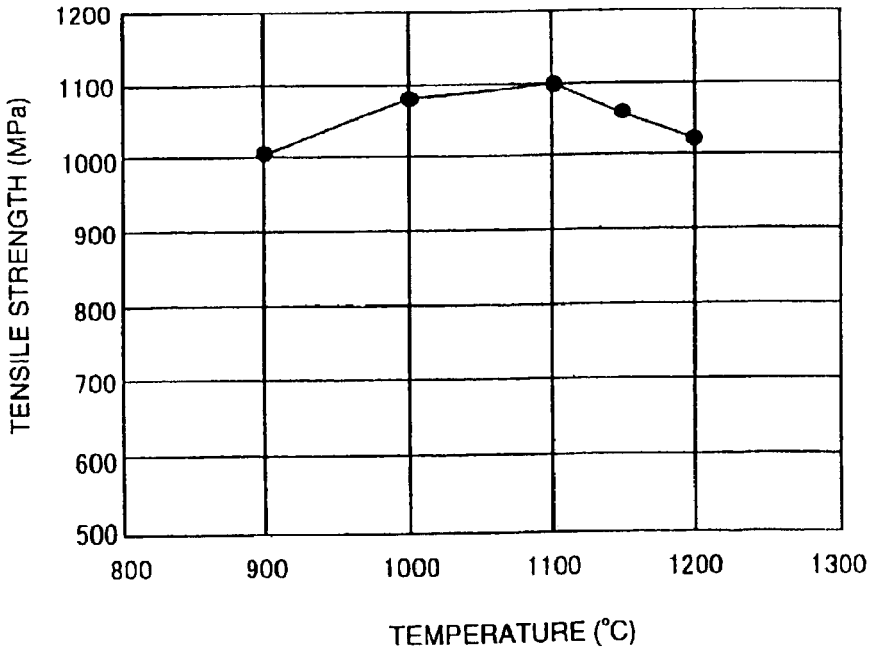
FIGS. 16(*a*) and 16(*b*) are diagrams showing, by (a) data and (b) graph, a relationship between the re-sintering temperature and the tensile strength of the sintered body, in which the sintered body is obtained by the heat treatment under a predetermined condition after being produced by changing the re-sintering temperature.
Figures 17A, 17B:
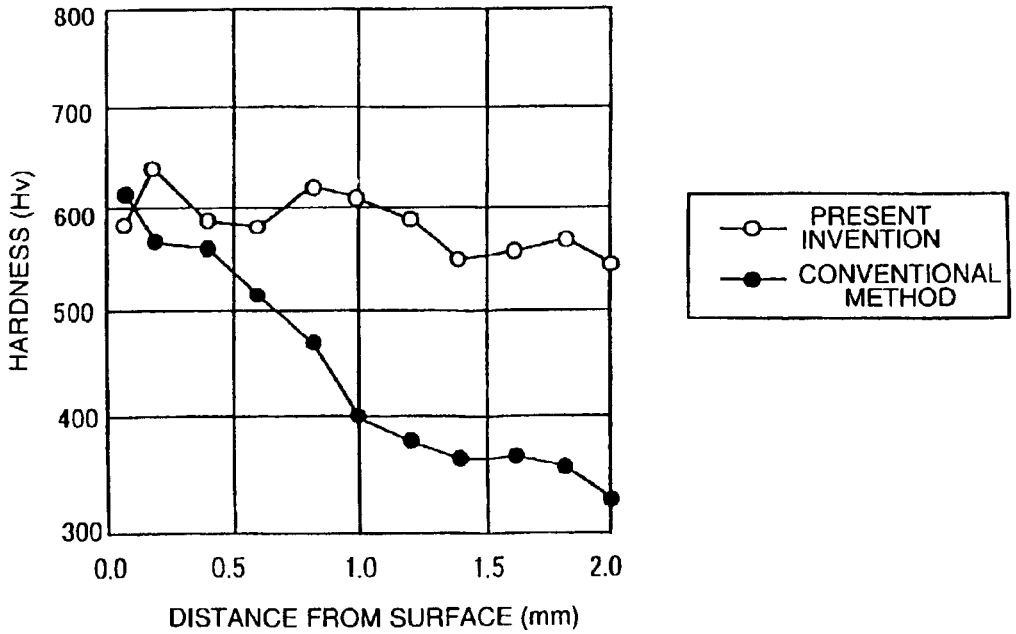
FIGS. 17(*a*) and 17(*b*) are diagrams showing, by (a) data and (b) graph, a relationship between hardness and a distance from a surface of the body heat-treated under a predetermined condition.

Specifically, as shown in FIG. 16, the heat-treated sintered body 11 has a tensile strength larger than that of the sintered body 11 merely resintered because of the presence of the hardened layer formed therein. Further, the sintered body 11 obtained by re-sintering the re-compacted body 10 at a predetermined temperature has less amount of voids and a high density owing to the re-compaction at the re-compaction step 3, so that the degree of diffusion of carbon due to the heat treatment is lessened inwardly from the surface of the sintered body 11. For this reason, as illustrated in FIG. 17, the heat-treated sintered body 11 shows an increased hardness in the vicinity of the surface thereof, and a good toughness at an inside thereof, thereby allowing the sintered body 11 to have excellent mechanical properties as a whole.

Accordingly, there can be provided the sintered body 11 obtained by heat-treating the sintered body after re-sintering the re-compacted body produced from the metallic powder-molded body, which has an excellent deformability suitable for the manufacture of machine parts having an increased mechanical strength caused due to sintered metal, as well as a process for the production thereof.

Next, an embodiment of the present invention as recited in at least certain claims and claims subsequent thereto will be described in detail.

Namely, processes for the production of the metallic powder-molded body, the re-compacted body and the sintered body of the embodiments of the invention are the same as that shown in FIG. 1. The step of producing the preform is also the same as that shown in FIG. 2. At the preliminary molding step 1 shown in FIG. 1, in this embodiment shown in FIGS. 2(*a*)–(*d*), a metallic powder mixture 7 explained later is filled in the mold cavity 15 of the forming die 14 and then pressed by the upper and lower punches 16 and 17 to form the preform 8 having the density of not less than 7.3 g/cm3. In this case, the metallic powder mixture 7 and the forming die 14 are conditioned at ordinary temperature.

The mold cavity 15 of the forming die 14 includes a greater-diameter portion 19 into which the upper punch 16 is inserted, a smaller-diameter portion 20 into which the lower punch 17 is inserted, and a tapered portion 21 connecting the greater-diameter an d smaller-diameter portions 19 and 20 with each other.

Either one or both of the upper and lower punches 16 and 17 received into the mold cavity 15 of the forming die 14 is formed with a notch 23 so as to increase a volume of the mold cavity 15. In this embodiment, the upper punch 16 is formed with the notch 23 on an outer circumferential periphery of its end surface 22 opposed to the mold cavity 15 of the forming die 14. The notch 23 has an annular shape having a generally hook-shape in section.

Reference numeral 24 denotes a core inserted into the mold cavity 15 of the forming die 14. The core 24 defines a generally cylindrical shape of the preform 8 formed within the mold cavity 15.

In the preliminary molding step 1, first, as shown in FIG. 2(*a*), the metallic powder mixture 7 is filled in the mold cavity 15 of the forming die 14. The filled metallic powder mixture 7 is prepared by blending graphite in amount of not less than 0.1% by weight with the following metal powder.

Specifically, the metal powder is a metal powder containing at least one alloy element selected from the group consisting of molybdenum (Mo), nickel (Ni), manganese (Mn), copper (Cu), chromium (Cr), tungsten (W), vanadium (V), cobalt (Co) and the like, and as the remainder, iron and a small amount of inevitable impurities (the metal powder according to at least certain claims); a metal powder obtained by diffusing and depositing a powder containing an alloy element selected from the above-described alloy elements as a main component onto an iron-based metal powder (the metal powder according to at least certain claims); or a metal powder obtained by blending a powder containing an alloy element selected from the above-described alloy elements as a main component with the iron-based metal powder (the metal powder according to at least certain claims).

Next, the upper punch 16 and the lower punch 17 are inserted into the mold cavity 15 of the forming die 14 and cooperate to press the metallic powder mixture 7. Specifically, the upper punch 16 is inserted into the greater-diameter portion 19 of the mold cavity 15 and the lower punch 17 is inserted into the smaller-diameter portion 20 of the mold cavity 15 such that they cooperate with each other to press the metallic powder mixture 7. At this time, the upper punch 16 formed with the notch 23 is so constructed as to stop within the greater-diameter portion 19 (see FIG. 2(*b*)).

After pressing and compacting the metallic powder mixture 7 into the preform 8, the upper punch 16 is retarded or upwardly moved and at the same time, the forming die 14 is downwardly moved (see FIG. 2(*c*)). The obtained preform 8 is taken out of the mold cavity 15 (see FIG. 2(*d*)).

Generally, upon compaction of the metallic powder mixture, the greater the density of the compacted body is, the higher the friction caused between the compacted body and the forming die becomes and the greater the spring-back of the compacted body becomes. For this reason, it is difficult to take the compacted body out from the forming die. Although it seems difficult to obtain the compacted body having a high density, the problem described above can be effectively solved at the preliminary molding step 1.

Specifically, since the mold cavity 15 of the forming die 14 includes the tapered portion 21, the tapered portion 21 acts as a so-called draft to facilitate the takeout of the preform 8 from the forming die 14. Further, with the arrangement of the notch 23 increasing the volume of the mold cavity 15 on the outer circumferential periphery of the end surface 22 of the upper punch 16 opposed to the mold cavity 15 of the forming die 14, the density of the preform 8 is locally reduced at the notch 23. As a result, the friction between the preform 8 and the forming die 4 and the spring-back of the preform 8 can be effectively restricted, so that the takeout of the preform 8 from the forming die 4 can be facilitated.

In this manner, the preform 8 having the density of not less than 7.3 g/cm$^3$ can be readily obtained.

Figure 18:
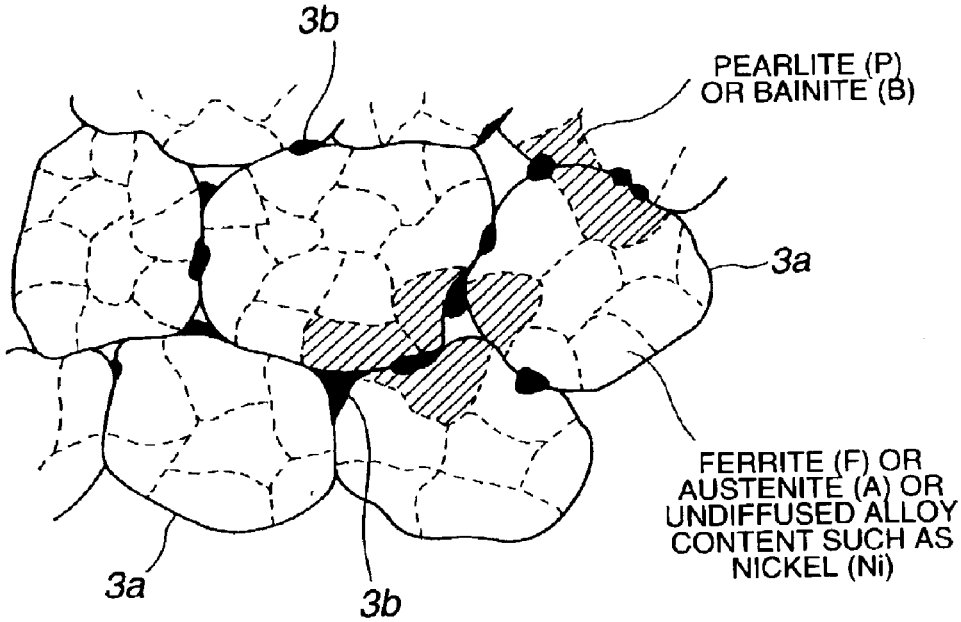
FIG. 18 is a diagram showing a structure of the molded body produced by provisionally sintering the preform corresponding to Examples 1 and 2 in the embodiment according to at least certain claims.

Next, the preform 8 obtained at the preliminary molding step 1 is provisionally sintered at the provisional sintering step 2. As a result, it is possible to obtain the molded body having a structure in which the graphite 3*b* remains along a grain boundary of the metal powder 3*a* and there exists substantially no precipitate such as carbides of iron or the alloy element, as shown in FIG. 18.

Specifically, if the metal powder 3*a* according to at least certain claims is used and the whole amount of graphite 3*b* remains along the grain boundary of the metal powder 3*a* (no diffusion of the graphite 3*b*), the metal powder 3*a* may be constituted by ferrite (F) or austenite (A) as a whole. If a part of graphite 3*b* is diffused in the metal powder 3*a*, the metal powder 3*a* may contain a less amount of pearlite (P) or bainite (B) precipitated near the graphite 3*b*. Further, if the metal powder 3*a* according to at least certain claims is used and the whole amount of graphite 3*b* remains along the grain boundary of the metal powder 3*a*, the metal powder 3*a* may be constituted by ferrite (F) or austenite (A) as a whole or may contain the undiffused alloy component such as nickel (Ni). If the metal powder 3*a* according to at least certain claims is used and a part of graphite 3*b* is diffused in the metal powder 3*a*, the metal powder 3*a* may contain a less amount of pearlite (P) or bainite (B) precipitated near the graphite 3*b*. That is, at least the metal powder 3*a* may be constituted by pearlite (P) or bainite (B) as a whole. Therefore, the molded body has a low hardness and a large elongation, exhibiting an excellent deformability.

More specifically, since the preform 8 has the density of not less than 7.3 g/cm3, voids between the metal powder 3*a* are not continuous but isolated, thereby obtaining a molded body exhibiting a large elongation after the provisional sintering. That is, if the voids between particles of the metal powder 3*a* are continuous, an atmospheric gas within a furnace will enter deep an interior of the preform 8 upon the provisional sintering and a gas generated from the graphite contained thereinside will be diffused around so as to promote carburization of the preform 8. However, since the voids of the preform 8 are isolated from each other, the promotion of carburization can be effectively prevented so that the molded body 9 can have a low hardness and a large elongation. Accordingly, the hardness and elongation of the obtained molded body is rarely influenced by the content of graphite 3*b*.

Further, at the provisional sintering step 2, the sintering extensively occurs by the surface diffusion or melting caused on contact surfaces of particles of the metal powder 3*a* in the preform 8, whereby the molded body can exhibit a larger elongation.

The sintering temperature at the provisional sintering step 2 is selected within a range of 700–1000° C. If the sintering temperature is below 700° C., the bonding of the metal powder does not sufficiently proceed. If the sintering temperature is higher than 1000° C., the graphite 3*b* is excessively diffused in the metal powder to increase the hardness too much. The sintering temperature may be normally selected within a range of 800–1000° C. In a case where the metal powder contains the alloy element such as chromium (Cr) which is capable of readily producing carbides, the sintering temperature may be selected within a range of 700–800° C. This is because the precipitate such as carbides of the alloy element will occur at the sintering temperature higher than 800° C. to thereby increase the hardness.

Figures 19A, 19B:
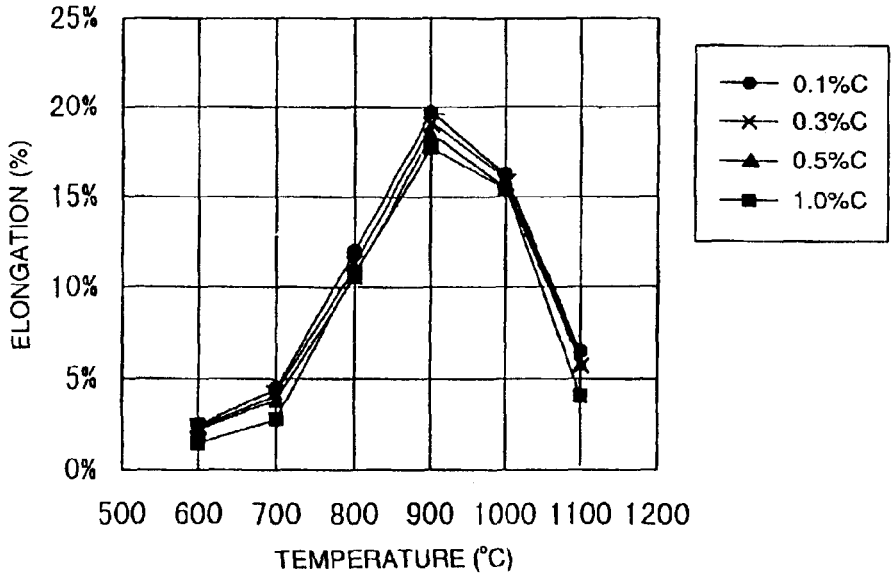
FIGS. 19(A) and 19(B) are diagrams showing, by data and graph, a variation of elongation of the molded body corresponding to Example 1 with variations of an amount of the graphite present in the molded body and the provisional sintering temperature.
Figures 20A, 20B:
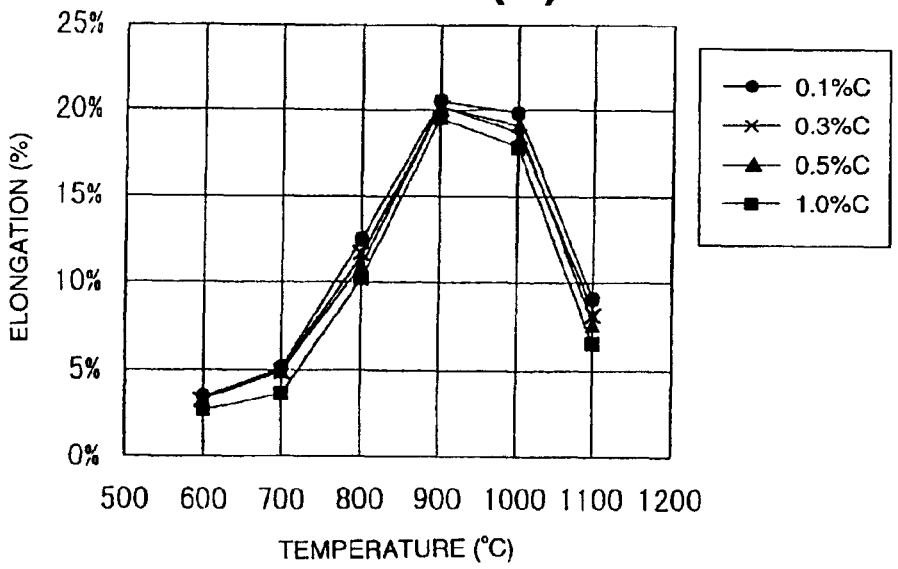
FIGS. 20(A) and 20(B) are diagrams, by data and graph, a variation of elongation of the molded body corresponding to Example 2 with variations of an amount of the graphite present in the molded body and the provisional sintering temperature.
Figures 21A, 21B:
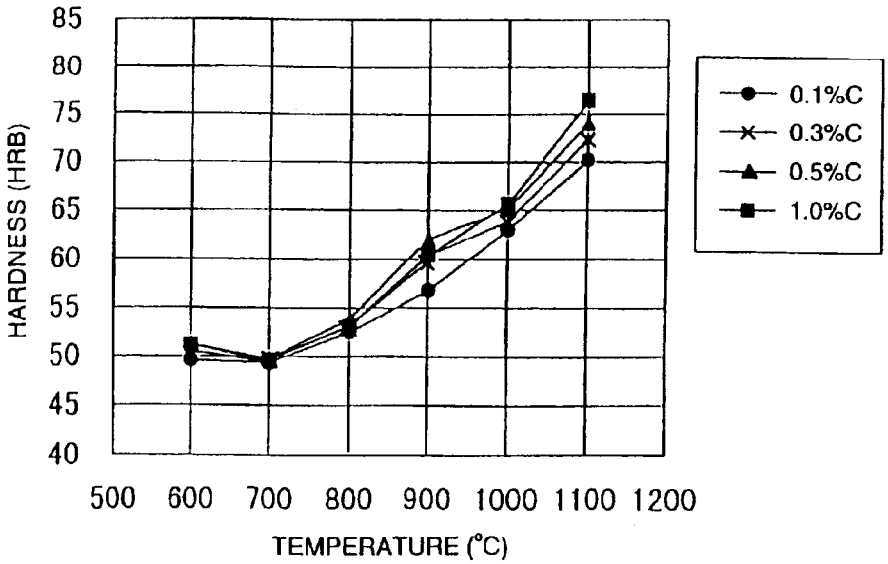
FIGS. 21(A) and 21(B) are diagrams, by data and graph, a variation of hardness of the molded body corresponding to Example 1 with variations of an amount of the graphite present in the molded body and the provisional sintering temperature.
Figures 22A, 22B:
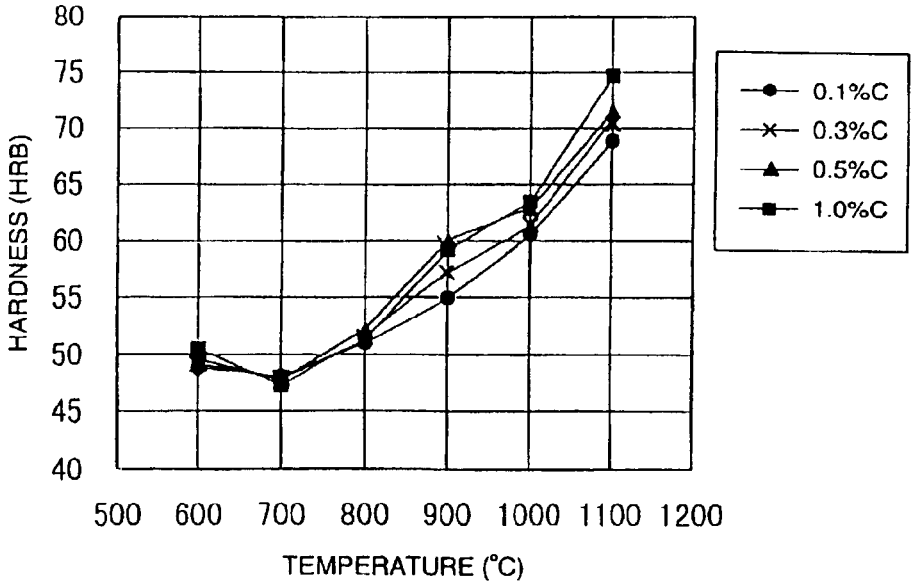
FIGS. 22(A) and 22(B) are diagrams showing, by data and graph, a variation of hardness of the molded body corresponding to Example 2 with variations of an amount of the graphite present in the molded body and the provisional sintering temperature.

FIG. 19 shows test data and a graph indicating a relationship between the provisional sintering temperature and the elongation of the molded body in Example 1 described later. FIG. 20 shows test data and a graph, similar to FIG. 19, but indicating the relationship obtained in Example 2. FIG. 21 shows test data and a graph indicating a relationship between the provisional sintering temperature and the hardness of the molded body in Example 1. FIG. 22 shows test data and a graph, similar to FIG. 21, but indicating the relationship obtained in Example As be apparent from the data and the graphs, if the provisional sintering temperature is selected within the range of 700–1000° C., at least the elongation of 5% or more of the molded body and the hardness of approximately HRB60 thereof can be maintained. Meanwhile, the hardness of HRB60 is substantially the same as the hardness exhibitable in the case of annealing a high-strength cold-forging steel. The molded body of the present invention can exhibit the hardness of approximately HRB60 without being subjected to annealing.

Also, the molded body obtained at the provisional sintering step 2 is subjected to recompaction (cold forging and the like) to form a plastic-worked body at the subsequent re-compaction step 3. The obtained plastic-worked body has a structure having substantially no voids because the molded body containing the graphite 3*b* retained along the grain boundary of the metal powder 3*a* has a dense structure with collapsed voids therein.

Figures 23A, 23B:
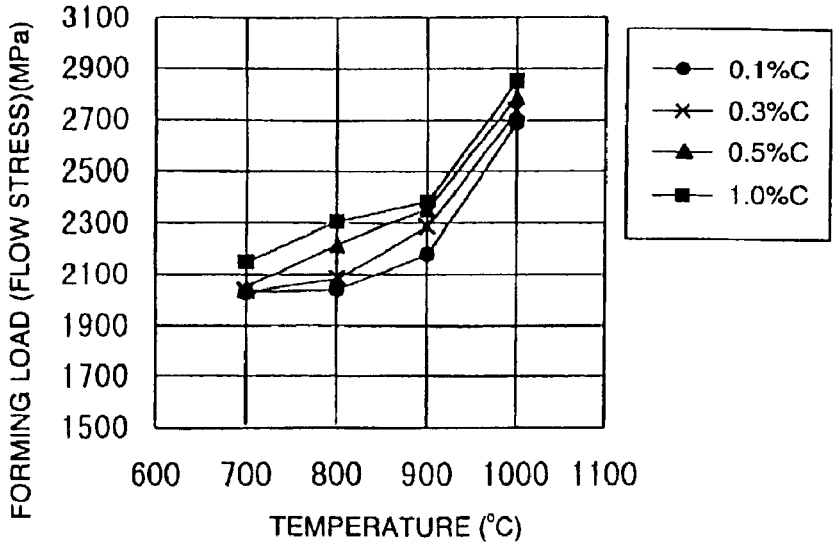
FIGS. 23(A) and 23(B) are diagrams showing, by data and graph, a molding load (deformation resistance) per unit time applied to the molded body corresponding to Example 1 upon the re-compaction (cold forging) thereof.
Figures 24A, 24B:
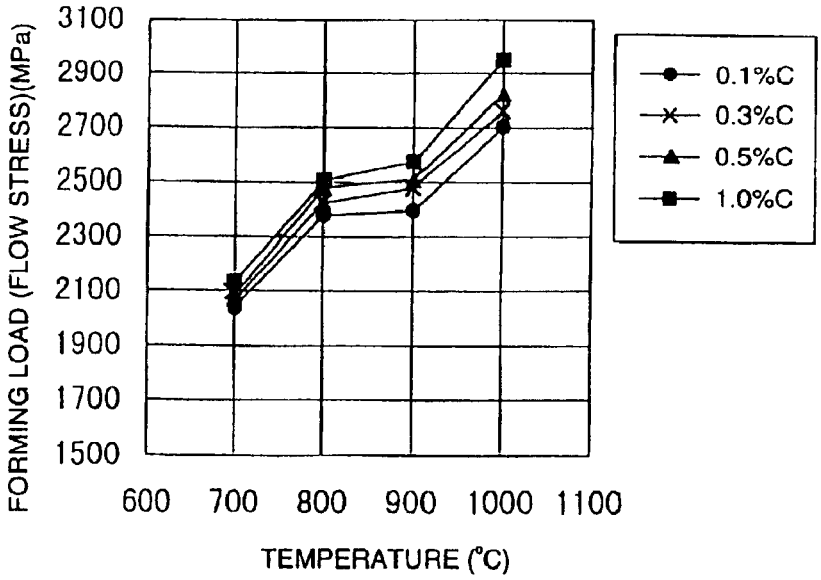
FIGS. 24(A) and 24(B) are diagrams showing, by data and graph, a molding load (deformation resistance) per unit time which is applied to the molded body corresponding to Example 2 upon the re-compaction (cold forging) thereof.

Further, since the obtained plastic-worked body is substantially free from diffusion of carbon owing to the structure of the molded body in which the graphite 3*b* remains along the grain boundary of the metal powder 3*a*, it is possible to considerably decrease a molding load (deformation resistance) applied to the molded body upon the re-compaction as shown in FIGS. 23 and 24. Namely, the molded body is substantially free from diffusion of carbon to thereby exhibit a low hardness and a large elongation. In addition, since the graphite remaining along the grain boundary of the metal powder acts to promote the sliding between particles of the metal powder, the molding load applied upon the re-compaction can be reduced and the plastic-worked body can be readily re-compacted into a desired shape. FIG. 23 shows the molding load in Example 1 and FIG. 24 shows the molding load in Example 2, respectively.

Figures 25A, 25B:
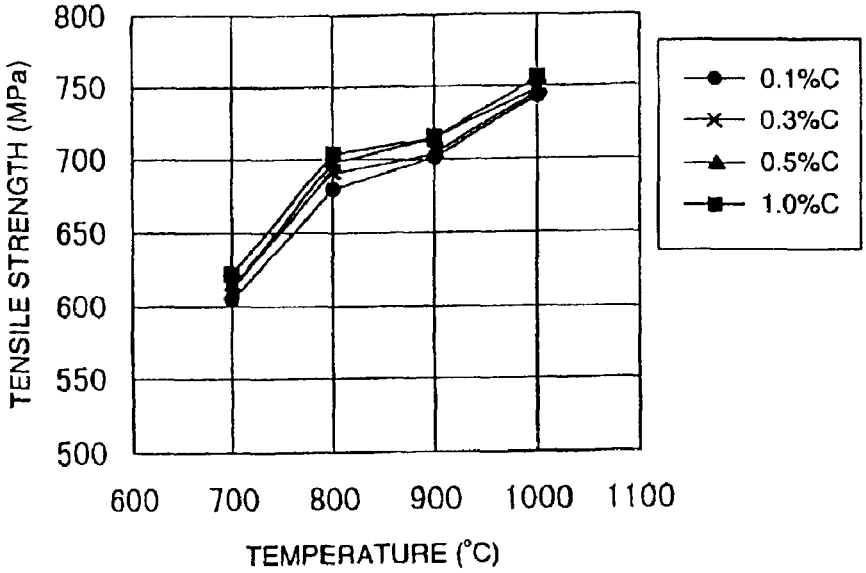
FIGS. 25(A) and 25(B) are diagrams showing, by data and graph, a variation of tensile strength of a plastic-worked body corresponding to Example 1 with variations of an amount of the graphite present in the plastic-worked body and the provisional sintering temperature.
Figures 26A, 26B:
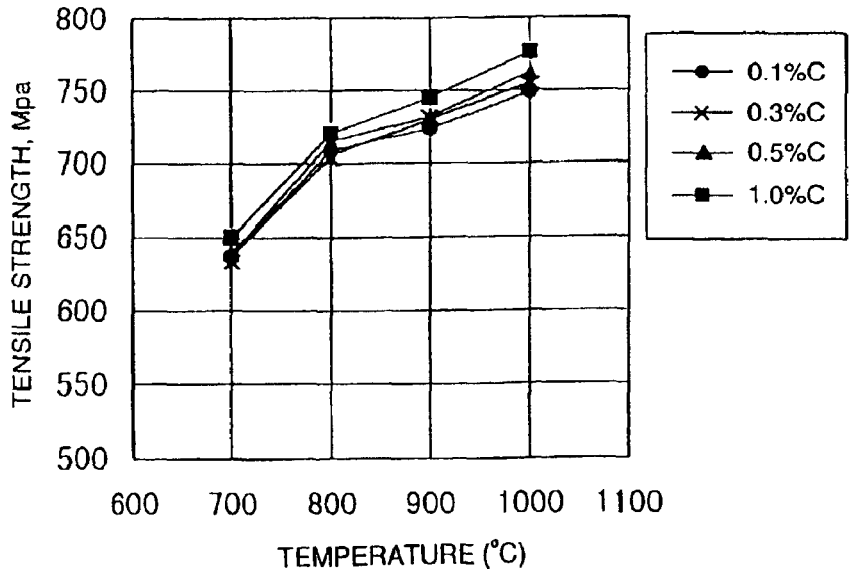
FIGS. 26(A) and 26(B) are diagrams showing, by data and graph, a variation of tensile strength of a plastic-worked body corresponding to Example 2 with variations of an amount of the graphite present in the plastic-worked body and the provisional sintering temperature.
Figures 27A, 27B:
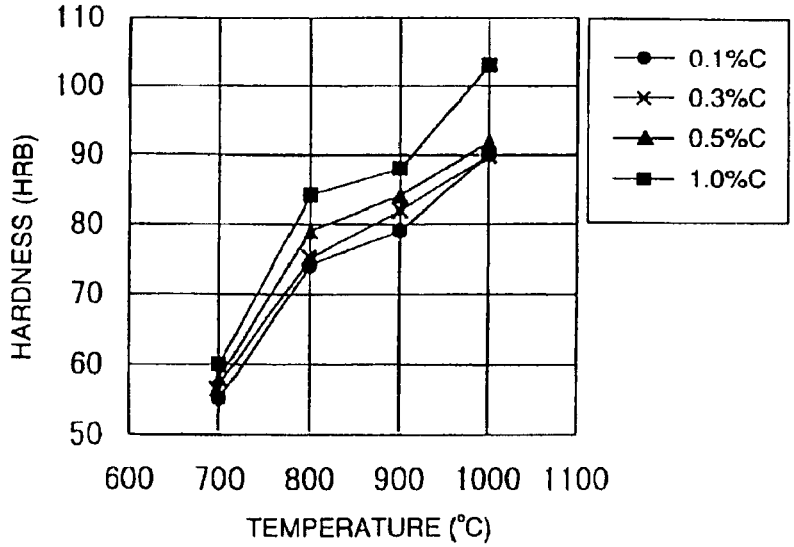
FIGS. 27(A) and 27(B) are diagrams showing, by data and graph, a variation of hardness of a plastic-worked body corresponding to Example 1 with variations of an amount of the graphite present in the plastic-worked body and the provisional sintering temperature.
Figures 28A, 28B:
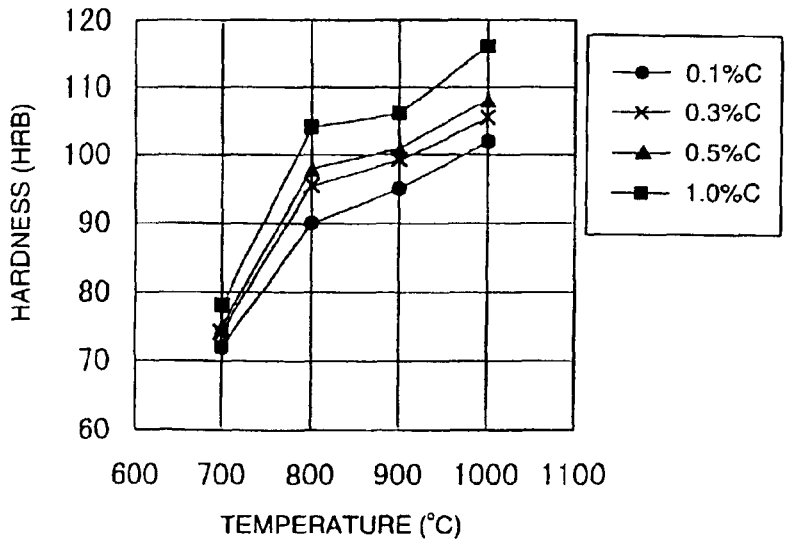
FIGS. 28(A) and 28(B) are diagrams showing, by data and graph, a variation of hardness of a plastic-worked body corresponding to Example 2 with variations of an amount of the graphite present in the plastic-worked body and the provisional sintering temperature.

Also, by selecting the provisional sintering temperature within the range of 700–1000° C., the plastic-worked body can exhibit a sufficient tensile strength as shown in FIGS. 25 and 26 and a sufficient hardness as shown in FIGS. 27 and 28. Meanwhile, FIGS. 25 and 27 illustrate the tensile strength and the hardness in Example 1 and FIGS. 26 and 28 illustrate those in Example 2. Thus, the plastic-worked body can exhibit substantially the same tensile strength and hardness as those of cast/forging materials and therefore the sufficiently increased mechanical strength.

In the case of re-compaction with a relatively small deformation, it is possible to readily perform re-deformation, that is, to conduct the plastic working again. In the case of re-compaction with a relatively large deformation, it is possible to obtain a high hardness due to the work hardening.

Figure 29:
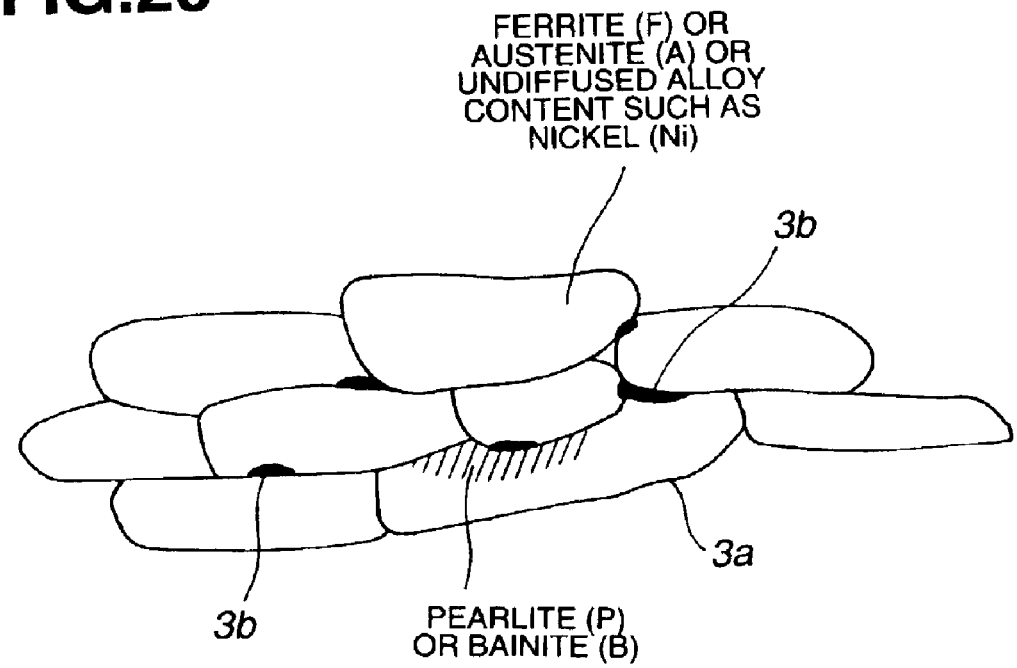
FIG. 29 is a diagram showing a structure of a plastic-worked body produced by re-compacting (cold forging) the molded body corresponding to Example 1 or 2 at a relatively small reduction in area (deformation rate).
Figure 30:
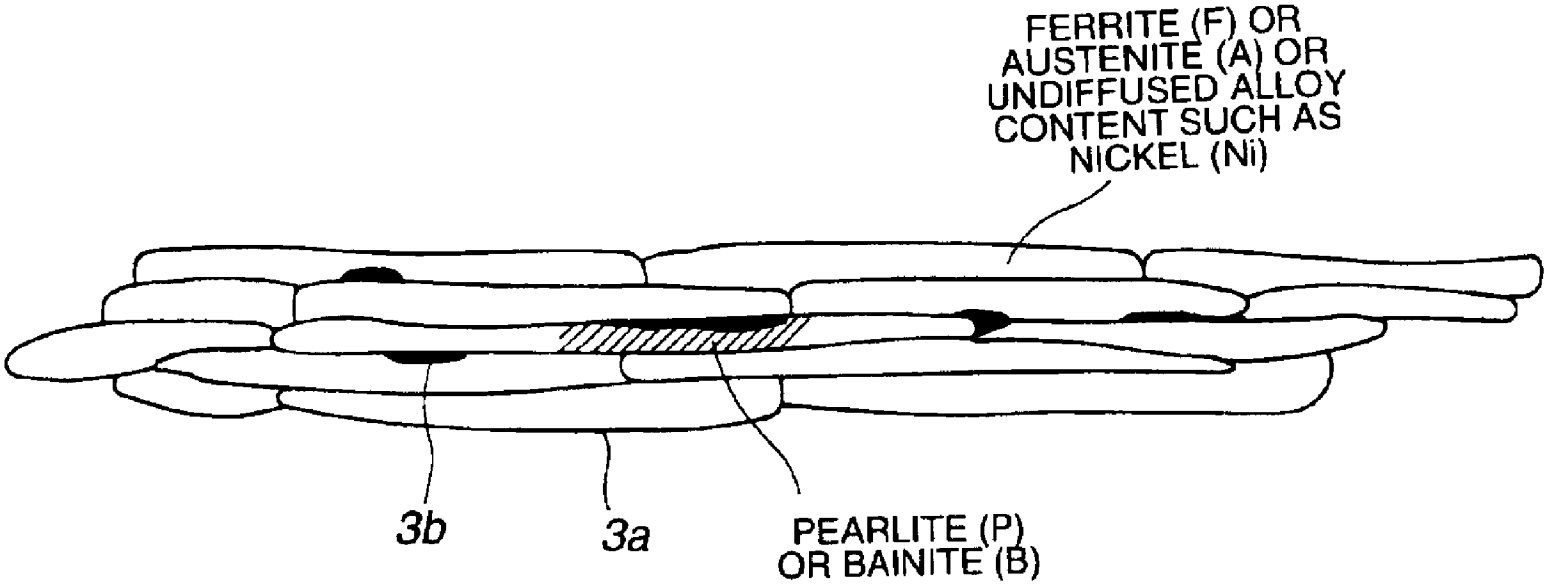
FIG. 30 is a diagram showing a structure of a plastic-worked body produced by re-compacting (cold forging) the molded body corresponding to Example 1 or 2 at a relatively large reduction in area.

FIG. 29 illustrates a structure of the plastic-worked body produced by the re-compaction with the relatively small deformation and FIG. 30 illustrates a structure of the plastic-worked body produced by the re-compaction with the relatively large deformation. In both of the structures, the graphite 3*b* remains along a grain boundary of the metal powder 3*a*. If the metal powder 3*a* is recited in at least certain claims, the structure thereof is a ferrite (F) structure, an austenite (A) structure or such a structure in which a slight amount of pearlite (P) or bainite (B) is precipitated in the vicinity of the graphite 3*b*. If the metal powder 3*a* is recited in at least certain claims, the structure thereof is a ferrite (F) structure; an austenite (A) structure, a structure in which at least one undiffused alloy component such as nickel (Ni) is co-present, or a structure in which a slight amount of pearlite (P) or bainite (B) is precipitated in the vicinity of the graphite 3*b*. In the structure shown in FIG. 29, the metal powder 3*a* is slightly deformed and voids between the metal particles are substantially lessened. In the structure shown in FIG. 30, the metal powder 3*a* is remarkably deformed to a flat shape and substantially all voids between the metal particles are eliminated.

Further, since the re-compaction of the molded body is conducted at ordinary temperature, production of scales or deteriorated dimensional accuracy of the obtained plastic-worked body due to transformation thereof can be prevented. Furthermore, since the molded body can be re-compacted using the lower molding load applied thereto, the spring-back thereof can be decreased as compared with that of forging materials and the plastic-worked body produced by the re-compaction can exhibit substantially a true density as a whole. As a result, the obtained plastic-worked body exhibits the less dispersion of density and dimensional variation than in the conventional sintered body. Thus, the plastic-worked body obtained by re-compacting the molded body can exhibit a high dimensional accuracy.

Accordingly, the obtained plastic-worked body is applicable to sliding parts requiring a high strength and a high accuracy.

Figure 31:
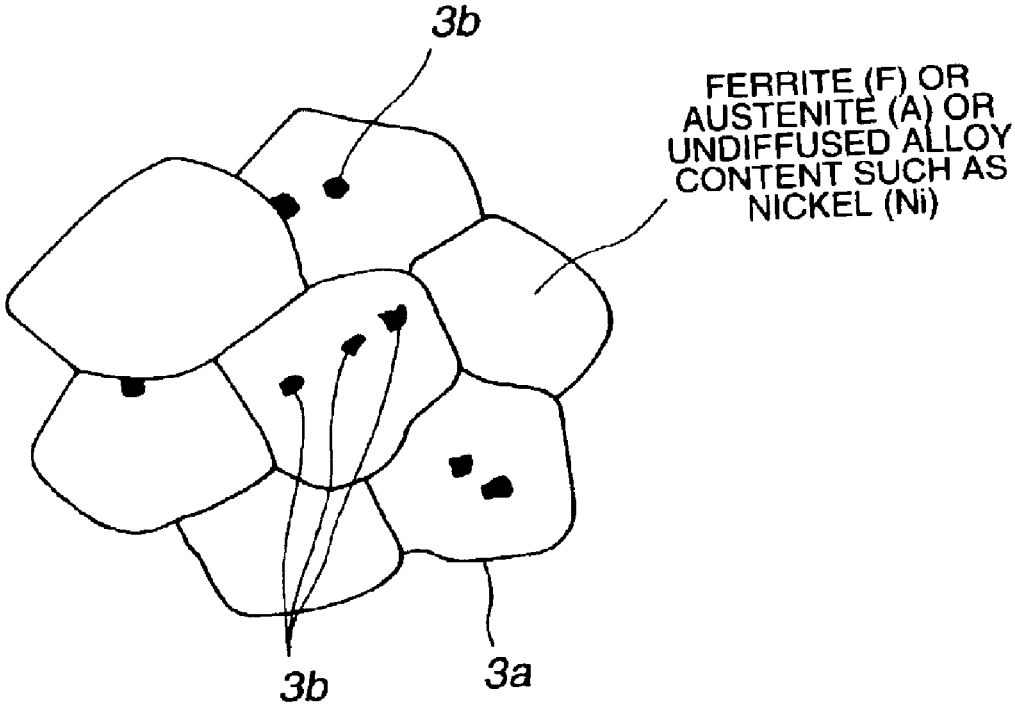
FIG. 31 is a diagram showing a structure of the re-sintered molded-body corresponding to Example 1 or 2.

The plastic-worked body is re-sintered at the subsequent re-sintering step 4. Upon the re-sintering, the sintering due to surface-diffusion or melting occurs at contact surfaces between the metal powder particles and, at the same time, the graphite 3*b* retained along the grain boundary of the metal powder 3*a* is diffused into a ferrite base material of the metal powder (to form a solid solution or a carbide therewith). As illustrated in FIG. 31, if the metal powder 3*a* is recited in at least certain claims, the structure thereof is a ferrite (F) structure, an austenite (A) structure, a pearlite (P) structure or a bainite (B) structure, and if the metal powder 3*a* is recited in at least certain claims, the structure thereof is a ferrite (F) structure, an austenite (A) structure, a pearlite (P) structure, a bainite (B) structure or a structure in which at least one undiffused alloy component such as nickel (Ni) coexists. If the residual graphite 3*b* is present, there is obtained such a structure in which the graphite 3*b* is interspersed inside or along the grain boundary of the metal powder 3*a*.

Figures 32A, 32B:
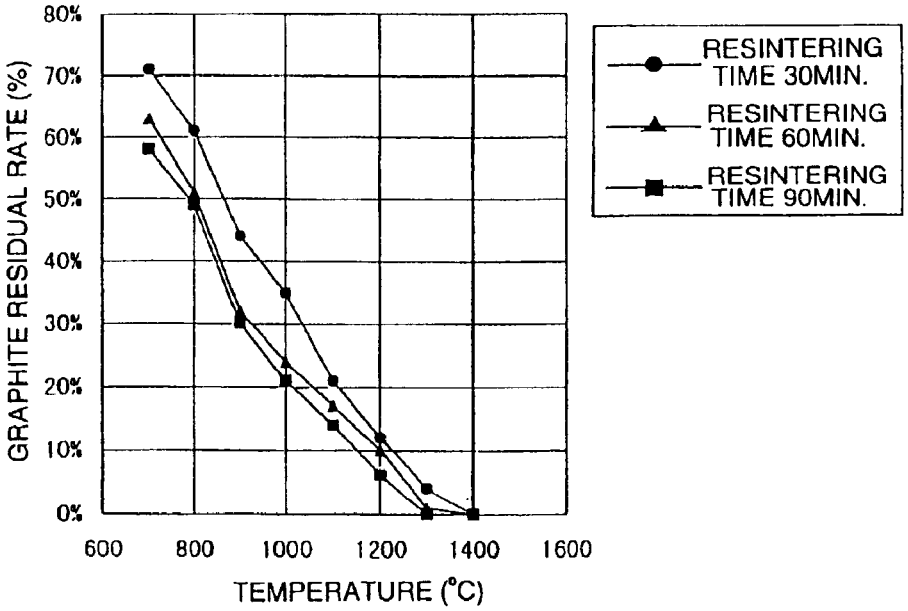
FIGS. 32(A) and 32(B) are diagrams showing, by data and graph, a variation of a graphite residual rate of the re-sintered molded-body corresponding to Example 1 with variations of the re-sintering temperature and the re-sintering time.
Figures 33A, 33B:
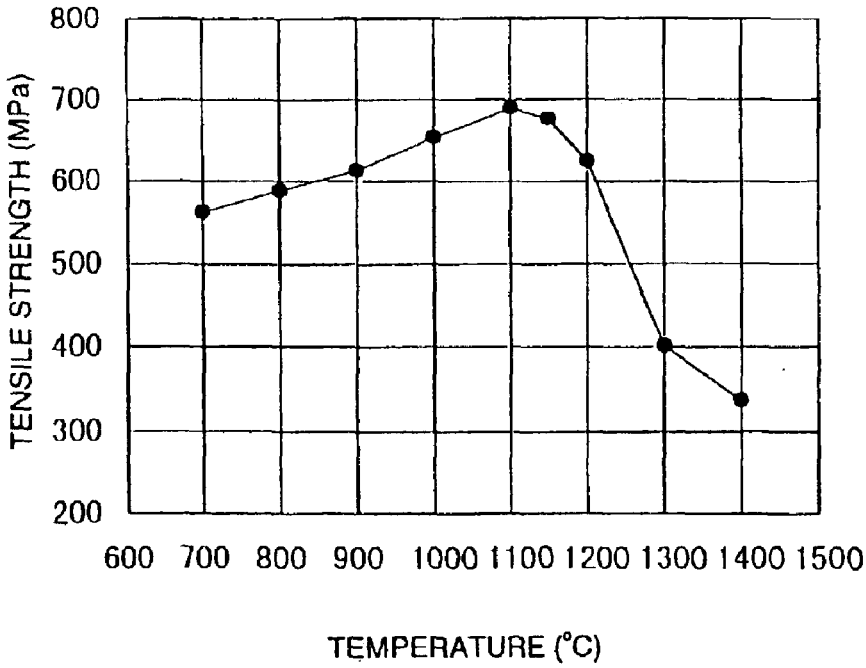
FIGS. 33(A) and 33(B) are diagrams showing, by data and graph, a variation of tensile strength of the re-sintered molded-body corresponding to Example 1 with variation of the re-sintering temperature.
Figures 34A, 34B:
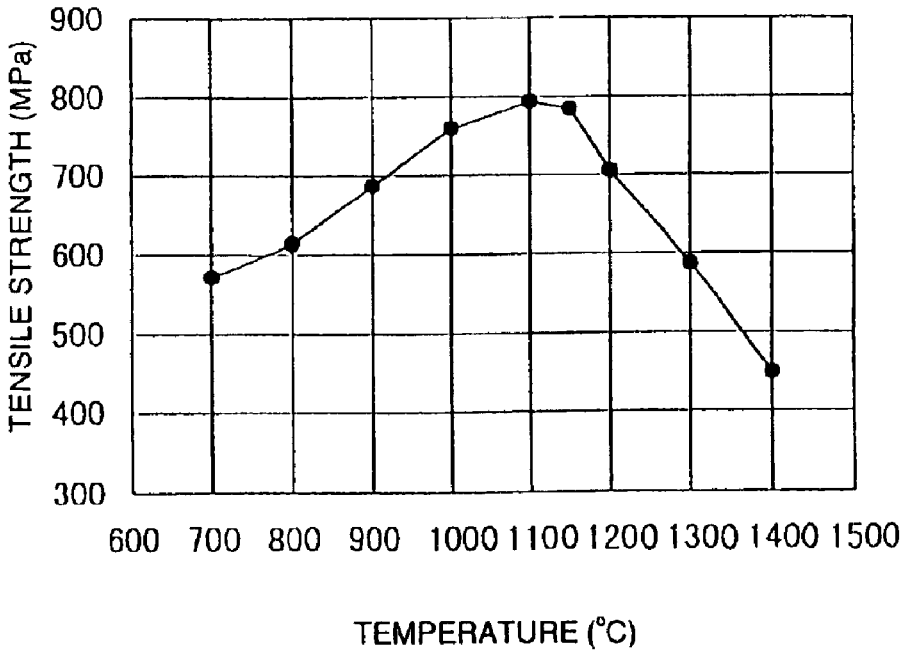
FIGS. 34(A) and 34(B) are diagrams showing, by data and graph, a variation of tensile strength of the re-sintered molded-body corresponding to Example 2 with variation of the re-sintering temperature.
Figures 35A, 35B:
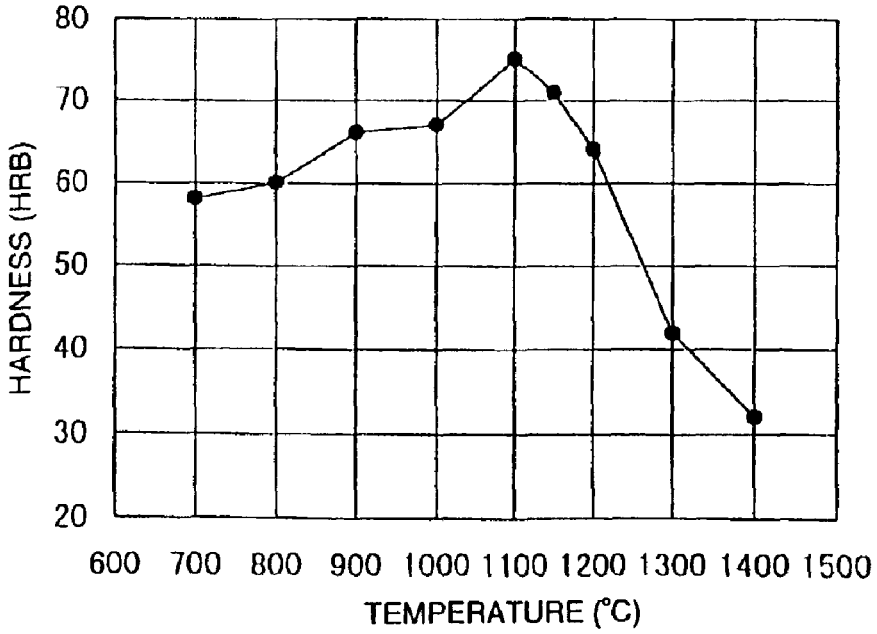
FIGS. 35(A) and 35(B) are diagrams showing, by data and graph, a variation of hardness of the re-sintered molded-body corresponding to Example 1 with variation of the re-sintering temperature.
Figures 36A, 36B:
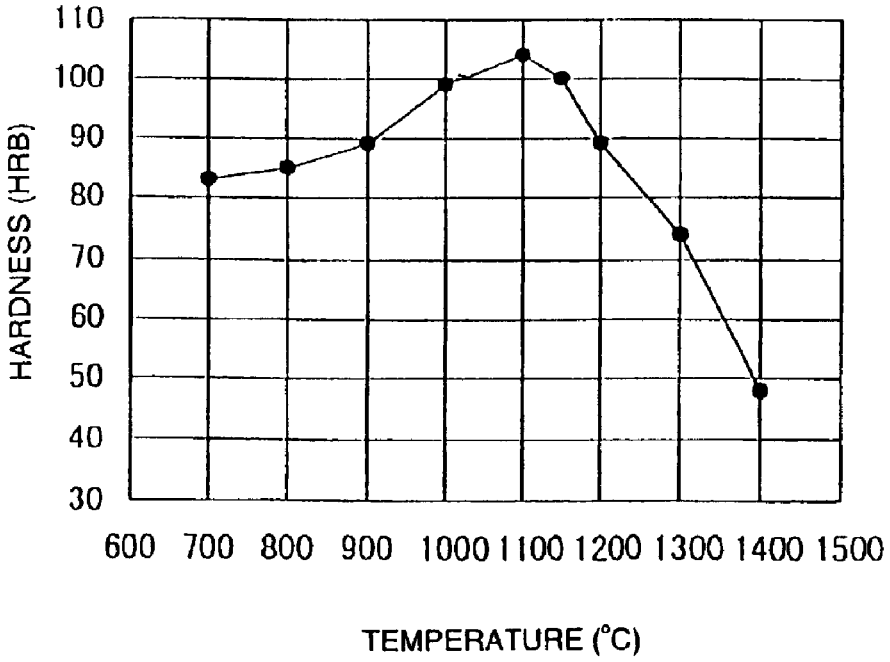
FIGS. 36(A) and 36(B) are diagrams showing, by data and graph, a variation of hardness of the re-sintered molded-body corresponding to Example 2 with variation of the re-sintering temperature.

Further, in the sintered body produced from the metallic powder mixture as recited in at least certain claims, as shown in FIG. 32, the residual rate of the blended graphite 3*b* (a rate of an amount of undiffused graphite to the total amount of carbon contents) becomes smaller as the re-sintering temperature raises. The re-sintered molded body has a structure in which the graphite 3*b* is diffused in the metal powder and a structure in which the graphite 3*b* remains therein, in a predetermined ratio depending on the re-sintering temperature. Here, in the case of the high re-sintering temperature, the graphite residual rate is zero as shown in FIG. 32 and the graphite 3*b* remaining structure is dissipated.

Also, upon the re-sintering, the alloy elements capable of forming a solid solution with a base material can produce a more uniform solid solution therewith, and those capable of forming precipitates such as carbides can produce precipitates. Thus, the effect of mechanical properties enhanced due to the added alloy elements can be reflected on the macro-structure of the re-sintered molded body, improving the mechanical properties of the re-sintered molded body as a whole.

For this reason, the strength of the re-sintered molded body is sufficiently higher than that of the plastic-worked body. In addition, by controlling an amount of the diffused graphite 3*b*, it is possible to obtain the re-sintered molded body depending on the desired mechanical properties such as strength and lubricating ability. The re-sintered molded body re-sintered at a predetermined temperature has a large tensile strength and a high hardness and can exhibit a mechanical strength substantially identical to or higher than those of cast/forging materials which do not require a specific hardened layer.

Further, by being subjected to the re-sintering after the re-compaction, the re-sintered molded body shows a re-crystallized structure having a fine crystal grain size of about 20 pm or less, which is smaller than the crystal grain size, i.e., 40–50 pm, of the conventional sintered body. This allows the re-sintered molded body to exhibit a high strength, a large elongation, a high fatigue strength and a high impact value and thus exhibit excellent mechanical properties.

Here, the re-sintering temperature is selected within a range of 700–1300° C. This is because if the re-sintering temperature is lower than 700° C., the diffusion of the graphite 3*b* will not proceed, while if the re-sintering temperature is higher than 1300° C., carburization, decarburization or bulky growth of the crystal grains of the re-sintered molded body will occur.

Also, as shown in FIGS. 33–36, if the re-sintering temperature is in the relatively low range of 700–1000° C., the hardness of the re-sintered molded body work-hardened upon the re-compaction is reduced by the re-sintering, but as the diffusion of the graphite 3*b* proceeds, the structure containing the fine crystal grains is obtained due to the low-temperature re-sintering. As a result, the strength and hardness of the obtained re-sintered molded body is increased. Meanwhile, depending on the shape of the plastic-worked body re-compacted, the low-temperature re-sintering causes a large reduction in hardness of the work-hardened re-sintered molded body is slowly softened and hardened again at approximately 1000° C.

Further, in a case where the re-sintering temperature is in the relatively high range of 1000–1300° C., the residual rate of the graphite 3*b* is low and the graphite 3*b* is diffused in the base material of the metal powder. This allows the strength and hardness of the obtained re-sintered molded body to increase. However, if the re-sintering temperature exceeds 1100° C., there will occur such a tendency that the total amount of carbon contents decreases as the amount of carbon decarburized increases, or the strength and hardness of the obtained re-sintered molded body are reduced due to the re-growth of the crystal. grains. If the re-sintering temperature is higher than 1300° C., the mechanical properties of the obtained re-sintered molded body is remarkably reduced. Therefore, the re-sintering temperature is preferably within the range of 900–1300° C.

Next, the re-sintered molded body is subjected to heat treatment at the heat treatment step 105. The heat treatment may include induction quenching, carburizing-quenching, nitriding and the combination thereof. By the heat treatment, the graphite 3*b* forms the super-saturated solid solution with the base material or the precipitate as fine carbides to thereby form a hardened layer in the re-sintered molded body.

Figures 37A, 37B:
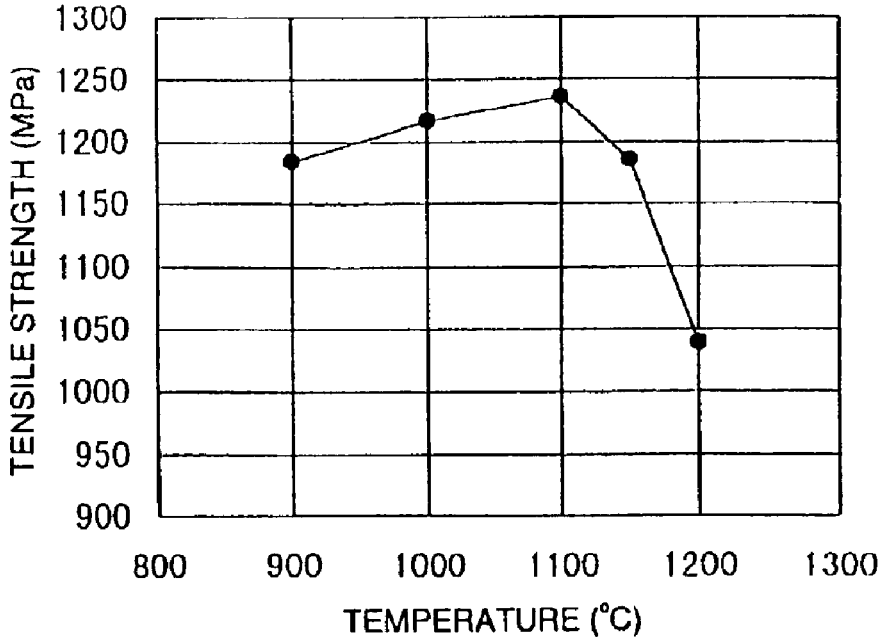
FIGS. 37(A) and 37(B) are diagrams showing, by data and graph, a variation of tensile strength of the heat-treated molded-body corresponding to Example 1 with variation of the re-sintering temperature.
Figures 38A, 38B:
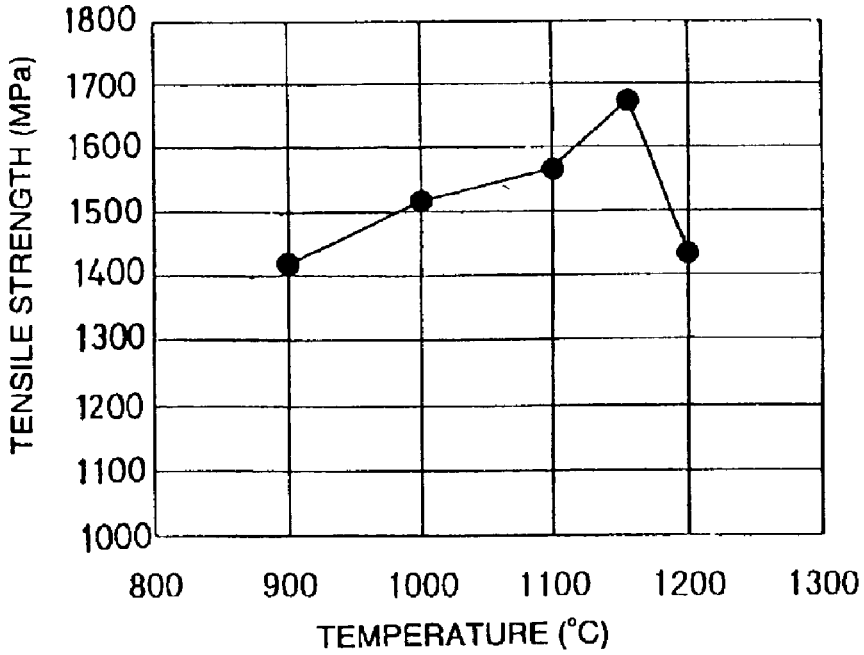
FIGS. 38(A) and 38(B) are diagrams showing, by data and graph, a variation of tensile strength of the heat-treated molded-body corresponding to Example 2 with variation of the re-sintering temperature.
Figures 39A, 39B:
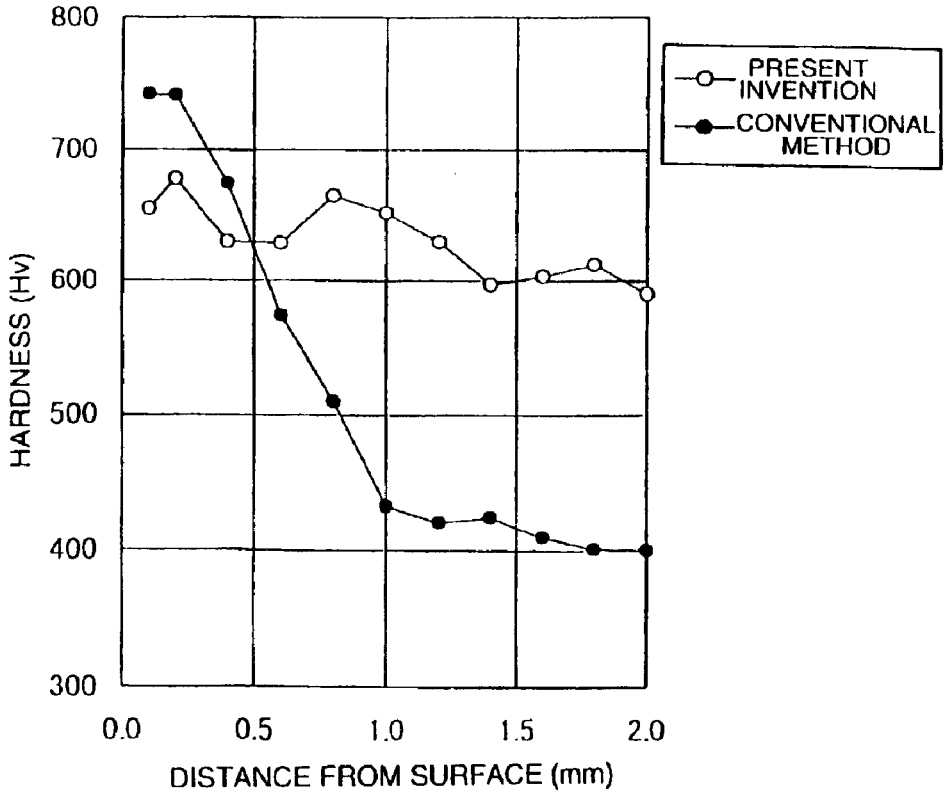
FIGS. 39(A) and 39(B) are diagrams showing, by data and graph, internal hardness distribution of the heat-treated molded-body. corresponding to Example 2, and internal hardness distribution of the heat-treated molded-body obtained by provisionally compacting the same metallic powder mixture as that in Example 2 to form a preform having a density of 7.0 g/cm$^3$ and then heat-treating the preform under the same condition as that in Example 2 (as a conventional manner).

As illustrated in FIGS. 37 and 38, the obtained heat-treated molded body has a tensile strength larger than that of the re-sintered molded body due to the hardened layer produced therein. As be appreciated from the relationship between the hardness and the distance from surface as shown in FIG. 39, since the heat-treated molded body of the present invention has substantially a true density, the degree of diffusion of carbon caused by the heat treatment becomes lessened towards an inside thereof. Thus, the heat-treated molded body shows a high hardness at the near-surface portion due to the heat treatment, while exhibiting a good toughness thereinside. Accordingly, the heat-treated molded body of the present invention exhibits excellent mechanical properties as a whole. On the other hand, the heat-treated molded body produced by the conventional method exhibits diffusion of carbon proceeding to an inside thereof and a high hardness, but it is fragile and lowered in toughness and rigidity due to the presence of voids therein.

Namely, since the heat-treated molded body produced by the conventional method is heat-treated as a whole and has the voids therein, it is difficult to obtain high strength and high toughness. Conversely, the heat-treated molded body of the present invention has the strength, toughness and rigidity higher than those of a general sintered body to thereby be capable of being heat-treated depending on a desired mechanical property, similar to cast/forging materials. In addition, in a case where the metal powder contains the alloy element capable of forming a solid solution with a base material of the metal powder to thereby improve a heat-treatment ability such as hardenability, it is possible to produce the heat-treated molded body having better mechanical properties, from the metal powder.

Accordingly, the obtained heat-treated molded body may be applied to machine parts requiring high strength, high toughness and high sliding property, at a low cost. The machine parts include automobile engine components such as a camshaft and a rotor, propeller shaft joints, drive shafts, clutches, drive parts such as transmission, power steering gears, steering parts such as anti-lock device, suspensions, various bearings, pump components and the like.

The present invention is not limited to the embodiments as described above. For instance, the preform 8 can be produced by so-called warm molding in which the preform 8 is formed under condition that the metallic powder mixture 7 and the forming die are heated up to a predetermined temperature to thereby lower a yielding point of the metallic powder mixture 7.

Also, although the upper punch 16 is formed with the notch 23 increasing the volume of the mold cavity 15 in the embodiment, the notch 23 can be formed in the lower punch 17 or both of the upper and lower punches 16 and 17.

EXAMPLES

Example 1

A metallic powder mixture was prepared by blending graphite in an amount of 0.3% by weight with an alloy steel powder containing molybdenum (Mo) in an amount of 0.2% by weight with the balance containing iron (Fe) and a small amount of inevitable impurities. The obtained metallic powder mixture was compacted to form a preform having a density of 7.4 g/cm$^3$. The obtained preform was provisionally sintered in a nitrogen atmosphere within a furnace at 800° C. for 60 minutes, to form a molded body. The elongation of the obtained molded body was 11.2% and the hardness thereof was HRB53.3 (see FIGS. 19 and 21).

Subsequently, the molded body was re-compacted (cold forged) by backward extrusion at a reduction in area (deformation rate) of form a plastic-worked body having a cup shape.

The molding load (deformation resistance) applied to the molded body upon the plastic-worked body being obtained, was 2078 MPa (see FIG. 23). The tensile strength (in terms of radial crushing strength) of the obtained plastic-worked body was 692 MPa and the hardness thereof was HRB75 (see FIGS. 25 and 27). Here, the density of the obtained plastic-worked body was 7.71 g/cm$^3$.

Next, the plastic-worked body was re-sintered in an atmosphere of a mixed gas of nitrogen and hydrogen within a furnace at 1150° C., to thereby form a re-sintered molded body. The tensile strength (in terms of radial crushing strength) of the obtained re-sintered molded body was 676 MPa and the hardness thereof was HRB71 (see FIGS. 33 and 35). Here, the density of the obtained re-sintered molded body was 7.71 g/cm$^3$.

After that, the re-sintered molded body was carburized in an atmosphere having a carbon potential of 1.0% within a furnace at the maximum temperature of 860° C., oil-quenched at 90° C., tempered at 150° C., to thereby form a heat-treated molded body. As a result, the tensile strength (in terms of radial crushing strength) of the obtained heat-treated molded body was 1185 MPa (see FIG. 37), the surface hardness thereof was HRC59 and the internal hardness (hardness at the portion 2 mm-inward from the surface) thereof was HRC33 (HV330).

Example 2

A metallic powder mixture was prepared by blending graphite in an amount of 0.3% by weight with an alloy steel powder obtained by diffusing and depositing nickel (Ni) in an amount of 2.0% by weight and molybdenum (Mo) in an amount of 1.0% by weight onto an iron powder containing iron (Fe) and a small amount of inevitable impurities. The obtained metallic powder mixture was compacted tp form a preform having a density of 7.4 g/cm$^3$. The obtained preform was provisionally sintered in a nitrogen atmosphere within a furnace at 800° C. for 60 minutes, to form a molded body. The elongation of the obtained molded body was 11.8% and the hardness thereof was HRB52 (see FIGS. 20 and 22).

Next, the molded body was re-compacted (cola forged) by backward extrusion at a reduction in area (deformation rate) of 60% to form a plastic-worked body having a cup shape.

The molding load (deformation resistance) applied to the molded body upon the plastic-worked body being obtained, was 2428 MPa (see FIG. 24). The tensile strength (in terms of radial crushing strength) of the obtained plastic-worked body was 7O6 MPa and the hardness thereof was HRB96 (see FIGS. 26 and 28). Here, the density of the obtained plastic-worked body was 7.70 g/cm$^3$.

Next, the plastic-worked body was re-sintered in an atmosphere of a mixed gas of nitrogen and hydrogen within a furnace at 1150° C., to thereby form a re-sintered molded body. Here, the tensile strength (in terms of radial crushing strength) of the obtained re-sintered molded body was 784 MPa and the hardness thereof was HRB100 (see FIGS. 34 and 36). The density of the obtained re-sintered molded body was 7.70 g/cm$^3$.

After that, the re-sintered molded body was carburized in an atmosphere having a carbon potential of 1.0% within a furnace at the maximum temperature of 860° C., oil-quenched at 90° C., tempered at 150° C., to thereby form a heat-treated molded body. As a result, the tensile strength (in terms of radial crushing strength) of the obtained heat-treated molded body was 1678 MPa, the surface hardness thereof was HRC62 and the internal hardness (hardness at the portion 2 mm-inward from the surface) thereof was HRC41 (HV400) (see FIGS. 38 and 39).

Example 3

A metallic powder mixture was prepared by blending copper (Cu) in an amount of 2.0% by weight and graphite in an amount of 0.3% by weight with an iron powder containing iron (Fe) and a small amount of inevitable impurities. The obtained metallic powder mixture was compacted to form a preform having a density of 7.4 g/cm$^3$. The obtained preform was provisionally sintered in a nitrogen atmosphere within a furnace at 800° C. for 60 minutes, to form a molded body. The elongation of the obtained molded body was 12.0% and the hardness thereof was HRB47.

Next, the molded body was re-compacted (cold forged) by backward extrusion at a reduction in area of 60% to form a plastic-worked body having a cup shape.

The molding load (deformation resistance) applied to the molded body upon the plastic-worked body being obtained, was 196 OMPa. The tensile strength (in terms of radial crushing strength) of the obtained plastic-worked body was 51 OMPa and the hardness thereof was HRB75. Here, the density of the obtained plastic-worked body was 7.70 g/cm$^3$.

Next, the plastic-worked body was re-sintered in an atmosphere of a mixed gas of nitrogen and hydrogen within a furnace at 1150° C., to thereby form a re-sintered molded body. Here, the tensile strength (in terms of radial crushing strength) of the obtained re-sintered molded body was 735 MPa, the hardness thereof was HRB8O, and the density of the obtained re-sintered molded body was 7.75 g/cm$^3$.

After that, the re-sintered molded body was carburized in an atmosphere having a carbon potential of 1.0% within a furnace at the maximum temperature of 860° C., oil-quenched at 90° C., tempered at 150° C., to thereby form a heat-treated molded body. As a result, the tensile strength (in terms of radial crushing strength) of the obtained heat-treated molded body was 98 OMPa, the surface hardness thereof was HRC42 and the internal hardness (hardness at the portion 2 mm-inward from the surface) thereof was HRB91.

Examples 4–7 will be explained hereinafter. These Examples are different in components of the alloy steel powder from Example 1 as described above and are the same as Example 1 in the amount of graphite (0.3% by weight) blended with the alloy steel powder, the density (7.4 g/cm3)

of the preform, the provisional sintering conditions (in the nitrogen atmosphere within the furnace at 800° C. for 60 minutes), the re-compaction conditions (at a reduction in area of 60%), the re-sintering conditions (in the atmosphere of the mixed gas of nitrogen and hydrogen within the furnace at 1150° C.), and the heat-treatment conditions (in the atmosphere having the carbon potential of 1.0% within the furnace at the maximum temperature of 860° C., the oil-quenching at 90° C., the tempering at 150° C.). The components of the alloy steel powder and the test results in these Examples are described below.

Example 4

755 Mpa HRB85 1235 Mpa HRC6O

An alloy steel powder was constituted by 1.0% by weight of nickel (Ni), 0.3% by weight of molybdenum (Mo), 0.3% by weight of copper (Cu) with the balance containing iron (Fe) and a small amount of inevitable impurities.

(a) molding load upon re-compaction: 2195 MPa (b) tensile strength of plastic-worked body: 725 MPa (c) hardness of plastic-worked body: HRB82

(d) density of plastic-worked body: 7.74 g/cm$^3$ (e) tensile strength of re-sintered molded body: 755 MPa (f) hardness of re-sintered molded body: HRB85

(g) density of re-sintered molded body: 7.74 g/cm3

(h) tensile strength of heat-treated molded body: 1235 MPa (i) surface hardness of heat-treated molded body: HRC60

(j) internal hardness of heat-treated molded body: HRC33 (HV326)

Example 5

An alloy steel powder was constituted by 1.0% by weight of chromium (Cr), 0.7% by weight of manganese (Mn), 0.3% by weight of molybdenum (Mo) with the balance containing iron (Fe) and a small amount of inevitable impurities.

(a) molding load upon re-compaction: 2333 MPa (b) tensile strength of plastic-worked body: 7O6 MPa (c) hardness of plastic-worked body: HRB80

(d) density of plastic-worked body: 7.66 g/cm3

(e) tensile strength of re-sintered molded body: 794 MPa (f) hardness of re-sintered molded body: HRB90

(g) density of re-sintered molded body: 7.66 G/CM$^3$ (h) tensile strength of heat-treated molded body: 1323 MPa (i) surface hardness of heat-treated molded body: HRC6O (j) internal hardness of heat-treated molded body: HRC42 (HV418)

Example 6

An alloy steel powder was constituted by 1.0% by weight of chromium (Cr), 0.3% by weight of molybdenum (Mo), 0.3% by weight of vanadium (V) with the balance containing iron (Fe) and a small amount of inevitable impurities.

(a) molding load upon re-compaction: 2362 MPa (b) tensile strength of plastic-worked body: 725 MPa (c) hardness of plastic-worked body: HRB82

(d) density of plastic-worked body: 7.65 g/cm$^3$ (e) tensile strength of re-sintered molded body: 804 MPa (f) hardness of re-sintered molded body: HRB88

(g) density of re-sintered molded body: 7.65 g/cm$^3$ (h) tensile strength of heat-treated molded body molded body: HRC63

(j) internal hardness of heat-treated molded body: HRC43 (HV421)

Example 7

An alloy steel powder was constituted by 6.5% by weight of cobalt (Co), 8.0% by weight of chromium (Cr), 2.0% by weight of tungsten (W), 0.5% by weight of molybdenum (Mo) with the balance containing iron (Fe) and a small amount of inevitable impurities.

(a) molding load upon re-compaction: 2450 MPa (b) tensile strength of plastic-worked body: 696 MPa (c) hardness of plastic-worked body: HRB95

(d) density of plastic-worked body: 7.60 g/cm$^3$ (e) tensile strength of re-sintered molded body: 784 MPa (f) hardness of re-sintered molded body: HRB100

(g) density of re-sintered molded body: 7.60 g/cm3

(h) tensile strength of heat-treated molded body: 1176 MPa (i) surface hardness of heat-treated molded body: HRC66

(j) internal hardness of heat-treated molded body: HRC45 (HV450)

As explained above, the metallic powder-molded body of the present invention has a predetermined graphite content suitably applied to the production of machine parts having a high mechanical strength, and exhibits the mechanical properties such as a low hardness and a large elongation (deformability), which are advantageous to re-compaction thereof.

Further, the re-compacted body of the present invention exhibits the enhanced mechanical properties including hardness, fatigue strength and the like, and the increased dimensional accuracy.

INDUSTRIAL APPLICABILITY

The present invention is not limited to the above-described embodiments and may be modified without diverting from the scope of the present invention. For instance, the preform 8 can be produced by so-called warm molding in which the preform 8 is formed under condition that the metallic powder mixture 7 and the forming die are heated up to a predetermined temperature to lower a yielding point of the metallic powder mixture 7.

Also, although the upper punch 16 formed with the notch 23 for increasing the volume of the mold cavity 15, is used at the preliminary molding step 1, the notch 23 can be formed in the lower punch 17 or both of the upper and lower punches 16 and 17.

What is claimed is:

1. A metallic powder-molded body produced by a process comprising the steps of:

compacting a metallic powder mixture obtained by blending graphite with an iron-based metal powder to form a preform having a density of not less than 7.3 g/cm$^3$; and provisionally sintering the preform at a temperature of 700–1000° C. to form the metallic powder-molded body, said metallic powder-molded body having a structure in which the graphite remains along a grain boundary of the metal powder.

2. The metallic powder-molded body as claimed in claim 1, wherein the amount of the graphite blended with the metal powder is 0.3% by weight or more.

3. A re-compacted body produced by re-compacting the metallic powder-molded body as claimed in claim 1.

4. A sintered body produced by a process comprising the steps of:

compacting a metallic powder mixture obtained by blending graphite with an iron-based metal powder to form a preform having a density of not less than 7.3 g/cm$^3$;

provisionally sintering the preform at a temperature of 700–1000° C. to form a metallic powder-molded body having a structure in which the graphite remains along a grain boundary of the metal powder;

re-compacting the metallic powder-molded body to form a re-compacted body; and re-sintering the re-compacted body at a predetermined temperature, said sintered body having a structure in which the graphite particle is diffused or remains in the metal powder and along a grain boundary thereof at a predetermined rate.

5. The sintered body as claimed in claim 4, wherein the amount of the graphite blended with the metal powder is 0.3% by weight or more.

6. A sintered body produced by a process comprising the steps of:

compacting a metallic powder mixture obtained by blending graphite with an iron-based metal powder to form a preform having a density of not less than 7.3 g/cm$^3$;

provisionally sintering the preform at a temperature of 700–1000° C. to form a metallic powder-molded body having a structure in which the graphite remains along a grain boundary of the metal powder;

re-compacting the metallic powder-molded body to form a re-compacted body;

re-sintering the re-compacted body at a predetermined temperature to form a sintered body having a structure in which the graphite is diffused or remains in the metal powder and along a grain boundary thereof at a predetermined rate; and heat-treating the sintered body.

7. The sintered body as claimed in claim 6, wherein the amount of the graphite blended with the metal powder is 0.3% by weight or more.

8. A metallic powder-molded body comprising the metallic powder mixture as claimed in claim 1, wherein said metallic powder mixture is an iron-based alloy steel powder containing at least one alloy element selected from the group consisting of molybdenum (Mo), nickel (Ni), manganese (Mn), copper (Cu), chromium (Cr), tungsten (W), vanadium (V), cobalt (Co) and the like, which element is capable of forming a solid solution with a base material of the metal powder to enhance mechanical properties such as strength and hardenability, or capable of forming a precipitate such as carbide to enhance mechanical properties such as strength and hardness, said metallic powder-molded body, when being provisionally sintered, having a structure in which the graphite remains along a grain boundary of the metal powder and which contains substantially no precipitate such as carbides of iron or the alloy elements.

9. A metallic powder-molded body comprising the metallic powder mixture as claimed in claim 1, wherein said metallic powder mixture is obtained by diffusing and depositing a powder containing as a main component, an alloy element selected from the group consisting of molybdenum (Mo), nickel (Ni); manganese (Mn), copper (Cu), chromium (Cr), tungsten (W), vanadium (V), cobalt (Co) and the like, which element is capable of forming a solid solution with a base material of the metal powder to enhance mechanical properties such as strength and hardenability, or capable of forming a precipitate such as carbide to enhance mechanical properties such as strength and hardness, onto said iron-based metal powder, said metallic powder-molded body, when being provisionally sintered, having a structure in which the graphite remains along a grain boundary of the metal powder and which contains substantially no precipitate such as carbides of iron or the alloy element.

10. A metallic powder-molded body comprising the metallic powder mixture as claimed in claim 1, wherein said metallic powder mixture is obtained by blending a powder containing as a main component, an alloy element selected from the group consisting of molybdenum (Mo), nickel (Ni), manganese (Mn), copper (Cu), chromium (Cr), tungsten (W), vanadium (V), cobalt (Co) and the like, which element is capable of forming a solid solution with a base material of the metal powder to enhance mechanical properties such as strength and hardenability, or capable of forming a precipitate such as carbide to enhance mechanical properties such as strength and hardness, with the iron-based metal powder, said metallic powder-molded body, when being provisionally sintered, having a structure in which the graphite remains along a grain boundary of the metal powder and which contains substantially no precipitate such as carbides of iron or the alloy element.

11. The metallic powder-molded body as claimed in claim 8, wherein the amount of the graphite blended with the metal powder is 0.1% by weight or more.

12. A re-compacted body produced by re-compacting the metallic powder-molded body as claimed in claim 8, wherein the re-compacted body has a dense structure containing substantially no voids.

13. The re-compacted body claimed in claim 12, wherein the amount of the graphite blended with the metal powder is 0.1% by weight or more.

14. A sintered body obtained by re-sintering the re-compacted body as claimed in claim 12 at a predetermined temperature, wherein the sintered body has a graphite-diffused structure and a graphite-remaining structure at a predetermined ratio determined depending on the predetermined re-sintering temperature.

15. A sintered body produced by heat-treating the sintered body as claimed in claim 14, wherein the sintered body heat-treated has a hardened structure.

16. The sintered body claimed in claim 14, wherein the amount of the graphite blended with the metal powder is 0.1% by weight or more.

17. A re-compacted body produced by a process comprising the steps of:

forming a preform using a device comprising a forming die having a mold cavity to be filled with the metallic powder mixture, and upper and lower punches inserted into the forming die to press the metallic powder mixture, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an end surface thereof facing the mold cavity to increase a volume of the mold cavity;

provisionally sintering the preform at a temperature of 700–1000° C. to form the metallic powder-molded body as claimed in claim 8; and re-compacting the metallic powder-molded body to form a re-compacted body.

18. The re-compacted body as claimed in claim 17, wherein the amount of the graphite blended with the metal powder is 0.1% by weight or more.

19. A sintered body produced by a process comprising the steps of:

forming a preform using a device comprising a forming die having a mold cavity to be filled with the metallic powder mixture, and upper and lower punches inserted into the forming die to press the metallic powder mixture, said mold cavity being formed with a greater-diameter portion into which the upper punch is inserted, a smaller-diameter portion into which the lower punch is inserted, and a tapered portion connecting the greater-diameter and smaller-diameter portions with each other, and either one or both of the upper and lower punches having a notch at an end surface thereof facing the mold cavity to increase a volume of the mold cavity;

provisionally sintering the preform at a temperature of 700–1000° C. to form the metally powder-molded body as claimed in claim 8;

re-compacting the metallic powder-molded body to form a re-compacted body; and re-sintering the re-compacted body to form the sintered body.

20. The sintered body as claimed in claim 19, wherein the amount of the graphite blended with the metal powder is 0.1% by weight or more.

21. A sintered body produced by conducting the re-sintering as claimed in claim 4, wherein the re-sintering temperature is within a range of 700–1300° C.

* * * * *